US010643631B2

(12) United States Patent
Moriya et al.

(10) Patent No.: US 10,643,631 B2
(45) Date of Patent: May 5, 2020

(54) DECODING METHOD, APPARATUS AND RECORDING MEDIUM

(71) Applicants: Nippon Telegraph and Telephone Corporation, Chiyoda-ku (JP); The University of Tokyo, Bunkyo-ku (JP)

(72) Inventors: Takehiro Moriya, Atsugi (JP); Yutaka Kamamoto, Atsugi (JP); Noboru Harada, Atsugi (JP); Hirokazu Kameoka, Atsugi (JP); Ryosuke Sugiura, Bunkyo-ku (JP)

(73) Assignees: Nippon Telegraph and Telephone Corporation, Chiyoda-ku (JP); The University of Tokyo, Bunkyo-ku (JP)

( * ) Notice: Subject to any disclaimer, the term of this patent is extended or adjusted under 35 U.S.C. 154(b) by 0 days.

(21) Appl. No.: 16/601,740

(22) Filed: Oct. 15, 2019

(65) Prior Publication Data

US 2020/0043506 A1 Feb. 6, 2020

Related U.S. Application Data

(63) Continuation of application No. 16/398,429, filed on Apr. 30, 2019, now Pat. No. 10,504,533, which is a (Continued)

(30) Foreign Application Priority Data

Apr. 24, 2014 (JP) ..... 2014-089895

(51) Int. Cl.
*G10L 19/07* (2013.01)
*G10L 19/02* (2013.01)
(Continued)

(52) U.S. Cl.
CPC ..... *G10L 19/07* (2013.01); *G10L 19/02* (2013.01); *G10L 19/12* (2013.01); *G10L 25/06* (2013.01); *G10L 25/12* (2013.01)

(58) Field of Classification Search
None
See application file for complete search history.

(56) References Cited

U.S. PATENT DOCUMENTS 5,003,604 A * 3/1991 Okazaki ..... G10L 19/00 704/207
5,327,518 A * 7/1994 George ..... G10L 19/02 704/211
(Continued)

FOREIGN PATENT DOCUMENTS

JP 4-5700 A 1/1992
JP 8-305397 A 11/1996
(Continued)

OTHER PUBLICATIONS

3rd Generation Partnership Project (3GPP), "Technical Specification Group Services and System Aspects; Audio codec processing functions; Extended Adaptive Multi-Rate—Wideband (AMR-WB+) codec; Transcoding functions (Release 10)," Technical Specification (TS) 26.290, Version 10.0.0, Mar. 2011, (85 pages).
(Continued)

*Primary Examiner* — Marcus T Riley
(74) *Attorney, Agent, or Firm* — Oblon, McClelland, Maier & Neustadt, L.L.P.

(57) ABSTRACT

The present invention reduces encoding distortion in frequency domain encoding compared to conventional techniques, and obtains LSP parameters that correspond to quantized LSP parameters for the preceding frame and are to be used in time domain encoding from coefficients equivalent to linear prediction coefficients resulting from frequency domain encoding. When p is an integer equal to or greater
(Continued)

than 1, a linear prediction coefficient sequence which is obtained by linear prediction analysis of audio signals in a predetermined time segment is represented as a[1], a[2], . . . , a[p], and ω[1], ω[2], . . . , ω[p] are a frequency domain parameter sequence derived from the linear prediction coefficient sequence a[1], a[2], . . . , a[p], an LSP linear transformation unit (300) determines the value of each converted frequency domain parameter ~ω[i] (i=1, 2, . . . , p) in a converted frequency domain parameter sequence ~ω[1], ~ω[2], . . . , ~ω[p] using the frequency domain parameter sequence ω[1], ω[2], . . . , ω[p] as input, through linear transformation which is based on the relationship of values between ω[i] and one or more frequency domain parameters adjacent to ω[i].

5 Claims, 23 Drawing Sheets

Related U.S. Application Data continuation of application No. 15/302,094, filed as application No. PCT/JP2015/054135 on Feb. 16, 2015, now Pat. No. 10,332,533.

(51) Int. Cl.

| | |
|---|---|
| ***G10L 25/06*** | (2013.01) |
| ***G10L 19/12*** | (2013.01) |
| ***G10L 25/12*** | (2013.01) |

(56) References Cited

U.S. PATENT DOCUMENTS

| | | | | |
|---|---|---|---|---|
| 5,504,833 | A * | 4/1996 | George | G10L 19/02 704/203 |
| 5,806,024 | A * | 9/1998 | Ozawa | G10L 19/10 704/218 |
| 5,822,732 | A | 10/1998 | Tasaki | |
| 5,864,796 | A * | 1/1999 | Inoue | G10L 19/07 704/219 |
| 5,933,803 | A * | 8/1999 | Ojala | G10L 19/002 704/216 |
| 7,272,556 | B1 * | 9/2007 | Aguilar | G10L 19/093 704/201 |
| 7,330,813 | B2 * | 2/2008 | Saito | G10L 19/26 704/209 |
| 8,239,190 | B2 * | 8/2012 | Kapoor | G10L 21/01 704/200 |
| 8,280,727 | B2 * | 10/2012 | Endo | G10L 21/038 704/201 |
| 8,494,863 | B2 * | 7/2013 | Biswas | G10L 19/008 704/500 |
| 9,047,865 | B2 * | 6/2015 | Aguilar | G10L 19/093 |
| 9,230,554 | B2 * | 1/2016 | Moriya | H03M 5/06 |
| 9,336,790 | B2 * | 5/2016 | Gao | G10L 19/005 |
| 9,524,725 | B2 * | 12/2016 | Moriya | H03M 7/40 |
| 9,697,822 | B1 * | 7/2017 | Naik | G10L 15/063 |
| 9,711,158 | B2 * | 7/2017 | Moriya | G10L 19/0212 |
| 9,916,538 | B2 * | 3/2018 | Zadeh | G06N 7/005 |
| 10,332,533 | B2 * | 6/2019 | Moriya | G10L 19/12 |
| 2004/0042622 | A1 * | 3/2004 | Saito | G10L 19/26 381/74 |
| 2008/0052065 | A1 * | 2/2008 | Kapoor | G10L 19/18 704/221 |
| 2008/0052068 | A1 * | 2/2008 | Aguilar | G10L 19/093 704/230 |
| 2010/0286990 | A1 * | 11/2010 | Biswas | G10L 19/26 704/500 |
| 2010/0318350 | A1 * | 12/2010 | Endo | G10L 21/038 704/209 |
| 2013/0311192 | A1 * | 11/2013 | Moriya | G10L 19/0212 704/500 |
| 2013/0317814 | A1 * | 11/2013 | Moriya | H03M 5/06 704/219 |
| 2014/0156267 | A1 * | 6/2014 | Gao | G10L 19/005 704/207 |
| 2014/0201126 | A1 * | 7/2014 | Zadeh | A61B 5/4803 706/52 |
| 2015/0187366 | A1 * | 7/2015 | Moriya | G10L 19/02 704/206 |
| 2015/0302859 | A1 * | 10/2015 | Aguilar | G10L 19/093 704/211 |
| 2016/0292445 | A1 * | 10/2016 | Lindemann | G06F 16/353 |
| 2016/0361041 | A1 * | 12/2016 | Barsimantov | A61B 8/065 |
| 2017/0154188 | A1 * | 6/2017 | Meier | G06F 21/6209 |
| 2017/0249947 | A1 * | 8/2017 | Moriya | G10L 19/02 |
| 2018/0012137 | A1 * | 1/2018 | Wright | G05B 13/0265 |
| 2018/0165554 | A1 * | 6/2018 | Zhang | G06K 9/6269 |
| 2019/0228309 | A1 * | 7/2019 | Yu | G05B 13/0265 |

FOREIGN PATENT DOCUMENTS

| | | |
|---|---|---|
| JP | 9-230896 A | 9/1997 |
| JP | 2004-86102 A | 3/2004 |

OTHER PUBLICATIONS

Max Neuendorf, et al., "MPEG Unified Speech and Audio Coding—The ISO/MPEG Standard for High-Efficiency Audio Coding of all Content Types," Audio Engineering Society Convention 132, Apr. 26, 2012, (22 pages).

International Search Report dated Apr. 28, 2015 in PCT/JP2015/054135 filed Feb. 16, 2015.

Extended European Search Report dated Aug. 17, 2017 in Patent Application No. 15783646.1.

R. Sugiura, et al. "Direct Linear Conversion of LSP parameters for perceptual control in speech and audio coding," EUSIPCO, XP032681872, 2014, 5 Pages.

"Universal Mobile Telecommunications System (UMTS); LTE; EVS Codec Detailed Algorithmic Description (3GPP TS 26.445 version 12.0.0 Release 12)," ETSI, vol. 3GPP SA 4, No. V12.0.0, XP014235545, 2014, 627 Pages.

Korean Office Action dated Sep. 29, 2017 in Patent Application No. 10-2016-7029133 (w/English translation).

Extended European Search Report dated Dec. 7, 2018 for European Application No. 18200102.4.

Office Action dated Apr. 4, 2019 in Chinese Application No. 201580020682.5 (w/English translation).

Extended Search Report dated Jan. 28, 2020 in European Application No. 19216781.5.

* cited by examiner

DECODING METHOD, APPARATUS AND RECORDING MEDIUM

CROSS-REFERENCE TO RELATED APPLICATIONS

This application is a continuation of and claims the benefit of priority under 35 U.S.C. § 120 from U.S. application Ser. No. 16/398,429 filed Apr. 30, 2019, which is a continuation of U.S. application Ser. No. 15/302,094 filed May 16, 2017 (now U.S. Pat. No. 10,332,533 issued Jun. 25, 2019), the entire contents of which are incorporated herein by reference. U.S. application Ser. No. 15/302,094 is a National Stage of PCT/JP2015/054135 filed Feb. 16, 2015, which claims the benefit of priority under 35 U.S.C. § 119 from Japanese Application No. 2014-089895 filed Apr. 24, 2014.

TECHNICAL FIELD

The present invention relates to encoding techniques, and more particularly to techniques for converting frequency domain parameters equivalent to linear prediction coefficients.

BACKGROUND ART

In encoding of speech or sound signals, schemes that perform encoding using linear prediction coefficients obtained by linear prediction analysis of input sound signals are widely employed.

For instance, according to Non-Patent Literatures 1 and 2, input sound signals in each frame are coded by either a frequency domain encoding method or a time domain encoding method. Whether to use the frequency domain or time domain encoding method is determined in accordance with the characteristics of the input sound signals in each frame.

Both in the time domain and frequency domain encoding methods, linear prediction coefficients obtained by linear prediction analysis of input sound signal are converted to a sequence of LSP parameters, which is then coded to obtained LSP codes, and also a quantized LSP parameter sequence corresponding to the LSP codes is generated. In the time domain encoding method, encoding is carried out by using linear prediction coefficients determined from a quantized LSP parameter sequence for the current frame and a quantized LSP parameter sequence for the preceding frame as the filter coefficients for a synthesis filter serving as a time-domain filter, applying the synthesis filter to a signal generated by synthesis of the waveforms contained in an adaptive codebook and the waveforms contained in a fixed codebook so as to determine a synthesized signal, and determining indices for the respective codebooks such that the distortion between the synthesized signal determined and the input sound signal is minimized.

In the frequency domain encoding method, a quantized LSP parameter sequence is converted to linear prediction coefficients to determine a quantized linear prediction coefficient sequence; the quantized linear prediction coefficient sequence is smoothed to determine a adjusted quantized linear prediction coefficient sequence; a signal from which the effect of the spectral envelope has been removed is determined by normalizing each value in a frequency domain signal series which is determined by converting the input sound signal to the frequency domain using each value in a power spectral envelope series, which is a series in the frequency domain corresponding to the adjusted quantized linear prediction coefficients; and the determined signal is coded by variable length encoding taking into account spectral envelope information.

As described, linear prediction coefficients determined through linear prediction analysis of the input sound signal are employed in common in the frequency domain and time domain encoding methods. Linear prediction coefficients are converted into a sequence of frequency domain parameters equivalent to the linear prediction coefficients, such as LSP (Line Spectrum Pair) parameters or ISP (Immittance Spectrum Pairs) parameters. Then, LSP codes (or ISP codes) generated by encoding the LSP parameter sequence (or ISP parameter sequence) are transmitted to a decoding apparatus. The frequencies from 0 to $\pi$ of LSP parameters used in quantization or interpolation are sometimes specifically referred distinctively as LSP frequencies (LSF) or as ISP frequencies (ISF) in the case of ISP frequencies; however, such frequency parameters are referred to as LSP parameters or ISP parameters in the description of the present application.

Referring to FIGS. 1 and 2, processing performed by a conventional encoding apparatus will be described more specifically.

In the following description, an LSP parameter sequence consisting of p LSP parameters will be represented as $\theta[1], \theta[2], \ldots, \theta[p]$. "p" represents the order of prediction which is an integer equal to or greater than 1. The symbol in brackets ([ ]) represents index. For example, $\theta[i]$ indicates the ith LSP parameter in an LSP parameter sequence $\theta[1], \theta[2], \ldots, \theta[p]$.

A symbol written in the upper right of $\theta$ in brackets indicates frame number. For example, an LSP parameter sequence generated for the sound signals in the fth frame is represented as $\theta^{[f]}[1], \theta^{[f]}[2], \ldots, \theta^{[f]}[p]$. However, since most processing is conducted within a frame in a closed manner, indication of the upper right frame number is omitted for parameters that correspond to the current frame (the fth frame). Omission of a frame number is intended to mean parameters generated for the current frame. That is, $\theta[i]=\theta^{[f]}[i]$ holds.

A symbol written in the upper right without brackets represents exponentiation. That is, $\theta^{k}[i]$ means the kth power of $\theta[i]$.

Although symbols used in the text such as "~", "^", and "¯" should be originally indicated immediately above the following letter, they are indicated immediately before the corresponding letter due to limitations in text denotation. In mathematical expressions, such symbols are indicated at the appropriate position, namely immediately above the corresponding letter.

At step S100, a speech sound digital signal (hereinafter referred to as input sound signal) in the time domain per frame, which defines a predetermined time segment, is input to a conventional encoding apparatus 9. The encoding apparatus 9 performs processing in the processing units described below on the input sound signal on a per-frame basis.

A per-frame input sound signal is input to a linear prediction analysis unit 105, a feature amount extracting unit 120, a frequency domain encoding unit 150, and a time domain encoding unit 170.

At step S105, the linear prediction analysis unit 105 performs linear prediction analysis on the per-frame input sound signal to determine a linear prediction coefficient sequence $a[1], a[2], \ldots, a[p]$, and outputs it. Here, $a[i]$ is a linear prediction coefficient of the ith order. Each coefficient $a[i]$ in the linear prediction coefficient sequence is coefficient a[i] (i=1, 2, . . . , p) that is obtained when input sound signal z is modeled with the linear prediction model represented by Formula (1):

$$A(z) = 1 + \sum_{i=1}^{p} a[i]z^{-i} \tag{1}$$

The linear prediction coefficient sequence a[1], a[2], . . . , a[p] output by the linear prediction analysis unit 105 is input to an LSP generating unit 110.

At step S110, the LSP generating unit 110 determines and outputs a series of LSP parameters, θ[1], θ[2], . . . , θ[p], corresponding to the linear prediction coefficient sequence a[1], a[2], . . . , a[p] output from the linear prediction analysis unit 105. In the following description, the series of LSP parameters, θ[1], θ[2], . . . , θ[p], will be referred to as an LSP parameter sequence. The LSP parameter sequence θ[1], θ[2], . . . , θ[p] is a series of parameters that are defined as the root of the sum polynomial defined by Formula (2) and the difference polynomial defined by Formula (3).

$$F_1(z)=A(z)+z^{-(p+1)}A(z^{-1}) \tag{2}$$

$$F_2(z)=A(z)-z^{-(p+1)}A(z^{-1}) \tag{3}$$

The LSP parameter sequence θ[1], θ[2], . . . , θ[p] is a series in which values are arranged in ascending order. That is, it satisfies $$0<\theta[1]<\theta[2]< \ldots <\theta[p]<\pi.$$

The LSP parameter sequence θ[1], θ[2], . . . , θ[p] output by the LSP generating unit 110 is input to an LSP encoding unit 115.

At step S115, the LSP encoding unit 115 encodes the LSP parameter sequence θ[1], θ[2], . . . , θ[p] output by the LSP generating unit 110, determines LSP code C1 and a quantized LSP parameter series ˆθ[1], ˆθ[2], . . . , ˆθ[p] corresponding to the LSP code C1, and outputs them. In the following description, the quantized LSP parameter series ˆ[1], ˆθ[2], . . . , ˆθ[p] will be referred to as a quantized LSP parameter sequence.

The quantized LSP parameter sequence ˆ[1], ˆθ[2], . . . , ˆθ[p] output by the LSP encoding unit 115 is input to a quantized linear prediction coefficient generating unit 900, a delay input unit 165, and a time domain encoding unit 170. The LSP code C1 output by the LSP encoding unit 115 is input to an output unit 175.

At step S120, the feature amount extracting unit 120 extracts the magnitude of the temporal variation in the input sound signal as the feature amount. When the extracted feature amount is smaller than a predetermined threshold (i.e., when the temporal variation in the input sound signal is small), the feature amount extracting unit 120 implements control so that the quantized linear prediction coefficient generating unit 900 will perform the subsequent processing. At the same time, the feature amount extracting unit 120 inputs information indicating the frequency domain encoding method to the output unit 175 as identification code Cg. Meanwhile, when the extracted feature amount is equal to or greater than the predetermined threshold (i.e., when the temporal variation in the input sound signal is large), the feature amount extracting unit 120 implements control so that the time domain encoding unit 170 will perform the subsequent processing. At the same time, the feature amount extracting unit 120 inputs information indicating the time domain encoding method to the output unit 175 as identification code Cg.

Processes in the quantized linear prediction coefficient generating unit 900, a quantized linear prediction coefficient adjusting unit 905, an approximate smoothed power spectral envelope series calculating unit 910, and the frequency domain encoding unit 150 are executed when the feature amount extracted by the feature amount extracting unit 120 is smaller than the predetermined threshold (i.e., when the temporal variation in the input sound signal is small) (step S121).

At step S900, the quantized linear prediction coefficient generating unit 900 determines a series of linear prediction coefficients, ˆa[1], ˆa[2], . . . , ˆa[p], from the quantized LSP parameter sequence ˆ[1], ˆθ[2], . . . , ˆθ[p] output by the LSP encoding unit 115, and outputs it. In the following description, the linear prediction coefficient series ˆa[1], ˆa[2], . . . , ˆa[p] will be referred to as a quantized linear prediction coefficient sequence.

The quantized linear prediction coefficient sequence ˆa[1], ˆa[2], . . . , ˆa[p] output by the quantized linear prediction coefficient generating unit 900 is input to the quantized linear prediction coefficient adjusting unit 905.

At step S905, the quantized linear prediction coefficient adjusting unit 905 determines and outputs a series ˆa[1]×(γR), ˆa[2]×$(\gamma R)^2$, . . . , ˆa[p]×$(\gamma R)^p$ of value ˆa[i]×$(\gamma R)^i$, which is the product of the ith-order coefficient ˆa[i] (i=1, . . . , p) in the quantized linear prediction coefficient sequence ˆ[1], ˆa[2], . . . , ˆa[p] output by the quantized linear prediction coefficient generating unit 900 and the ith power of adjustment factor γR. Here, the adjustment factor γR is a predetermined positive integer equal to or smaller than 1. In the following description, the series ˆa[1]×(γR), ˆa[2]×$(\gamma R)^2$, . . . , ˆa[p]×$(\gamma R)^p$ will be referred to as a adjusted quantized linear prediction coefficient sequence.

The adjusted quantized linear prediction coefficient sequence ˆa[1]×(γR), ˆa[2]×$(\gamma R)^2$, . . . , ˆa[p]×$(\gamma R)^p$ output by the quantized linear prediction coefficient adjusting unit 905 is input to the approximate smoothed power spectral envelope series calculating unit 910.

At step S910, using each coefficient ˆa[i]×$(\gamma R)^i$ in the adjusted quantized linear prediction coefficient sequence ˆa[1]×(γR), ˆa[2]×$(\gamma R)^2$, . . . , ˆa[p]×$(\gamma R)^p$ output by the quantized linear prediction coefficient adjusting unit 905, the approximate smoothed power spectral envelope series calculating unit 910 generates an approximate smoothed power spectral envelope series ~$W_{\gamma R}$[1], ~$W_{\gamma R}$[2], . . . , ~$W_{\gamma R}$[N] by Formula (4) and outputs it. Here, exp(•) is an exponential function whose base is Napier's constant, j is the imaginary unit, and $\sigma^2$ is prediction residual energy.

$$\tilde{W}_{\gamma R}[n] = \frac{\sigma^2}{2\pi\left|1 + \sum_{i=1}^{p} \hat{a}[i]\cdot(\gamma R)^i \cdot \exp(-ijn)\right|^2} \tag{4}$$

As defined by Formula (4), the approximate smoothed power spectral envelope series ~$W_{\gamma R}$[1], ~$W_{\gamma R}$[2], . . . , ~$W_{\gamma R}$[N] is a frequency-domain series corresponding to the adjusted quantized linear prediction coefficient sequence ˆa[1]×(γR), ˆa[2]×$(\gamma R)^2$, . . . , ˆa[p]×$(\gamma R)^p$.

The approximate smoothed power spectral envelope series ~$W_{\gamma R}$[1], ~$W_{\gamma R}$[2], . . . , ~$W_{\gamma R}$[N] output by the approximate smoothed power spectral envelope series calculating unit 910 is input to the frequency domain encoding unit 150.

In the following, the reason why a series of values defined by Formula (4) is called an approximate smoothed power spectral envelope series will be explained.

With a pth-order autoregressive process which is an all-pole model, input sound signal x[t] at time t is represented by Formula (5) with its own values in the past back to time p, i.e., x[t−1], . . . , x[t−p], a prediction residual e[t], and linear prediction coefficients a[1], a[2], . . . , a[p]. Then, each coefficient W[n] (n=1, . . . , N) in a power spectral envelope series W[1], W[2], . . . , W[N] of the input sound signal is represented by Formula (6):

$$x[t]+a[1]x[t-1]+\ldots+a[p]x[t-p]=e[t] \tag{5}$$

$$W[n]=\frac{\sigma^2}{2\pi}\frac{1}{\left|1+\sum_{i=1}^{p}a[i]\cdot\exp(-jin)\right|^2} \tag{6}$$

Here, a series $W_{\gamma R}[1], W_{\gamma R}[2], \ldots, W_{\gamma R}[N]$ defined by $$W_{\gamma R}[n]=\frac{\sigma^2}{2\pi\left|1+\sum_{i=1}^{p}a[i](\gamma R)^i\cdot\exp(-ijn)\right|^2} \tag{7}$$

sin which a[i] in Formula (6) is replaced with $a[i]\times(\gamma R)^i$ is equivalent to the power spectral envelope series W[1], W[2], . . . , W[N] of the input sound signal defined by Formula (6) but with the waves of the amplitude smoothed. In other words, processing for adjusting a linear prediction coefficient by multiplying linear prediction coefficient a[i] by the ith power of the adjustment factor γR is equivalent to processing that flats the waves of the amplitude of the power spectral envelope in the frequency domain (processing for smoothing the power spectral envelope). Accordingly, the series $W_{\gamma R}[1], W_{\gamma R}[2], \ldots, W_{\gamma R}[N]$ defined by Formula (7) is called a smoothed power spectral envelope series.

The series $\sim W_{\gamma R}[1], \sim W_{\gamma R}[2], \ldots, \sim W_{\gamma R}[N]$ defined by Formula (4) is equivalent to a series of approximations of the individual values in the smoothed power spectral envelope series $W_{\gamma R}[1], W_{\gamma R}[2], \ldots, W_{\gamma R}[N]$ defined by Formula (7). Accordingly, the series $\sim W_{\gamma R}[1], \sim W_{\gamma R}[2], \ldots, \sim W_{\gamma R}[N]$ defined by Formula (4) is called an approximate smoothed power spectral envelope series.

At step S150, the frequency domain encoding unit 150 normalizes each value X[n] (n=1, . . . , N) in a frequency domain signal sequence X[1], X[2], . . . , X[N], generated by converting the input sound signal into the frequency domain, with the square root of each value $\sim W_{\gamma R}[n]$ in the approximate smoothed power spectral envelope series, thereby determining a normalized frequency domain signal sequence $X_N[1], X_N[2], \ldots, X_N[N]$. That is to say, $X_N[n]=X[n]/\mathrm{sqrt}(\sim W_{\gamma R}[n])$ holds. Here, sqrt(y) represents the square root of y. The frequency domain encoding unit 150 then encodes the normalized frequency domain signal sequence $X_N[1], X_N[2], \ldots, X_N[N]$ by variable length encoding to generate frequency domain signal codes.

The frequency domain signal codes output by the frequency domain encoding unit 150 are input to the output unit 175.

The delay input unit 165 and the time domain encoding unit 170 are executed when the feature amount extracted by the feature amount extracting unit 120 is equal to or greater than the predetermined threshold (i.e., when the temporal variation in the input sound signal is large) (step S121).

At step S165, the delay input unit 165 holds the input quantized LSP parameter sequence ^θ[1], ^θ[2], . . . , ^θ[p], and outputs it to the time domain encoding unit 170 with a delay equivalent to the duration of one frame. For example, if the current frame is the fth frame, the quantized LSP parameter sequence for the f−1th frame, $\hat{\theta}^{[f-1]}[1], \hat{\theta}^{[f-1]}[2], \ldots, \hat{}^{[f-1]}[p]$, is output to the time domain encoding unit 170.

At step S170, the time domain encoding unit 170 carries out encoding by determining a synthesized signal by applying the synthesis filter to a signal generated by synthesis of the waveforms contained in the adaptive codebook and the waveforms contained in the fixed codebook, and determining the indices for the respective codebooks so that the distortion between the synthesized signal determined and the input sound signal is minimized. When determining the indices for the codebooks so that the distortion between the synthesized signal and the input sound signal is minimized, the codebook indices are determined so as to minimize the value given by applying an auditory weighting filter to a signal representing the difference of the synthesized signal from the input sound signal. The auditory weighting filter is a filter for determining distortion when selecting the adaptive codebook and/or the fixed codebook.

The filter coefficients of the synthesis filter and the auditory weighting filter are generated by use of the quantized LSP parameter sequence for the fth frame, ^θ[1], ^θ[2], . . . , ^θ[p], and the quantized LSP parameter sequence for the f−1th frame, $\hat{\theta}^{[f-1]}[1], \hat{}^{[f-1]}[2], \ldots, \hat{\theta}^{[f-1]}[p]$.

Specifically, a frame is first divided into two subframes, and the filter coefficients for the synthesis filter and the auditory weighting filter are determined as follows.

In the latter-half subframe, each coefficient ^a[i] in a quantized linear prediction coefficient sequence ^a[1], ^a[2], . . . , ^a[p], which is a coefficient sequence obtained by converting the quantized LSP parameter sequence for the fth frame, ^θ[1], ^θ[2], . . . , ^θ[p], into linear prediction coefficients, is employed for the filter coefficient of the synthesis filter. For the filter coefficients of the auditory weighting filter, a series of values, $$\hat{a}[1]\times(\gamma R),\ \hat{a}[2]\times(\gamma R)^2,\ \ldots,\ \hat{a}[p]\times(\gamma R)^p,$$

is employed which is determined by multiplying each coefficient ^a[i] in the quantized linear prediction coefficient sequence ^a[1], ^a[2], . . . , ^a[p] by the ith power of adjustment factor γR.

In the first-half subframe, each coefficient ~a[i] in an interpolated quantized linear prediction coefficient sequence ~a[1], ~a[2], . . . , ~a[p], which is a coefficient sequence obtained by converting an interpolated quantized LSP parameter sequence ~θ[1], ~θ[2], . . . , ~θ[p] into linear prediction coefficients, is employed for the filter coefficient of the synthesis filter. The interpolated quantized LSP parameter sequence ~θ[1], ~θ[2], . . . , ~θ[p] is a series of intermediate values between each value ^θ[i] in the quantized LSP parameter sequence for the fth frame, ^θ[1], ^θ[2], . . . , ^θ[p], and each value $\hat{\theta}^{[f-1]}[i]$ in the quantized LSP parameter sequence for the f−1th frame, $\hat{\theta}^{[f-1]}[1], \hat{\theta}^{[f-1]}[2], \ldots, \hat{\theta}^{[f-1]}[p]$, namely a series of values obtained by interpolating between the values ^θ[i] and $\hat{\theta}^{[f-1]}[i]$. For the filter coefficients of the auditory weighting filter, a series of values, $$\sim a[1]\times(\gamma R),\ \sim a[2]\times(\gamma R)^2,\ \ldots,\ \sim a[p]\times(\gamma R)^p,$$

is employed which is determined by multiplying each coefficient ~a[i] in the interpolated quantized linear prediction coefficient sequence ~a[1], ~a[2], . . . , ~a[p] by the ith power of the adjustment factor γR.

This has the effect of smoothing the transition between a decoded sound signal and the decoded sound signal for the preceding frame generated in the decoding apparatus. Note that the adjustment factor γ used in the time domain encoding unit 170 is the same as the adjustment factor γ used in the approximate smoothed power spectral envelope series calculating unit 910.

At step S175, the encoding apparatus 9 transmits, by way of the output unit 175, the LSP code C1 output by the LSP encoding unit 115, the identification code Cg output by the feature amount extracting unit 120, and either the frequency domain signal codes output by the frequency domain encoding unit 150 or the time domain signal codes output by the time domain encoding unit 170, to the decoding apparatus.

PRIOR ART LITERATURE

Non-Patent Literature

Non-patent Literature 1: 3rd Generation Partnership Project (3GPP), "Extended Adaptive Multi-Rate-Wideband (AMR-WB+) codec; Transcoding functions", Technical Specification (TS) 26.290, Version 10.0.0, 2011-03.

Non-patent Literature 2: M. Neuendorf, et al., "MPEG Unified Speech and Audio Coding-The ISO/MPEG Standard for High-Efficiency Audio Coding of All Content Types", Audio Engineering Society Convention 132, 2012.

SUMMARY OF THE INVENTION

Problems to be Solved by the Invention

The adjustment factor γR serves to achieve encoding with small distortion that takes the sense of hearing into account to an increased degree by flattening the waves of the amplitude of a power spectral envelope more for a higher frequency when eliminating the influence of the power spectral envelope from the input sound signal.

In order for the frequency domain encoding unit to achieve encoding with small distortion taking into account the sense of hearing, it is necessary for the approximate smoothed power spectral envelope series $\sim W_{\gamma R}[1]$, $\sim W_{\gamma R}[2], \ldots, \sim W_{\gamma R}[N]$ to approximate the smoothed power spectral envelope $W_{\gamma R}[1], W_{\gamma R}[2], \ldots, W_{\gamma R}[N]$ with high accuracy. Stated differently, assuming that $$a_{\gamma R}[i]=a[i]\times(\gamma R)^i (i=1, \ldots, p),$$

it is desirable that the adjusted quantized linear prediction coefficient sequence $\hat{a}[1]\times(\gamma R), \hat{a}[2]\times(\gamma R)^2, \ldots, \hat{a}[p]\times(\gamma R)^p$ is a series that approximates the adjusted linear prediction coefficient sequence $a_{\gamma R}[1], a_{\gamma R}[2], \ldots, a_{\gamma R}[p]$ with high accuracy.

However, the LSP encoding unit of a conventional encoding apparatus performs encoding processing so that the distortion between the quantized LSP parameter sequence $\hat{\theta}[1], \hat{\theta}[2], \ldots, \hat{\theta}[p]$ and the LSP parameter sequence $\theta[1], \theta[2], \ldots, \theta[p]$ is minimized. This means determining the quantized LSP parameter sequence $\hat{\theta}[1], \hat{\theta}[2], \ldots, \hat{\theta}[p]$ so that a power spectral envelope that does not take the sense of hearing into account (i.e., that has not been smoothed with adjustment factor γR) is approximated with high accuracy. Consequently, the distortion between the adjusted quantized linear prediction coefficient sequence $\hat{a}[1]\times(\gamma R), \hat{a}[2]\times(\gamma R)^2, \ldots, \hat{a}[p]\times(\gamma R)^p$ generated from the quantized LSP parameter sequence $\hat{\theta}[1], \hat{\theta}[2], \ldots, \hat{\theta}[p]$ and the adjusted linear prediction coefficient sequence $a_{\gamma R}[1], a_{\gamma R}[2], \ldots, a_{\gamma R}[p]$ is not minimized, leading to large encoding distortion in the frequency domain encoding unit.

An object of the present invention is to provide encoding techniques that selectively use frequency domain encoding and time domain encoding in accordance with the characteristics of the input sound signal and that are capable of reducing the encoding distortion in frequency domain encoding compared to conventional techniques, and also generating LSP parameters that correspond to quantized LSP parameters for the preceding frame and are to be used in time domain encoding, from linear prediction coefficients resulting from frequency domain encoding or coefficients equivalent to linear prediction coefficients, typified by LSP parameters. Another object of the present invention is to generate coefficients equivalent to linear prediction coefficients having varying degrees of smoothing effect from coefficients equivalent to linear prediction coefficients used, for example, in the above-described encoding technique.

Means to Solve the Problems

In order to attain the objects, a frequency domain parameter sequence generating method according to a first aspect of the invention, implemented by a frequency domain parameter sequence generating apparatus having processing circuitry.

The frequency domain parameter sequence generating method, includes, where p is an integer equal to or greater than 1, a linear prediction coefficient sequence which is obtained by linear prediction analysis of audio signals in a predetermined time segment as a[1], a[2], . . . , a[p], and ω[1], ω[2], . . . , ω[p] are a frequency domain parameter sequence derived from the linear prediction coefficient sequence a[1], a[2], . . . , a[p], determining, by the processing circuitry, a converted frequency domain parameter sequence ~ω[1], ~ω[2], . . . , ~ω[p] using the frequency domain parameter sequence ω[1], ω[2], . . . , ω[p] as input in a parameter sequence conversion step. The processing circuitry determines a value of each converted frequency domain parameter ~ω[i] (i=1, 2, . . . , p) in the converted frequency domain parameter sequence ~ω[1], ~ω[2], . . . , ~ω[p] through linear transformation which is based on a relationship of values between ω[i] and one or more frequency domain parameters adjacent to ω[i].

A frequency domain parameter sequence generating method according to a second aspect of the invention, implemented by a frequency domain parameter sequence generating apparatus having processing circuitry.

The frequency domain parameter sequence generating method includes, where p is an integer equal to or greater than 1, and a linear prediction coefficient sequence obtained by linear prediction analysis of audio signals in a predetermined time segment as a[1], a[2], . . . , a[p]; ω[1], ω[2], . . . , ω[p] is one of an LSP parameter sequence derived from the linear prediction coefficient sequence a[1], a[2], . . . , a[p], an LSF parameter sequence derived from the linear prediction coefficient sequence a[1], a[2], . . . , a[p], and a frequency domain parameter sequence which is derived from the linear prediction coefficient sequence a[1], a[2], . . . , a[p] and in which all of ω[1], ω[2], . . . , ω[p] are present from 0 to π and, when all of linear prediction coefficients contained in the linear prediction coefficient sequence are 0, ω[1], ω[2], . . . , ω[p] are present from 0 to π at equal intervals; and each γ1 and γ2 is a adjustment factor which is a positive constant equal to or smaller than 1, and K is a predetermined p×p band matrix in which diagonal elements and elements that neighbor the diagonal elements in row direction have non-zero values, generating, by the processing circuitry, a converted frequency domain parameter sequence ~ω[1], ~ω[2], . . . , ω[p] defined by a following formula $$\begin{pmatrix} \tilde{\omega}[1] \\ \tilde{\omega}[2] \\ \vdots \\ \tilde{\omega}[p] \end{pmatrix} = K \begin{pmatrix} \omega[1] - \frac{\pi}{p+1} \\ \omega[2] - \frac{2\pi}{p+1} \\ \vdots \\ \omega[p] - \frac{p\pi}{p+1} \end{pmatrix} (\gamma 2 - \gamma 1) + \begin{pmatrix} \omega[1] \\ \omega[2] \\ \vdots \\ \omega[p] \end{pmatrix}.$$

A frequency domain parameter sequence generating method according to a third aspect of the invention, implemented by a frequency domain parameter sequence generating apparatus having processing circuitry.

The frequency domain parameter sequence generating method, includes, where p is an integer equal to or greater than 1, a linear prediction coefficient sequence which is obtained by linear prediction analysis of audio signals in a predetermined time segment as a[1], a[2], . . . , a[p], is one of an ISP parameter sequence derived from the linear prediction coefficient sequence a[1], a[2], . . . , a[p], and an ISF parameter sequence derived from the linear prediction coefficient sequence a[1], a[2], . . . , a[p]; and each γ1 and γ2 is a adjustment factor which is a positive constant equal to or smaller than 1, and K is a predetermined p−1×p−1 band matrix in which diagonal elements and elements that neighbor the diagonal elements in row direction have non-zero values, generating, by the processing circuitry, a converted frequency domain parameter sequence ~ω[1], ~ω[2], . . . , ~ω[p−1] defined by a following formula $$\begin{pmatrix} \tilde{\omega}[1] \\ \tilde{\omega}[2] \\ \vdots \\ \tilde{\omega}[p-1] \end{pmatrix} = K \begin{pmatrix} \omega[1] - \frac{\pi}{p} \\ \omega[2] - \frac{2\pi}{p} \\ \vdots \\ \omega[p-1] - \frac{(p-1)\pi}{p} \end{pmatrix} (\gamma 2 - \gamma 1) + \begin{pmatrix} \omega[1] \\ \omega[2] \\ \vdots \\ \omega[p-1] \end{pmatrix}.$$

A decoding method according to a fourth aspect of the invention, implemented by a decoding apparatus having processing circuitry.

The decoding method, includes: decoding, by the processing circuitry, input adjusted LSP codes to obtain a decoded adjusted LSP parameter sequence $\hat{\theta}_\gamma[1]$, $\hat{\theta}_\gamma[2]$, . . . , $\hat{\theta}_\gamma[p]$; with the frequency domain parameter sequence ω[1], ω[2], . . . , ω[p] being the decoded adjusted LSP parameter sequence $\hat{\theta}_\gamma[1]$, $\hat{\theta}_\gamma[2]$, . . . , $\hat{\theta}_\gamma[p]$, executing, by the processing circuitry, the parameter sequence conversion step of the frequency domain parameter sequence generating method described in the first aspect to thereby generate the converted frequency domain parameter sequence ~ω[1], ~ω[2], . . . , ~ω[p] as a decoded approximate LSP parameter sequence $\hat{\theta}_{app}[1]$, $\hat{\theta}_{app}[2]$, . . . , $\hat{\theta}_{app}[p]$; calculating, by the processing circuitry, a decoded smoothed power spectral envelope series $\hat{W}_\gamma[1]$, $\hat{W}_\gamma[2]$, . . . , $\hat{W}_\gamma[N]$ based on the decoded adjusted LSP parameter sequence $\hat{\theta}_\gamma[1]$, $\hat{\theta}_\gamma[2]$, . . . , $\hat{\theta}_\gamma[p]$; generating, by the processing circuitry, decoded sound signals using the frequency domain signal sequence resulting from decoding of input frequency domain signal codes and the decoded smoothed power spectral envelope series $\hat{W}_\gamma[1]$, $\hat{W}_\gamma[2]$, . . . , $\hat{W}_\gamma[N]$; generating, by the processing circuitry, decoded sound signals using the frequency domain signal sequence resulting from decoding of the input frequency domain signal codes and the decoded smoothed power spectral envelope series $\hat{W}_\gamma[1]$, $\hat{W}_\gamma[2]$, . . . , $\hat{W}_\gamma[N]$; decoding, by the processing circuitry, input LSP codes to obtain a decoded LSP parameter sequence $\hat{\theta}[1]$, $\hat{\theta}[2]$, . . . , $\hat{\theta}[p]$; and decoding, by the processing circuitry, input time domain signal codes, and generating decoded sound signals by synthesizing the time domain signal codes using either the decoded LSP parameter sequence for the preceding time segment or the decoded approximate LSP parameter sequence for the preceding time segment, and the decoded LSP parameter sequence for the predetermined time segment.

Effects of the Invention

According to the encoding techniques of the present invention, it is possible to reduce the encoding distortion in frequency domain encoding compared to conventional techniques, and also obtain LSP parameters that correspond to quantized LSP parameters for the preceding frame and are to be used in time domain encoding from linear prediction coefficients resulting from frequency domain encoding or coefficients equivalent to linear prediction coefficients, typified by LSP parameters. It is also possible to generate coefficients equivalent to linear prediction coefficients having varying degrees of smoothing effect from coefficients equivalent to linear prediction coefficients used in, for example, the above-described encoding technique.

DETAILED DESCRIPTION OF THE EMBODIMENTS

Figure 1:
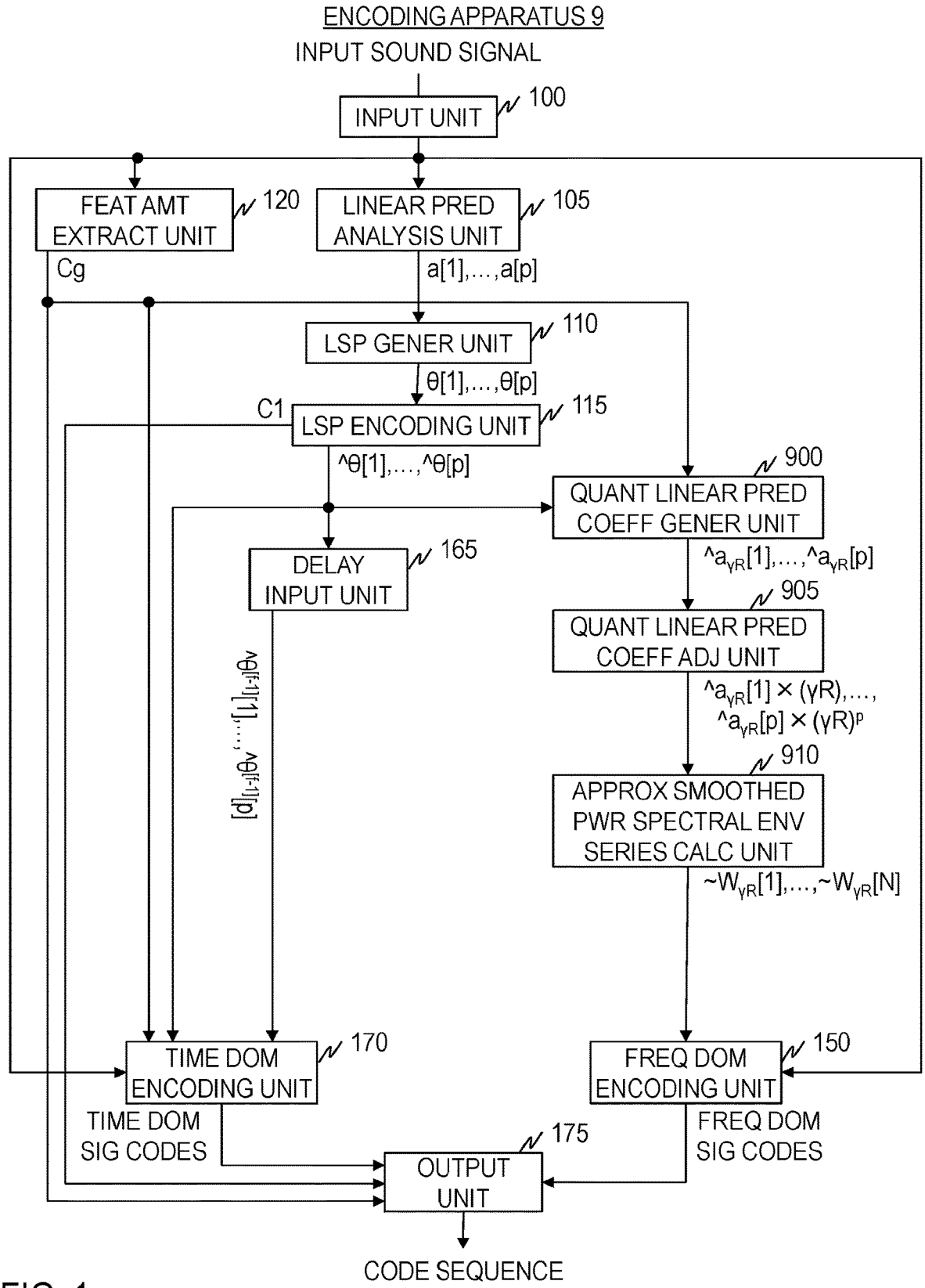
FIG. 1 is a diagram illustrating the functional configuration of a conventional encoding apparatus.
Figure 2:
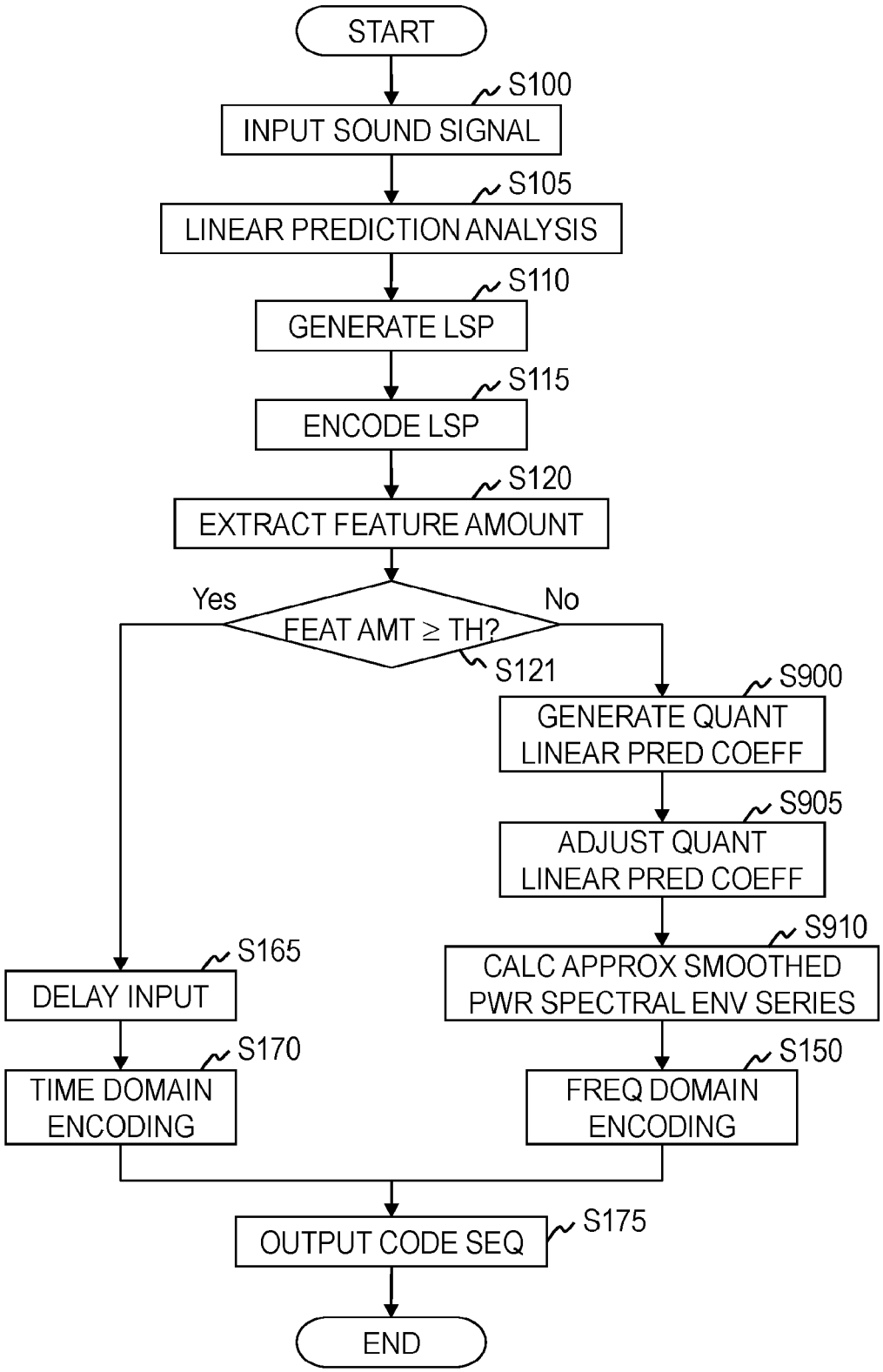
FIG. 2 is a diagram illustrating the process flow of a conventional encoding method.

Embodiments of the present invention will be described below. In the drawings used in the description below, components having the same function or steps that perform the same processing are denoted with the same reference characters and repeated descriptions are omitted.

First Embodiment

A encoding apparatus according to a first embodiment obtains, in a frame for which time domain encoding is performed, LSP codes by encoding LSP parameters that have been converted from linear prediction coefficients. In a frame for which frequency domain encoding is performed, the encoding apparatus obtains adjusted LSP codes by encoding adjusted LSP parameters that have been converted from adjusted linear prediction coefficients. When time domain encoding is to be performed in a frame following a frame for which frequency domain encoding was performed, linear prediction coefficients generated by inverse adjustment of linear prediction coefficients that correspond to LSP parameters corresponding to adjusted LSP codes are converted to LSPs, which are then used as LSP parameters in the time domain encoding for the following frame.

A decoding apparatus according to the first embodiment obtains, in a frame for which time domain decoding is performed, linear prediction coefficients that have been converted from LSP parameters resulting from decoding of LSP codes and uses them for time domain decoding. In a frame for which frequency domain decoding is performed, the decoding apparatus uses adjusted LSP parameters generated by decoding adjusted LSP codes for the frequency domain decoding. When time domain decoding is to be performed in a frame following a frame for which frequency domain decoding was performed, linear prediction coefficients generated by inverse adjustment of linear prediction coefficients that correspond to LSP parameters corresponding to the adjusted LSP codes are converted to LSPs, which are then used as LSP parameters in the time domain decoding for the following frame.

Figure 3:
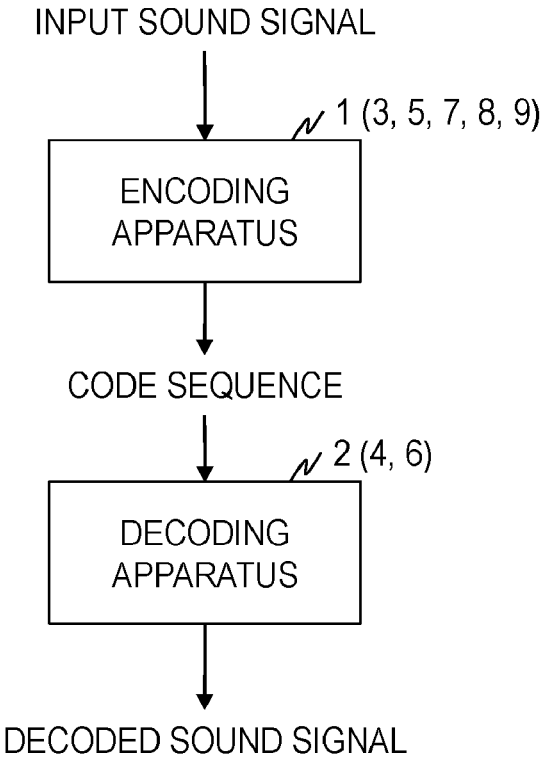
FIG. 3 is a diagram illustrating the relation between a encoding apparatus and a decoding apparatus.

In the encoding and decoding apparatuses according the first embodiment, as illustrated in FIG. 3, input sound signals input to a encoding apparatus 1 are coded into a code sequence, which is then sent from the encoding apparatus 1 to the decoding apparatus 2, in which the code sequence is decoded into decoded sound signals and output.

<Encoding Apparatus>

Figure 4:
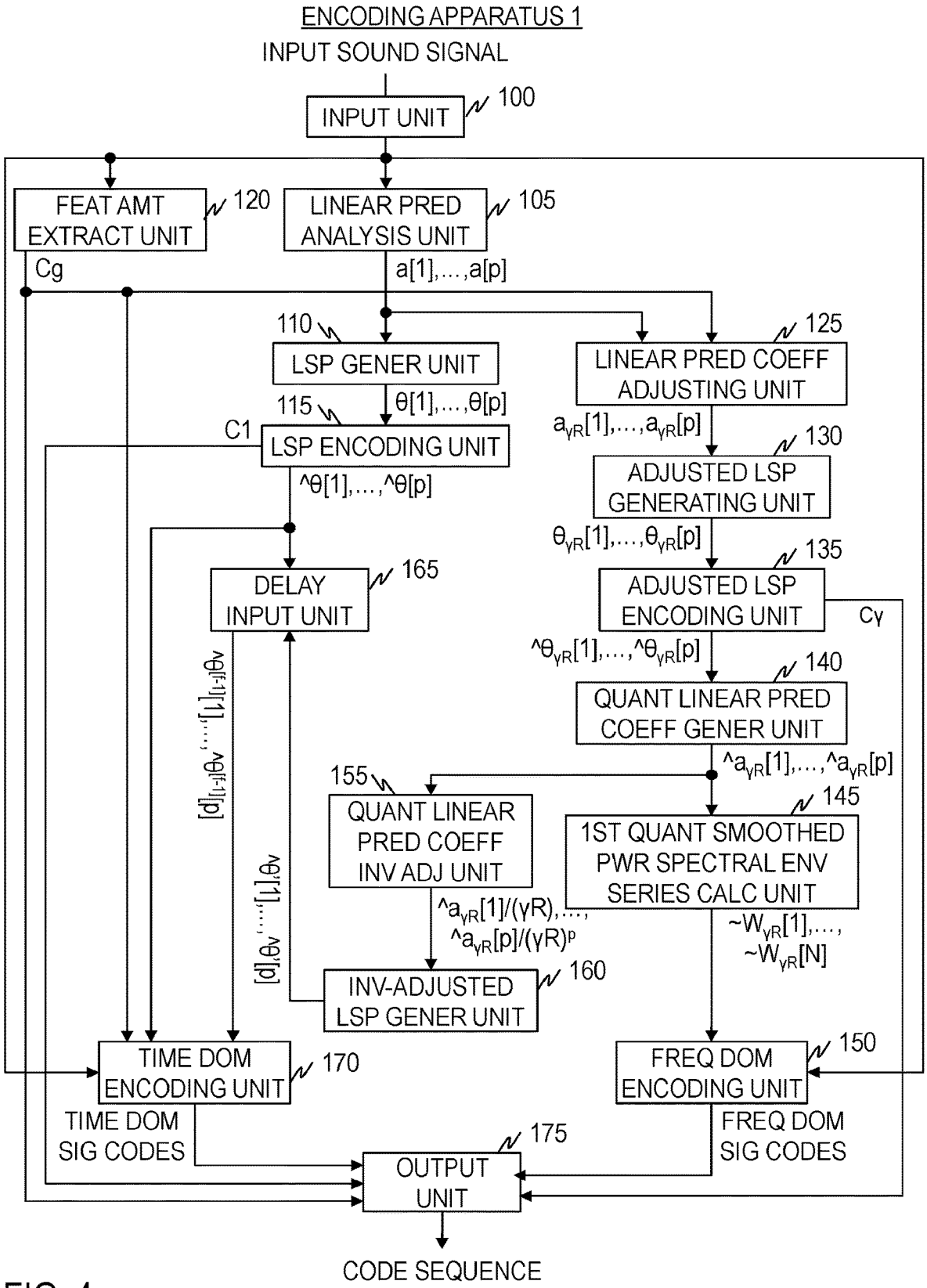
FIG. 4 is a diagram illustrating the functional configuration of a encoding apparatus in a first embodiment.

As shown in FIG. 4, the encoding apparatus 1 includes, as with the conventional encoding apparatus 9, an input unit 100, a linear prediction analysis unit 105, an LSP generating unit 110, an LSP encoding unit 115, a feature amount extracting unit 120, a frequency domain encoding unit 150, a delay input unit 165, a time domain encoding unit 170, and an output unit 175, for example. The encoding apparatus 1 further includes a linear prediction coefficient adjusting unit 125, a adjusted LSP generating unit 130, a adjusted LSP encoding unit 135, a quantized linear prediction coefficient generating unit 140, a first quantized smoothed power spectral envelope series calculating unit 145, a quantized linear prediction coefficient inverse adjustment unit 155, and an inverse-adjusted LSP generating unit 160, for example.

The encoding apparatus 1 is a specialized device build by incorporating special programs into a known or dedicated computer having a central processing unit (CPU), main memory (random access memory or RAM), and the like, for example. The encoding apparatus 1 performs various kinds of processing under the control of the central processing unit, for example. Data input to the encoding apparatus 1 or data resulting from various kinds of processing are stored in the main memory, for example, and data stored in the main memory are retrieved for use in other processing as necessary. At least some of the processing components of the encoding apparatus 1 may be implemented by hardware such as an integrated circuit.

As shown in FIG. 4, the encoding apparatus 1 in the first embodiment differs from the conventional encoding apparatus 9 in that, when the feature amount extracted by the feature amount extracting unit 120 is smaller than a predetermined threshold (i.e., when the temporal variation in the input sound signal is small), the encoding apparatus 1 encodes a adjusted LSP parameter sequence $\theta_{\gamma R}[1]$, $\theta_{\gamma R}[2], \ldots, \theta_{\gamma R}[p]$, which is a series generated by converting a adjusted linear prediction coefficient sequence $a_{\gamma R}[1]$, $a_{\gamma R}[2], \ldots, a_{\gamma R}[p]$ into LSP parameters, and outputs adjusted LSP code $C\gamma$, instead of encoding an LSP parameter sequence $\theta[1], \theta[2], \ldots, \theta[p]$ which is a series generated by converting linear prediction coefficient sequence $a[1]$, $a[2], \ldots, a[p]$ into LSP parameters and outputting LSP code C1.

With the configuration of the first embodiment, when the feature amount extracted by the feature amount extracting unit 120 in the preceding frame was smaller than the predetermined threshold (i.e., when temporal variation in the input sound signal was small), the quantized LSP parameter sequence $\hat{\theta}[1], \hat{\theta}[2], \ldots, \hat{\theta}[p]$ is not generated and thus cannot be input to the delay input unit 165. The quantized linear prediction coefficient inverse adjustment unit 155 and the inverse-adjusted LSP generating unit 160 are processing components added for addressing this: when the feature amount extracted by the feature amount extracting unit 120 in the preceding frame was smaller than the predetermined threshold (i.e., when temporal variation in the input sound signal was small), they generate a series of approximations of the quantized LSP parameter sequence $\hat{\theta}[1], \hat{\theta}[2], \ldots, \hat{\theta}[p]$ for the preceding frame to be used in the time domain encoding unit 170, from the adjusted quantized linear prediction coefficient sequence $\hat{a}_{\gamma R}[1], \hat{a}_{\gamma R}[2], \ldots, \hat{a}_{\gamma R}[p]$. In this case, an inverse-adjusted LSP parameter sequence $\hat{\theta}'[1], \hat{\theta}'[2], \ldots, \hat{\theta}'[p]$ is the series of approximations of the quantized LSP parameter sequence $\hat{\theta}[1], \hat{\theta}[2], \ldots, \hat{\theta}[p]$.

<Encoding Method>

Figure 5:
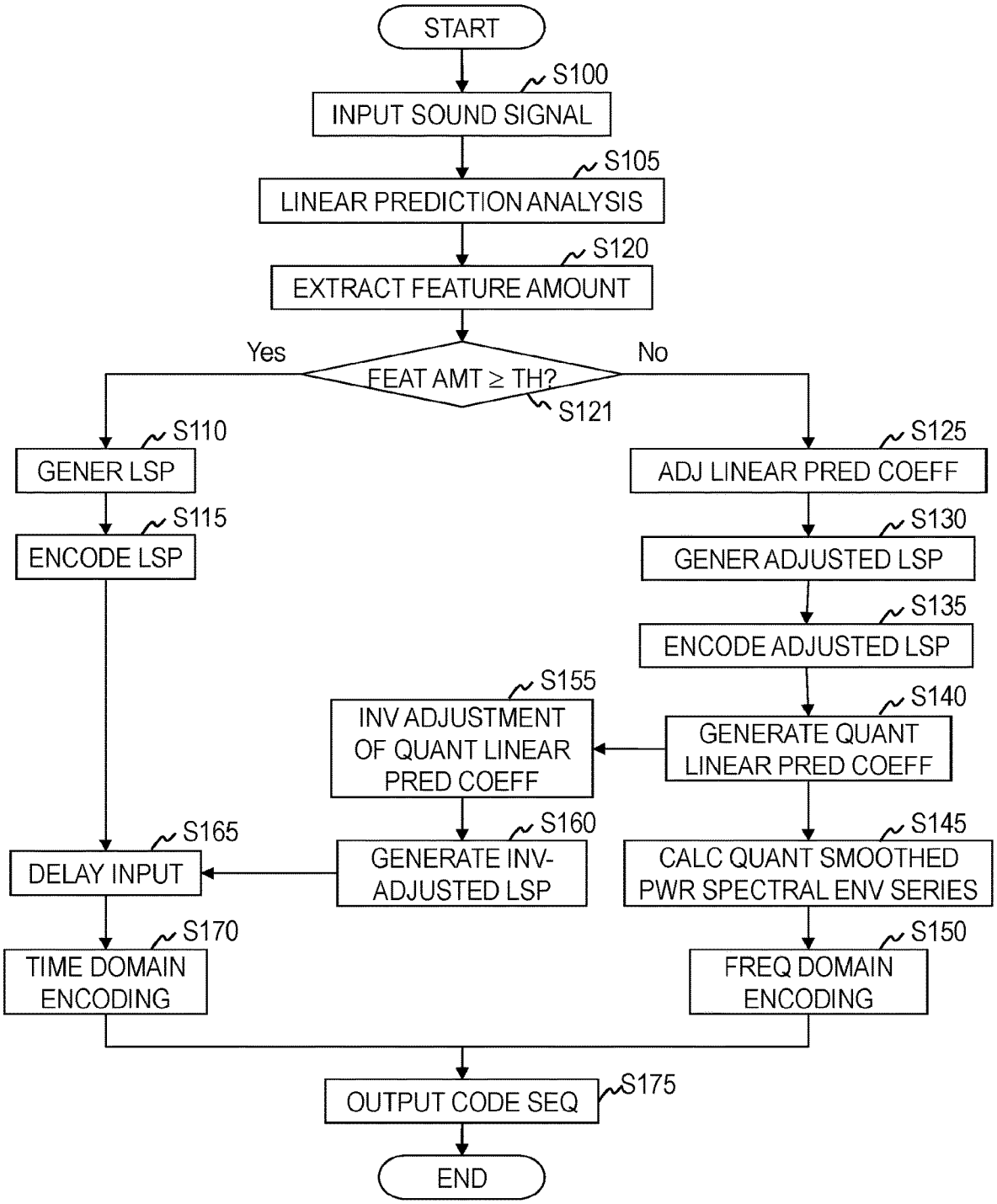
FIG. 5 is a diagram illustrating the process flow of the encoding method in the first embodiment.

Referring to FIG. 5, the encoding method according to the first embodiment will be described. The following description mainly focuses on differences from the conventional technique described above.

At step S125, the linear prediction coefficient adjusting unit 125 determines a series of coefficient, $a_{\gamma R}[i]=a[i]\times\gamma R^i$, which is the product of each coefficient a[i] (i=1, . . . , p) in the linear prediction coefficient sequence a[1], a[2], . . . , a[p] output by the linear prediction analysis unit 105 and the ith power of adjustment factor γR, and outputs it. In the following description, the series $a_{\gamma R}[1]$, $a_{\gamma R}[2]$, . . . , $a_{\gamma R}[p]$ determined will be called a adjusted linear prediction coefficient sequence.

The adjusted linear prediction coefficient sequence $a_{\gamma R}[1]$, $a_{\gamma R}[2]$, . . . , $a_{\gamma R}[p]$ output by the linear prediction coefficient adjusting unit 125 is input to the adjusted LSP generating unit 130.

At step S130, the adjusted LSP generating unit 130 determines and outputs a adjusted LSP parameter sequence $\theta_{\gamma R}[1]$, $\theta_{\gamma R}[2]$, . . . , $\theta_{\gamma R}[p]$, which is a series of LSP parameters corresponding to the adjusted linear prediction coefficient sequence $a_{\gamma R}[1]$, $a_{\gamma R}[2]$, . . . , $a_{\gamma R}[p]$ output by the linear prediction coefficient adjusting unit 125. The adjusted LSP parameter sequence $\theta_{\gamma R}[1]$, $\theta_{\gamma R}[2]$, . . . , $\theta_{\gamma R}[p]$ is a series in which values are arranged in ascending order. That is, it satisfies $$0<\theta_{\gamma R}[1]<\theta_{\gamma R}[2]< \ldots <\theta_{\gamma R}[p]<\pi.$$

The adjusted LSP parameter sequence $\theta_{\gamma R}[1]$, $\theta_{\gamma R}[2]$, . . . , $\theta_{\gamma R}[p]$ output by the adjusted LSP generating unit 130 is input to the adjusted LSP encoding unit 135.

At step S135, the adjusted LSP encoding unit 135 encodes the adjusted LSP parameter sequence $\theta_{\gamma R}[1]$, $\theta_{\gamma R}[2]$, . . . , $\theta_{\gamma R}[p]$ output by the adjusted LSP generating unit 130, and generates adjusted LSP code Cγ and a series of quantized adjusted LSP parameters, $\hat{\theta}_{\gamma R}[1]$, $\hat{\theta}_{\gamma R}[2]$, . . . , $\hat{\theta}_{\gamma R}[p]$, corresponding to the adjusted LSP code Cγ, and outputs them. In the following description, the series $\hat{\theta}_{\gamma R}[1]$, $\hat{\theta}_{\gamma R}[2]$, . . . , $\hat{\theta}_{\gamma R}[p]$ will be called a adjusted quantized LSP parameter sequence.

The adjusted quantized LSP parameter sequence $\hat{\theta}_{\gamma R}[1]$, $\hat{\theta}_{\gamma R}[2]$, . . . , $\hat{\theta}_{\gamma R}[p]$ output by the adjusted LSP encoding unit 135 is input to the quantized linear prediction coefficient generating unit 140. The adjusted LSP code Cγ output by the adjusted LSP encoding unit 135 is input to the output unit 175.

At step S140, the quantized linear prediction coefficient generating unit 140 generates and outputs a series of linear prediction coefficients, $\hat{a}_{\gamma R}[1]$, $\hat{a}_{\gamma R}[2]$, . . . , $\hat{a}_{\gamma R}[p]$, from the adjusted quantized LSP parameter sequence $\hat{\theta}_{\gamma R}[1]$, $\hat{\theta}_{\gamma R}[2]$, . . . , $\hat{\theta}_{\gamma R}[p]$ output by the adjusted LSP encoding unit 135. In the following description, the series $\hat{a}_{\gamma R}[1]$, $\hat{a}_{\gamma R}[2]$, . . . , $\hat{}_{\gamma R}[p]$ will be called a adjusted quantized linear prediction coefficient sequence.

The adjusted quantized linear prediction coefficient sequence $\hat{a}_{\gamma}[1]$, $\hat{a}_{\gamma}[2]$, . . . , $\hat{a}_{\gamma}[p]$ output by the quantized linear prediction coefficient generating unit 140 is input to the first quantized smoothed power spectral envelope series calculating unit 145 and the quantized linear prediction coefficient inverse adjustment unit 155.

At step S145, the first quantized smoothed power spectral envelope series calculating unit 145 generates and outputs a quantized smoothed power spectral envelope series $\hat{W}_{\gamma R}[1]$, $\hat{W}_{\gamma R}[2]$, . . . , $\hat{W}_{\gamma R}[N]$ according to Formula (8) using each coefficient $\hat{a}_{\gamma R}[i]$ in the adjusted quantized linear prediction coefficient sequence $\hat{a}_{\gamma R}[1]$, $\hat{a}_{\gamma R}[2]$, . . . , $\hat{a}_{\gamma R}[p]$ output by the quantized linear prediction coefficient generating unit 140.

$$\hat{W}_{\gamma R}[n] = \frac{\sigma^2}{2\pi\left|1 + \sum_{i=1}^{p} \hat{a}_{\gamma R}[i] \cdot \exp(-ijn)\right|^2} \tag{8}$$

The quantized smoothed power spectral envelope series $\hat{W}_{\gamma R}[1]$, $\hat{W}_{\gamma R}[2]$, . . . , $\hat{W}_{\gamma R}[N]$ output by the first quantized smoothed power spectral envelope series calculating unit 145 is input to the frequency domain encoding unit 150.

Processing in the frequency domain encoding unit 150 is the same as that performed by the frequency domain encoding unit 150 of the conventional encoding apparatus 9 except that it uses the quantized smoothed power spectral envelope series $\hat{W}_{\gamma R}[1]$, $\hat{W}_{\gamma R}[2]$, . . . , $\hat{W}_{\gamma R}[N]$ in place of the approximate smoothed power spectral envelope series $\sim W_{\gamma R}[1]$, $\sim W_{\gamma R}[2]$, . . . , $\sim W_{\gamma R}[N]$.

At step S155, the quantized linear prediction coefficient inverse adjustment unit 155 determines a series $\hat{a}_{\gamma}[1]/(\gamma R)$, $\hat{a}_{\gamma}[2]/(\gamma R)^2$, . . . , $\hat{a}_{\gamma}[p]/(\gamma R)^p$ of value $a_{\gamma}[i]/(\gamma R)^i$ determined by dividing each value $\hat{a}_{\gamma R}[i]$ in the adjusted quantized linear prediction coefficient sequence $\hat{a}_{\gamma R}[1]$, $\hat{a}_{\gamma R}[2]$, . . . , $\hat{a}_{\gamma R}[p]$ output by the quantized linear prediction coefficient generating unit 140 by the ith power of the adjustment factor γR, and outputs it. In the following description, the series $\hat{a}_{\gamma}[1]/(\gamma R)$, $\hat{a}_{\gamma}[2]/(\gamma R)^2$, . . . , $\hat{a}_{\gamma}[p]/(\gamma R)^p$ will be called an inverse-adjusted linear prediction coefficient sequence. The adjustment factor γR is set to the same value as the adjustment factor γR used in the linear prediction coefficient adjusting unit 125.

The inverse-adjusted linear prediction coefficient sequence $\hat{a}_{\gamma}[1]/(\gamma R)$, $\hat{a}_{\gamma}[2]/(\gamma R)^2$, . . . , $\hat{a}_{\gamma}[p]/(\gamma R)^p$ output by the quantized linear prediction coefficient inverse adjustment unit 155 is input to the inverse-adjusted LSP generating unit 160.

At step S160, the inverse-adjusted LSP generating unit 160 determines and outputs a series of LSP parameters, $\hat{\theta}'[1]$, $\hat{\theta}'[2]$, . . . , $\hat{\theta}'[p]$, from the inverse-adjusted linear prediction coefficient sequence $\hat{a}_{\gamma}[1]/(\gamma R)$, $\hat{a}_{\gamma}[2]/(\gamma R)^2$, . . . , $\hat{a}_{\gamma}[p]/(\gamma R)^p$ output by the quantized linear prediction coefficient inverse adjustment unit 155. In the following description, the LSP parameter series $\hat{\theta}'[1]$, $\hat{\theta}'[2]$, . . . , $\hat{\theta}[p]$ will be called an inverse-adjusted LSP parameter sequence. The inverse-adjusted LSP parameter sequence $\hat{\theta}'[1]$, $\hat{\theta}'[2]$, . . . , $\hat{\theta}'[p]$ is a series in which values are arranged in ascending order. That is, it is a series that satisfies $$0<\hat{\theta}'[1]<\hat{\theta}'[2]< \ldots <\hat{\theta}'[p]<\pi.$$

The inverse-adjusted LSP parameters $\hat{\theta}'[1]$, $\hat{\theta}'[2]$, . . . , $\hat{\theta}'[p]$ output by the inverse-adjusted LSP generating unit 160 are input to the delay input unit 165 as a quantized LSP parameter sequence $\hat{\theta}[1]$, $\hat{\theta}[2]$, . . . , $\hat{\theta}[p]$. That is, the inverse-adjusted LSP parameters $\hat{\theta}'[1]$, $\hat{\theta}'[2]$, . . . , $\hat{\theta}'[p]$ are used in place of the quantized LSP parameter sequence $\hat{\theta}[1]$, $\hat{\theta}[2]$, . . . , $\hat{\theta}[p]$.

At step S175, the encoding apparatus 1 sends, by way of the output unit 175, the LSP code C1 output by the LSP encoding unit 115, the identification code Cg output by the feature amount extracting unit 120, the adjusted LSP code Cγ output by the adjusted LSP encoding unit 135, and either the frequency domain signal codes output by the frequency domain encoding unit 150 or the time domain signal codes output by the time domain encoding unit 170, to the decoding apparatus 2.

<Decoding Apparatus>

Figure 6:
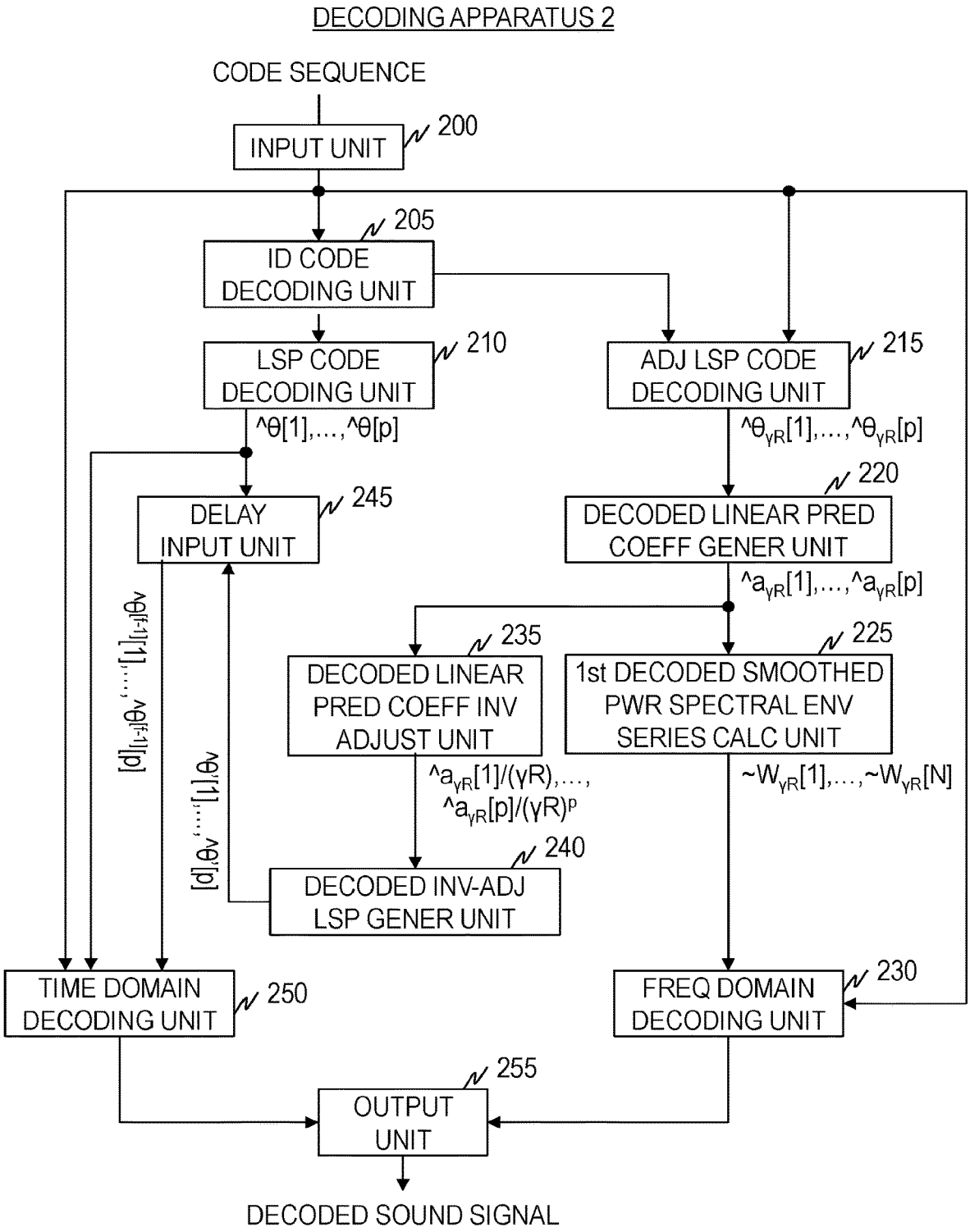
FIG. 6 is a diagram illustrating the functional configuration of a decoding apparatus in the first embodiment.

As illustrated in FIG. 6, the decoding apparatus 2 includes an input unit 200, an identification code decoding unit 205, an LSP code decoding unit 210, a adjusted LSP code decoding unit 215, a decoded linear prediction coefficient generating unit 220, a first decoded smoothed power spectral envelope series calculating unit 225, a frequency domain decoding unit 230, a decoded linear prediction coefficient inverse adjustment unit 235, a decoded inverse-adjusted LSP generating unit 240, a delay input unit 245, a time domain decoding unit 250, and an output unit 255, for example.

The decoding apparatus 2 is a specialized device build by incorporating special programs into a known or dedicated computer having a central processing unit (CPU), main memory (random access memory or RAM), and the like, for example. The decoding apparatus 2 performs various kinds of processing under the control of the central processing unit, for example. Data input to the decoding apparatus 2 or data resulting from various kinds of processing are stored in the main memory, for example, and data stored in the main memory are retrieved for use in other processing as necessary. At least some of the processing components of the decoding apparatus 2 may be implemented by hardware such as an integrated circuit.

<Decoding Method>

Figure 7:
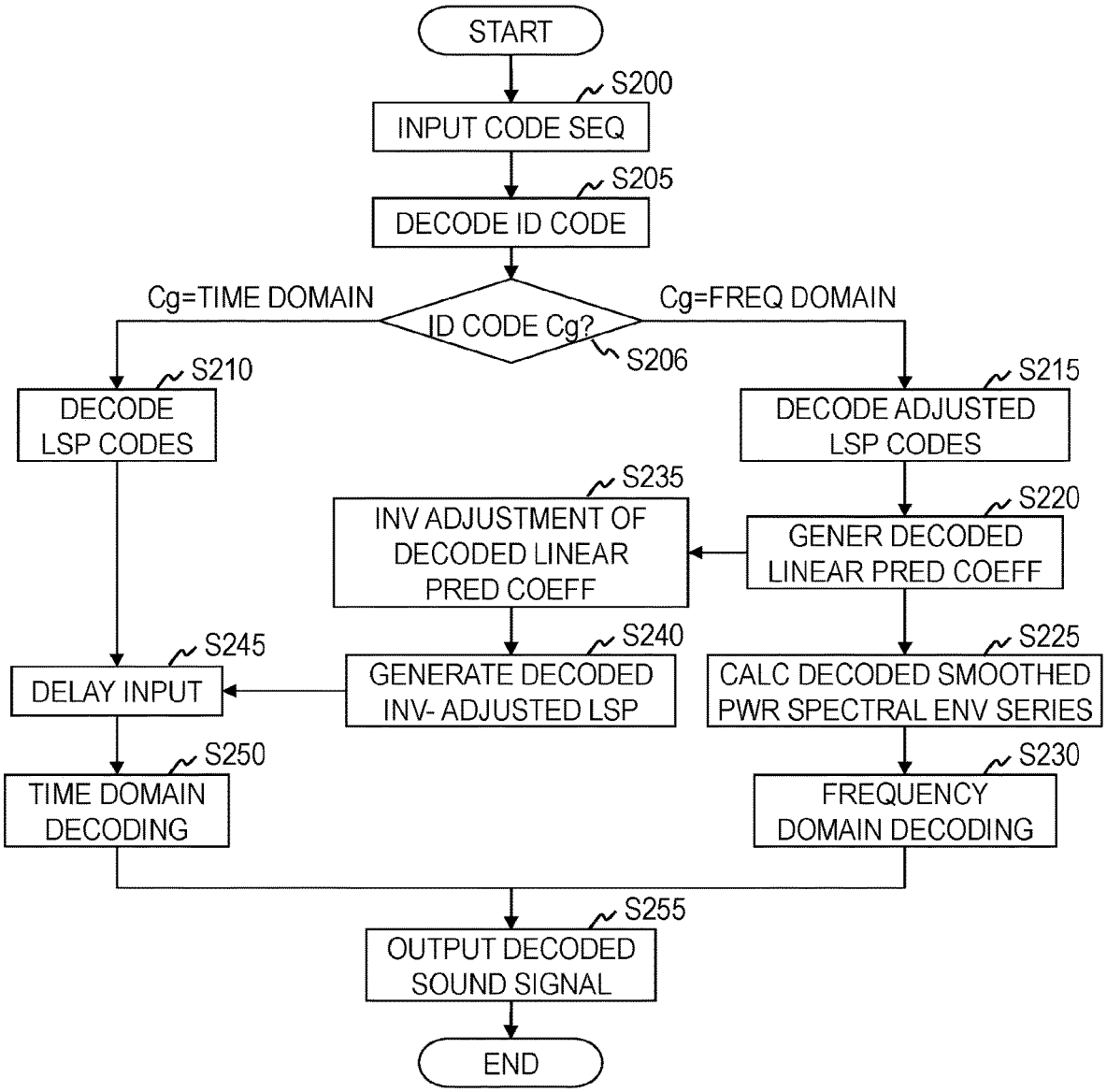
FIG. 7 is a diagram illustrating the process flow of the decoding method in the first embodiment.

Referring to FIG. 7, the decoding method in the first embodiment will be described.

At step S200, a code sequence generated in the encoding apparatus 1 is input to the decoding apparatus 2. The code sequence contains the LSP code C1, identification code Cg, adjusted LSP code Cγ, and either frequency domain signal codes or time domain signal codes.

At step S205, the identification code decoding unit 205 implements control so that the adjusted LSP code decoding unit 215 will execute the subsequent processing if the identification code Cg contained in the input code sequence corresponds to information indicating the frequency domain encoding method, and so that the LSP code decoding unit 210 will execute the subsequent processing if the identification code Cg corresponds to information indicating the time domain encoding method.

The adjusted LSP code decoding unit 215, the decoded linear prediction coefficient generating unit 220, the first decoded smoothed power spectral envelope series calculating unit 225, the frequency domain decoding unit 230, the decoded linear prediction coefficient inverse adjustment unit 235, and the decoded inverse-adjusted LSP generating unit 240 are executed when the identification code Cg contained in the input code sequence corresponds to information indicating the frequency domain encoding method (step S206).

At step S215, the adjusted LSP code decoding unit 215 obtains a decoded adjusted LSP parameter sequence $\hat{\theta}_{\gamma R}[1]$, $\hat{\theta}_{\gamma R}[2], \ldots, \hat{\theta}_{\gamma R}[p]$ by decoding the adjusted LSP code Cγ contained in the input code sequence, and outputs it. That is, it obtains and outputs a decoded adjusted LSP parameter sequence $\hat{\theta}_{\gamma R}[1], \hat{\theta}_{\gamma R}[2], \ldots, \hat{\theta}_{\gamma R}[p]$ which is a sequence of LSP parameters corresponding to the adjusted LSP code Cγ. The same symbols are used because the decoded adjusted LSP parameter sequence $\hat{\theta}_{\gamma R}[1], \hat{\theta}_{\gamma R}[2], \ldots, \hat{\theta}_{\gamma R}[p]$ obtained here is identical to the adjusted quantized LSP parameter sequence $\hat{\theta}_{\gamma R}[1], \hat{\theta}_{\gamma R}[2], \ldots, \hat{\theta}_{\gamma R}[p]$ generated by the encoding apparatus 1 if the adjusted LSP code Cγ output by the encoding apparatus 1 is accurately input to the decoding apparatus 2 without being affected by code errors or the like.

The decoded adjusted LSP parameter sequence $\hat{\theta}_{\gamma R}[1]$, $\hat{\theta}_{\gamma R}[2], \ldots, \hat{\theta}_{\gamma R}[p]$ output by the adjusted LSP code decoding unit 215 is input to the decoded linear prediction coefficient generating unit 220.

At step S220, the decoded linear prediction coefficient generating unit 220 generates and outputs a series of linear prediction coefficients, $\hat{a}_{\gamma R}[1], \hat{a}_{\gamma R}[2], \ldots, \hat{a}_{\gamma R}[p]$, from the decoded adjusted LSP parameter sequence $\hat{\theta}_{\gamma R}[1]$, $\hat{\theta}_{\gamma R}[2], \ldots, \hat{\theta}_{\gamma R}[p]$ output by the adjusted LSP code decoding unit 215. In the following description, the series $\hat{a}_{\gamma R}[1], \hat{a}_{\gamma R}[2], \ldots, \hat{a}_{\gamma R}[p]$ will be called a decoded adjusted linear prediction coefficient sequence.

The decoded linear prediction coefficient sequence $\hat{a}_{\gamma R}[1], \hat{a}_{\gamma R}[2], \ldots, \hat{a}_{\gamma R}[p]$ output by the decoded linear prediction coefficient generating unit 220 is input to the first decoded smoothed power spectral envelope series calculating unit 225 and the decoded linear prediction coefficient inverse adjustment unit 235.

At step S225, the first decoded smoothed power spectral envelope series calculating unit 225 generates and outputs a decoded smoothed power spectral envelope series $\hat{W}_{\gamma R}[1], \hat{W}_{\gamma R}[2], \ldots, \hat{W}_{\gamma R}[N]$ according to Formula (8) using each coefficient $\hat{a}_{\gamma R}[i]$ in the decoded adjusted linear prediction coefficient sequence $\hat{a}_{\gamma R}[1], \hat{a}_{\gamma R}[2], \ldots, \hat{a}_{\gamma R}[p]$ output by the decoded linear prediction coefficient generating unit 220.

The decoded smoothed power spectral envelope series $\hat{W}_{\gamma R}[1], \hat{W}_{\gamma R}[2], \ldots, \hat{W}_{\gamma R}[N]$ output by the first decoded smoothed power spectral envelope series calculating unit 225 is input to the frequency domain decoding unit 230.

At step S230, the frequency domain decoding unit 230 decodes the frequency domain signal codes contained in the input code sequence to determine a decoded normalized frequency domain signal sequence $X_N[1], X_N[2], \ldots, X_N[N]$. Next, the frequency domain decoding unit 230 obtains a decoded frequency domain signal sequence $X[1], X[2], \ldots, X[N]$ by multiplying each value $X_N[n]$ $(n=1, \ldots, N)$ in the decoded normalized frequency domain signal sequence $X_N[1], X_N[2], \ldots, X_N[N]$ by the square root of each value $\hat{W}_{\gamma R}[n]$ in the decoded smoothed power spectral envelope series $\hat{W}_{\gamma R}[1], \hat{W}_{\gamma R}[2], \ldots, \hat{W}_{\gamma R}[N]$, and outputs it. That is, it calculates $X[n]=X_N[n]\times\mathrm{sqrt}(\hat{W}_{\gamma R}[n])$. It then converts the decoded frequency domain signal sequence $X[1], X[2], \ldots, X[N]$ into the time domain to obtain and output decoded sound signals.

At step S235, the decoded linear prediction coefficient inverse adjustment unit 235 determines and outputs a series, $\hat{a}_{\gamma R}[1]/(\gamma R), \hat{a}_{\gamma R}[2]/(\gamma R)^2, \ldots, \hat{a}_{\gamma R}[p]/(\gamma R)^p$, of value $\hat{a}_{\gamma}[i]/(\gamma R)^i$ by dividing each value $\hat{a}_{\gamma R}[i]$ in the decoded adjusted linear prediction coefficient sequence $\hat{a}_{\gamma R}[1], \hat{a}_{\gamma R}[^2], \ldots, \hat{a}_{\gamma R}[p]$ output by the decoded linear prediction coefficient generating unit 220 by the ith power of the adjustment factor γR. In the following description, the series $\hat{a}_{\gamma R}[1]/(\gamma R), \hat{a}_{\gamma R}[2]/(\gamma R)^2, \ldots, \hat{a}_{\gamma R}[p]/(\gamma R)^p$ will be called a decoded inverse-adjusted linear prediction coefficient sequence. The adjustment factor γR is set to the same value as the adjustment factor γR used in the linear prediction coefficient adjusting unit 125 of the encoding apparatus 1.

The decoded inverse-adjusted linear prediction coefficient sequence $\hat{a}_{\gamma R}[1]/(\gamma R), \hat{a}_{\gamma R}[2]/(\gamma R)^2, \ldots, \hat{a}_{\gamma R}[p]/(\gamma R)^p$ output by the decoded linear prediction coefficient inverse adjustment unit 235 is input to the decoded inverse-adjusted LSP generating unit 240.

At step S240, the decoded inverse-adjusted LSP generating unit 240 determines an LSP parameter series $\hat{\theta}'[1]$, $\hat{\theta}'[2], \ldots, \hat{\theta}'[p]$ from the decoded inverse-adjusted linear prediction coefficient sequence $\hat{a}_{\gamma R}[1]/(\gamma R)$, $\hat{a}_{\gamma R}[2]/(\gamma R)^2, \ldots, \hat{a}_{\gamma R}[p]/(\gamma R)^p$, and outputs it. In the following description, the LSP parameter series $\hat{\theta}'[1], \hat{\theta}'[2], \ldots, \hat{\theta}'[p]$ will be called a decoded inverse-adjusted LSP parameter sequence.

The decoded inverse-adjusted LSP parameters $\hat{\theta}'[1], \hat{\theta}'[2], \ldots, \hat{\theta}'[p]$ output by the decoded inverse-adjusted LSP generating unit 240 are input to the delay input unit 245 as a decoded LSP parameter sequence $\hat{\theta}'[1], \hat{\theta}'[2], \ldots, \hat{\theta}'[p]$.

The LSP code decoding unit 210, the delay input unit 245, and the time domain decoding unit 250 are executed when the identification code Cg contained in the input code sequence corresponds to information indicating the time domain encoding method (step S206).

At step S210, the LSP code decoding unit 210 decodes the LSP code C1 contained in the input code sequence to obtain a decoded LSP parameter sequence $\hat{\theta}'[1], \hat{\theta}'[2], \ldots, \hat{\theta}'[p]$, and outputs it. That is, it obtains and outputs a decoded LSP parameter sequence $\hat{\theta}'[1], \hat{\theta}'[2], \ldots, \hat{\theta}'[p]$, which is a sequence of LSP parameters corresponding to the LSP code C1.

The decoded LSP parameter sequence $\hat{\theta}[1], \hat{\theta}[2], \ldots, \hat{\theta}[p]$ output by the LSP code decoding unit 210 is input to the delay input unit 245 and the time domain decoding unit 250.

At step S245, the delay input unit 245 holds the input decoded LSP parameter sequence $\hat{\theta}[1], \hat{\theta}[2], \ldots, \hat{\theta}[p]$ and outputs it to the time domain decoding unit 250 with a delay equivalent to the duration of one frame. For instance, if the current frame is the fth frame, the decoded LSP parameter sequence for the f−1th frame, $\hat{\theta}^{f-1}[1], \hat{\theta}^{f-1}[2], \ldots, \hat{\theta}^{f-1}[p]$, is output to the time domain decoding unit 250.

When the identification code Cg contained in the input code corresponds to information indicating the frequency domain encoding method, the decoded inverse-adjusted LSP parameter sequence $\hat{\theta}'[1], \hat{\theta}'[2], \ldots, \hat{\theta}'[p]$ output by the decoded inverse-adjusted LSP generating unit 240 is input to the delay input unit 245 as the decoded LSP parameter sequence $\hat{\theta}[1], \hat{\theta}[2], \ldots, \hat{\theta}[p]$.

At step S250, the time domain decoding unit 250 identifies the waveforms contained in the adaptive codebook and waveforms in the fixed codebook from the time domain signal codes contained in the input code sequence. By applying the synthesis filter to a signal generated by synthesis of the waveforms in the adaptive codebook and the waveforms in the fixed codebook that have been identified, a synthesized signal from which the effect of the spectral envelope has been removed is determined, and the synthesized signal determined is output as a decoded sound signal.

The filter coefficients for the synthesis filter are generated using the decoded LSP parameter sequence for the fth frame, $\hat{\theta}[1], \hat{\theta}[2], \ldots, \hat{\theta}[p]$, and the decoded LSP parameter sequence for the f−1th frame, $\hat{\theta}^{f-1}[1], \hat{\theta}^{f-1}[2], \ldots, \hat{\theta}^{f-1}[p]$.

Specifically, a frame is first divided into two subframes, and the filter coefficients for the synthesis filter are determined as follows.

In the latter-half subframe, a series of values $$\hat{a}[1]\times(\gamma R), \hat{a}[2]\times(\gamma R)^2, \ldots, \hat{a}[p]\times(\gamma R)^p$$

is used as filter coefficients for the synthesis filter. This is obtained by multiplying each coefficient $\hat{a}[i]$ of the decoded linear prediction coefficients $\hat{a}[1], \hat{a}[2], \ldots, \hat{a}[p]$, which is a coefficient sequence generated by converting the decoded LSP parameter sequence for the fth frame, $\hat{\theta}[1], \hat{\theta}[2], \ldots, \hat{\theta}[p]$, into linear prediction coefficients, by the ith power of the adjustment factor $\gamma R$.

In the first-half subframe, a series of values $$\sim a[1]\times(\gamma R), \sim a[2]\times(\gamma R)^2, \ldots, \sim a[p]\times(\gamma R)^p$$

which is obtained by multiplying each coefficient $\sim a[i]$ of decoded interpolated linear prediction coefficients $\sim a[1], \sim a[2], \ldots, \sim a[p]$ by the ith power of the adjustment factor $\gamma R$, is used as filter coefficients for the synthesis filter. The decoded interpolated linear prediction coefficients $\sim a[1], \sim a[2], \ldots, \sim a[p]$ is a coefficient sequence generated by converting, into linear prediction coefficients, the decoded interpolated LSP parameter sequence $\sim\theta[1], \sim\theta[2], \ldots, \sim\theta[p]$, which is a series of intermediate values between each value $\hat{\theta}[i]$ in the decoded LSP parameter sequence for the fth frame, $\hat{\theta}[1], \hat{\theta}[2], \ldots, \hat{\theta}[p]$, and each value $\hat{\theta}^{[f-1]}[i]$ in the decoded LSP parameter sequence for the f−1th frame, $\theta^{[f-1]}[1], \theta^{[f-1]}[2], \ldots, \theta^{[f-1]}[p]$. That is, $$\sim\theta[i]=0.5\times\hat{\theta}^{[f-1]}[i]+0.5\times\hat{\theta}[i] \quad (i=1, \ldots, p).$$

<Effects of the First Embodiment>

The adjusted LSP encoding unit 135 of the encoding apparatus 1 determines such a adjusted quantized LSP parameter sequence $\hat{\theta}_{\gamma R}[1], \hat{\theta}_{\gamma R}[2], \ldots, \hat{\theta}_{\gamma R}[p]$ that minimizes the quantizing distortion between the adjusted LSP parameter sequence $\theta_{\gamma R}[1], \theta_{\gamma R}[2], \ldots, \theta_{\gamma R}[p]$ and the adjusted quantized LSP parameter sequence $\hat{\theta}_{\gamma R}[1], \hat{\theta}_{\gamma R}[2], \ldots, \hat{\theta}_{\gamma R}[p]$. This can determine the adjusted quantized LSP parameter sequence $\hat{\theta}_{\gamma R}[1], \hat{\theta}_{\gamma R}[2], \ldots, \hat{\theta}_{\gamma R}[p]$ so that a power spectral envelope series that takes into account the sense of hearing (i.e., that has been smoothed with adjustment factor $\gamma R$) is approximated with high accuracy. The quantized smoothed power spectral envelope series $\hat{W}_{\gamma R}[1], \hat{W}_{\gamma R}[2], \ldots, \hat{W}_{\gamma R}[N]$, which is a power spectral envelope series obtained by expanding the adjusted quantized LSP parameter sequence $\hat{\theta}_{\gamma R}[1], \hat{\theta}_{\gamma R}[2], \ldots, \hat{\theta}_{\gamma R}[p]$ into the frequency domain, can approximate the smoothed power spectral envelope series $W_{\gamma R}[1], W_{\gamma R}[2], \ldots, W_{\gamma R}[N]$ with high accuracy. When the code amount of the LSP code C1 is the same as that of the adjusted LSP code $C\gamma$, the first embodiment yields smaller encoding distortion in frequency domain encoding than the conventional technique. In addition, assuming an equal encoding distortion to that in the conventional encoding method, the adjusted LSP code $C\gamma$ achieves a further smaller code amount compared to the conventional method than the LSP code C1 does. Thus, with a encoding distortion equal to that in the conventional method, the code amount can be reduced compared to the conventional method, whereas with the same code amount as the conventional method, encoding distortion can be reduced compared to the conventional method.

Second Embodiment

The encoding apparatus 1 and decoding apparatus 2 of the first embodiment are expensive in terms of calculation in the inverse-adjusted LSP generating unit 160 and the decoded inverse-adjusted LSP generating unit 240 in particular. To address this, a encoding apparatus 3 in a second embodiment directly generates an approximate quantized LSP parameter sequence $\hat{\theta}[1]_{app}, \hat{\theta}[2]_{app}, \ldots, \hat{\theta}[p]_{app}$, which is a series of approximations of the values in the quantized LSP parameter sequence $\hat{\theta}[1], \hat{\theta}[2], \ldots, \hat{\theta}[p]$, from the adjusted quantized LSP parameter sequence $\hat{\theta}_{\gamma R}[1], \hat{\theta}_{\gamma R}[2], \ldots, \hat{\theta}_{\gamma R}[p]$ without the intermediation of linear prediction coefficients. Similarly, a decoding apparatus 4 in the second embodiment directly generates a decoded approximate LSP parameter sequence $\hat{\theta}[1]_{app}$, $\hat{\theta}[2]_{app}, \ldots, \hat{\theta}[p]_{app}$, which is a series of approximations of the values in the decoded LSP parameter sequence $\hat{\theta}[1], \hat{\theta}[2], \ldots, \hat{\theta}[p]$, from the decoded adjusted LSP parameter sequence $\hat{\theta}_{\gamma R}[1], \hat{\theta}_{\gamma R}[2], \ldots, \hat{\theta}_{\gamma R}[p]$ without the intermediation of linear prediction coefficients.

<Encoding Apparatus>

Figure 8:
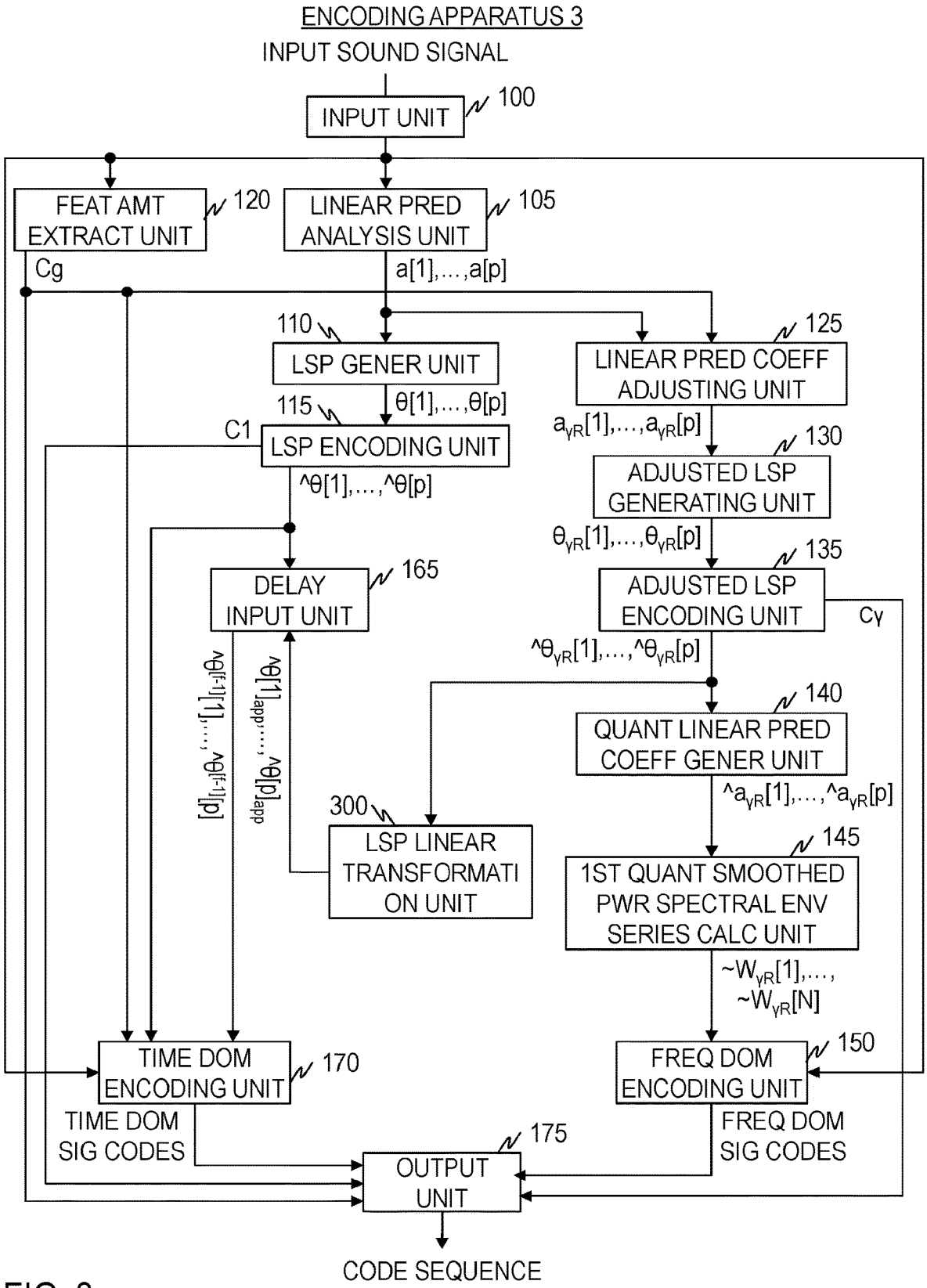
FIG. 8 is a diagram illustrating the functional configuration of the encoding apparatus in a second embodiment.

FIG. 8 shows the functional configuration of the encoding apparatus 3 in the second embodiment.

The encoding apparatus 3 differs from the encoding apparatus 1 of the first embodiment in that it does not include the quantized linear prediction coefficient inverse adjustment unit 155 and the inverse-adjusted LSP generating unit 160 but includes an LSP linear transformation unit 300 instead.

Utilizing the nature of LSP parameters, the LSP linear transformation unit 300 applies approximate linear transformation to a adjusted quantized LSP parameter sequence $\hat{\theta}_{\gamma R}[1], \hat{\theta}_{\gamma R}[2], \ldots, \hat{\theta}_{\gamma R}[p]$ to generate an approximate quantized LSP parameter sequence $\hat{\theta}[1]_{app}, \hat{\theta}[2]_{app}, \ldots, \hat{\theta}[p]_{app}$.

First, the nature of LSP parameters will be described.

Although the LSP linear transformation unit 300 applies approximate transformation to a series of quantized LSP parameters, the nature of an unquantized LSP parameter sequence will be discussed first because the nature of a quantized LSP parameter series is basically the same as the nature of an unquantized LSP parameter sequence.

An LSP parameter sequence $\theta[1], \theta[2], \ldots, \theta[p]$ is a parameter sequence in the frequency domain that is correlated with the power spectral envelope of the input sound signal. Each value in the LSP parameter sequence is correlated with the frequency position of the extreme of the power spectral envelope of the input sound signal. The extreme of the power spectral envelope is present at a frequency position between $\theta[i]$ and $\theta[i+1]$; and with a steeper slope of a tangent around the extreme, the interval between $\theta[i]$ and $\theta[i+1]$ (i.e., the value of $\theta[i+1]-\theta[i]$) becomes smaller. In other words, as the height difference in the waves of the amplitude of the power spectral envelope is larger, the interval between $\theta[i]$ and $\theta[i+1]$ becomes less even for each i (i=1, 2, . . . , p−1). Conversely, when there is almost no height difference in the waves of the power spectral envelope, the interval between $\theta[i]$ and $\theta[i+1]$ is close to an equal interval for each value of i.

As the value of the adjustment factor $\gamma$ becomes smaller, the height difference in the waves of the amplitude of smoothed power spectral envelope series $W_\gamma[1], W_\gamma[2], \ldots, W_\gamma[N]$, defined by Formula (7), becomes smaller than the height difference in the waves of the amplitude of the power spectral envelope series $W[1], W[2], \ldots, W[N]$ defined by Formula (6). It can be accordingly said that a smaller value of the adjustment factor $\gamma$ makes the interval between $\theta[i]$ and $\theta[i+1]$ closer to an equal interval. When $\gamma$ has no influence (i.e., $\gamma=0$), this corresponds to the case of a flat power spectral envelope.

When the adjustment factor $\gamma=0$, adjusted LSP parameters $\theta_{\gamma=0}[1], \theta_{\gamma=0}[2], \ldots, \theta_{\gamma=0}[p]$ are $$\theta_{\gamma=0}(i) = \frac{i\pi}{p+1},$$

in which case the interval between $\theta[i]$ and $\theta[i+1]$ is equal for all i=1, . . . , p31 1. When $\gamma=1$, the adjusted LSP parameter sequence $\theta_{\gamma=1}[1], \theta_{\gamma=1}[2], \ldots, \theta_{\gamma=1}[p]$ and the LSP parameter sequence $\theta[1], \theta[2], \ldots, \theta[p]$ are equivalent. The adjusted LSP parameters satisfy the property:

$$0<\theta_{65}[1]<\theta_\gamma[2] \ldots <\theta_{65}[p]<\pi.$$

Figure 9:
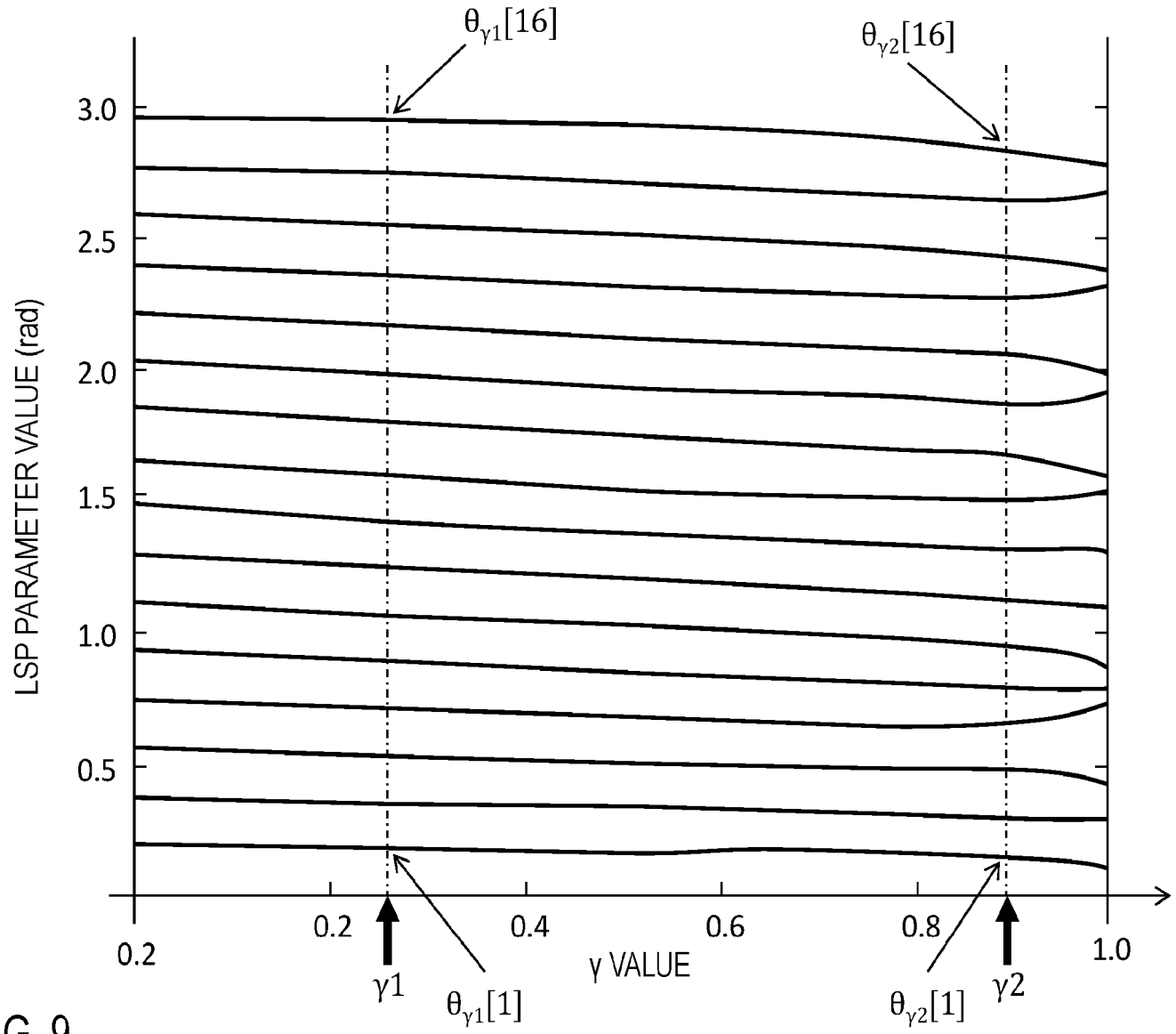
FIG. 9 is a diagram for describing the nature of LSP parameters.

FIG. 9 is an example of the relation between the adjustment factor $\gamma$ and adjusted LSP parameter $\theta_\gamma[i]$ (i=1, 2, . . . , p). The horizontal axis represents the value of adjustment factor $\gamma$ and the vertical axis represents the adjusted LSP parameter value. The plot illustrates the values of $\theta_\gamma[1], \theta_\gamma[2], \ldots, \theta_\gamma[16]$ in order from the bottom assuming the order of prediction p=16. The value of each $\theta_\gamma[i]$ is derived by determining a adjusted linear prediction coefficient sequence $a_\gamma[1], a_\gamma[2], \ldots, a_\gamma[p]$ for each value of $\gamma$ through processing similar to the linear prediction coefficient adjusting unit 125 by use of a linear prediction coefficient sequence $a[1], a[2], \ldots, a[p]$ which has been obtained by linear prediction analysis on a certain speech sound signal, and then converting the adjusted linear prediction coefficient sequence $a_\gamma[1], a_\gamma[2], \ldots, a_\gamma[p]$ into LSP parameters through similar processing to the adjusted LSP generating unit 130. When $\gamma=1$, $\theta_{\gamma=1}[i]$ is equivalent to $\theta[i]$.

As shown in FIG. 9, given $0<\gamma<1$, the LSP parameter $\theta_\gamma[i]$ is an internal division point between $\theta_{\gamma=0}[i]$ and $\theta_{\gamma=1}[i]$. On a two-dimensional plane where the horizontal axis represents the value of adjustment factor $\gamma$ and the vertical axis represents the LSP parameter value, each LSP parameter $\theta_\gamma[i]$, when seen locally, is in a linear relationship with increase or decrease of $\gamma$. Given two different adjustment factors $\gamma1$ and $\gamma2$ ($0<\gamma1<\gamma2\leq1$), the magnitude of the slope of a straight line connecting a point ($\gamma1$, $\theta_{\gamma1}[i]$) and a point ($\gamma2$, $\theta_{\gamma2}[i]$) on the two-dimensional plane is correlated with the relative interval between the LSP parameters that precede and follow $\theta_{\gamma1}[i]$ in the LSP parameter sequence, $\theta_{\gamma1}[1], \theta_{\gamma1}[2], \ldots, \theta_{\gamma1}[p]$ (i.e., $\theta_{\gamma1}[i-1]$ and $\theta_{\gamma1}[i+1]$), and $\theta_{\gamma1}[i]$. Specifically, when $$|\theta_{\gamma1}[i]-\theta_{\gamma1}[i-1]|>|\theta_{\gamma1}[i+1]-\theta_{\gamma1}[i]| \tag{9}$$

then the following properties hold:

$$|\theta_{\gamma2}[i+1]-\theta_{\gamma2}[i]|<|\theta_{\gamma1}[i+1]-\theta_{\gamma1}[i]|, \text{ and}$$

$$|\theta_{\gamma2}[i]-\theta_{\gamma2}[i-1]|>|\theta_{\gamma1}[i]-\theta_{\gamma1}[i-1]| \tag{10}$$

When $$|\theta_{\gamma1}[i]-\theta_{\gamma1}[i-1]|<|\theta_{\gamma1}[i+1]-\theta_{\gamma1}[i]| \tag{11}$$

then the following properties hold:

$$|\theta_{\gamma2}[i+1]-\theta_{\gamma2}[i]|>|\theta_{\gamma1}[i+1]-\theta_{\gamma1}[i]|, \text{ and}$$

$$|\theta_{\gamma2}[i]-\theta_{\gamma2}[i-1]|<|\theta_{\gamma1}[i]-\theta_{\gamma1}[i-1]|. \tag{12}$$

Figure 10:
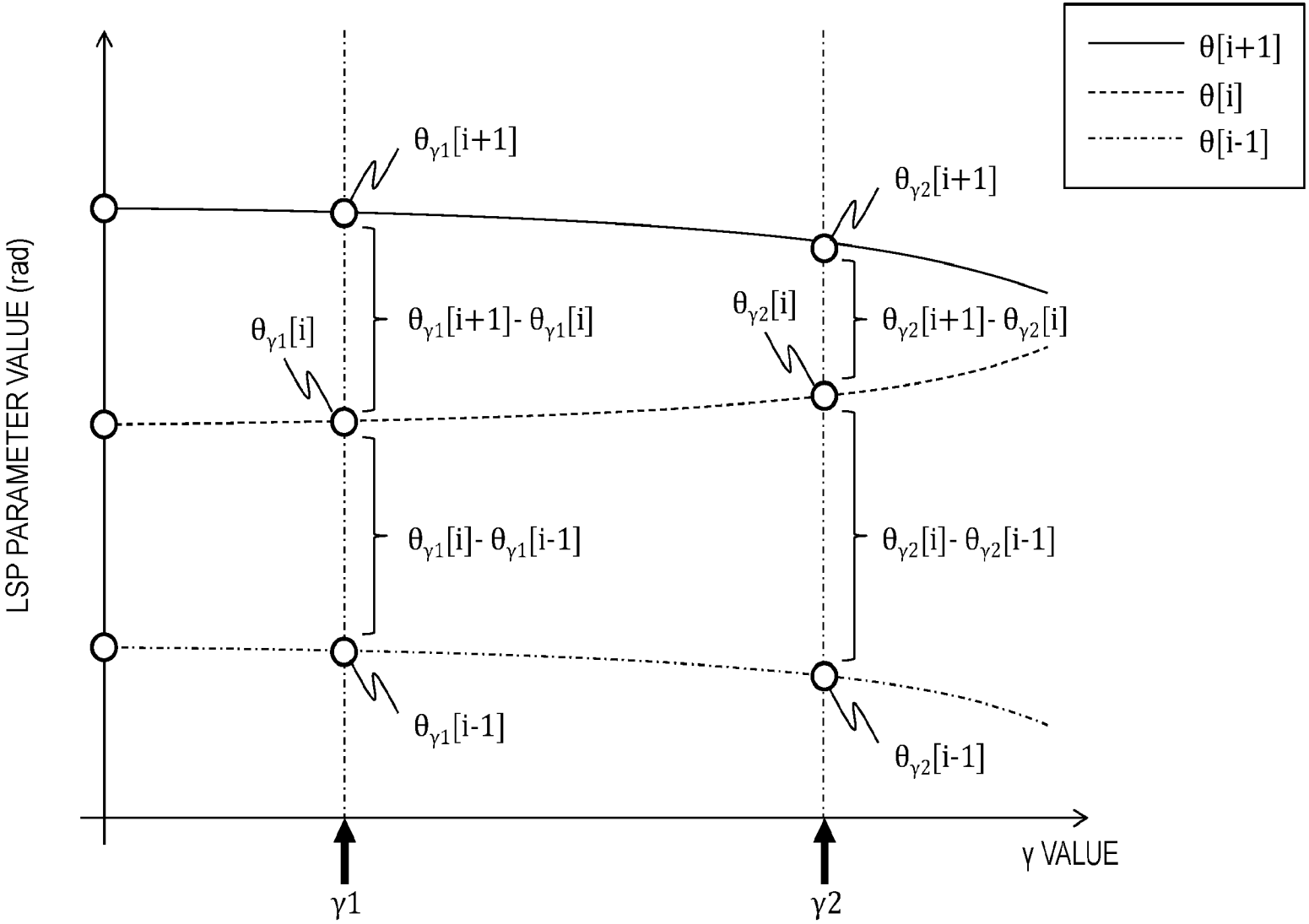
FIG. 10 is a diagram for describing the nature of LSP parameters.

Formulas (9) and (10) indicate that when $\theta_{\gamma1}[i]$ is closer to $\theta_{\gamma1}[i+1]$ with respect to the midpoint between $\theta_{\gamma1}[i+1]$ and $\theta_{\gamma1}[i-1]$, $\theta_\gamma[i]$ will assume a value that is further closer to $\theta_{\gamma2}[i+1]$ (see FIG. 10). This means that on a two-dimensional plane with the horizontal axis being the $\gamma$ value and the vertical axis being the LSP parameter value, the slope of straight line L2 connecting the point ($\gamma1$, $\theta_{\gamma1}[i]$) and the point ($\gamma2$, $\theta_{\gamma2}[i]$) is larger than the slope of straight line L1 connecting a point (0, $\theta_{\gamma=0}[i]$) and a point ($\gamma1$, $\theta_{\gamma1}[i]$) (see FIG. 11).

Formulas (11) and (12) indicate that when $\theta_{\gamma1}[i]$ is closer to $\theta_{\gamma1}[i-1]$ with respect to the midpoint between $\theta_{\gamma1}[i+1]$ and $\theta_{\gamma1}[i-1]$, $\theta_\gamma[i]$ will assume a value that is further closer to $\theta_{\gamma2}[i-1]$. This means that on a two-dimensional plane with the horizontal axis being the $\gamma$ value and the vertical axis being the LSP parameter value, the slope of straight line connecting the point ($\gamma1$, $\theta_{\gamma1}[i]$) and the point ($\gamma2$, $\theta_{\gamma2}[i]$) is smaller than the slope of a straight line connecting the point $(0, \theta_{\gamma=0}[i])$ and the point $(\gamma 1, \theta_{\gamma 1}[i])$.

Based on the properties above, the relationship between $\theta_{\gamma 1}[1], \theta_{\gamma 1}[2], \ldots, \theta_{\gamma 1}[p]$ and $\theta_{\gamma 2}[1], \theta_{\gamma 2}[2], \ldots, \theta_{\gamma 2}[p]$ can be modeled with Formula (13), where $\Theta_{\gamma 1}=(\theta_{\gamma 1}[1], \theta_{\gamma 1}[2], \ldots, \theta_{\gamma 1}[p])^T$ and $\Theta_{\gamma 2}=(\theta_{\gamma 2}[1], \theta_{\gamma 2}[2], \ldots, \theta_{\gamma 2}[p])^T$:

$$\Theta_{\gamma 2} \approx K(\Theta_{\gamma 1}-\Theta_{\gamma=0})(\gamma_2-\gamma_1)+\Theta_{\gamma 1} \tag{13}$$

where K is a p×p matrix defined by Formula (14).

$$K = \begin{pmatrix} x_1 & y_1 & & & 0 \\ z_2 & x_2 & y_2 & & \\ & z_3 & x_3 & y_3 & \\ & & \ddots & \ddots & \ddots \\ & & & \ddots & \ddots \\ 0 & & & z_p & x_p \end{pmatrix} \tag{14}$$

In this case, $0<\gamma 1$, $\gamma 2 \leq 1$, and $\gamma 1 \neq \gamma 2$ hold. Although Formulas (9) to (12) describe the relationships on the assumption of $\gamma 1<\gamma 2$, the model of Formula (13) has no limitation on the relation of magnitude between $\gamma 1$ and $\gamma 2$; they may be either $\gamma 1<\gamma 2$ or $\gamma 1>\gamma 2$.

The matrix K is a band matrix that has non-zero values only in the diagonal components and elements adjacent to them and is a matrix representing the correlations described above that hold between LSP parameters corresponding to the diagonal components and the neighboring LSP parameters. Note that although Formula (14) illustrates a band matrix with a band width of three, the band width is not limited to three.

Assuming that $$\tilde{\Theta}_{\gamma 2}=K(\Theta_{\gamma 1}-\Theta_{\gamma=0})(\gamma_2-\gamma_1)+\Theta_{\gamma 1} \tag{13a}$$

then $$\sim\Theta_{\gamma 2}=(\sim\theta_{\gamma 2}[1], \sim\theta_{\gamma 2}[2], \ldots, \sim\theta_{\gamma 2}[p])^T$$

is an approximation of $\Theta_{\gamma 2}$.

Expanding Formula (13a) gives Formula (15) below:

$$\tilde{\theta}_{\gamma 2}[i]=z_i(\theta_{\gamma 1}[i-1]-\theta_{\gamma=0}[i-1])+\gamma_i(\theta_{\gamma 1}[i+1]-\theta_{\gamma=0}[i+1])+ x_i(\theta_{\gamma 1}[i]-\theta_{\gamma=0}[i])+\theta_{\gamma 1}[i] \tag{15}$$

where $i=2, \ldots, p-1$.

Figure 11:
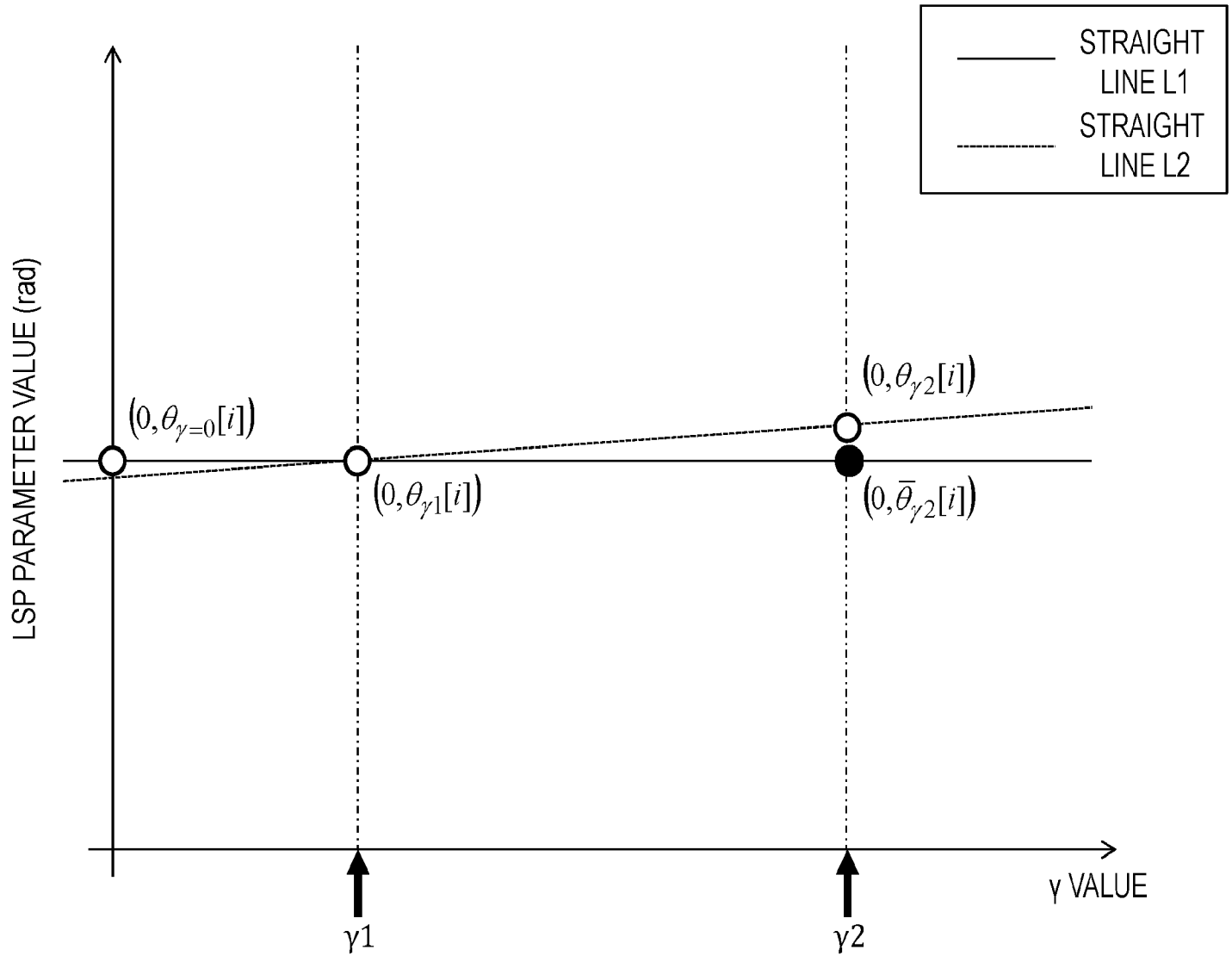
FIG. 11 is a diagram for describing the nature of LSP parameters.

On a two-dimensional plane with the horizontal axis representing the γ value and the vertical axis representing the LSP parameter value, let $^{-}\theta_{\gamma 2}[i]$ denote the value on the vertical axis corresponding to γ2 on an extension of straight line L1 that connects between the point $(\gamma 1, \theta_{\gamma 1}[i])$ and the point $(0, \theta_{\gamma=0}[i])$, namely the value on the vertical axis corresponding to γ2 as approximated by straight line approximation from the slope of straight line L1 connecting $\theta_{\gamma 1}[i]$ and $\theta_{\gamma=0}[i]$ (see FIG. 11). Then, $$\bar{\theta}_{\gamma 2}[i] = \frac{\theta_{\gamma 1}[i]-\theta_{\gamma=0}[i]}{\gamma_1}(\gamma_2-\gamma_1)+\theta_{\gamma 1}[i]$$

holds. When $\gamma 1>\gamma 2$, it means straight line interpolation, while when $\gamma 1<\gamma 2$, it means straight line extrapolation.

In Formula (14), given that $$x_i = \frac{1}{\gamma_1},\ y_i = 0,\ z_i = 0,$$

then $\sim\theta_{\gamma 2}[i]=^{-\theta}{}_{\gamma 2}[i]$, and $\sim\theta_{\gamma 2}[i]$ obtained with the model of Formula (13a) matches the estimation $^{-}\theta_{\gamma 2}[i]$ of the LSP parameter value corresponding to γ2 as approximated by straight line approximation with a straight line that connects the point $(\gamma 1, \theta_{\gamma 1}[i])$ and the point $(0, \theta_{\gamma=0}[i])$ on the two-dimensional plane. 101351 Given that $u_i$ and $v_i$ are positive values equal to or smaller than 1, assuming $$x_i = u_i + v_i + \frac{\gamma_2-\gamma_1}{\gamma_1},\ y_i = -v_i,\ z_i = -u_i \tag{16}$$

in the Formula (14) above, Formula (15) can be rewritten as:

$$\begin{aligned} \tilde{\theta}_{\gamma 2}[i] &= u_i(\theta_{\gamma 1}[i]-\theta_{\gamma=0}[i]-(\theta_{\gamma 1}[i-1]-\theta_{\gamma=0}[i-1]))+ \\ &\quad v_i(\theta_{\gamma 1}[i]-\theta_{\gamma=0}[i]-(\theta_{\gamma 1}[i+1]-\theta_{\gamma=0}[i+1]))+ \\ &\quad \frac{\gamma_2-\gamma_1}{\gamma_1}(\theta_{\gamma 1}[i]-\theta_{\gamma=0}[i])+\theta_{\gamma 1}[i] \\ &= u_i(\theta_{\gamma 1}[i]-\theta_{\gamma 1}[i-1]-(\theta_{\gamma=0}[i]-\theta_{\gamma=0}[i-1]))+ \\ &\quad v_i(\theta_{\gamma 1}[i]-\theta_{\gamma 1}[i+1]-(\theta_{\gamma=0}[i]-\theta_{\gamma=0}[i+1]))+\bar{\theta}_{\gamma 2}[i] \\ &= u_i\left(\theta_{\gamma 1}[i]-\theta_{\gamma 1}[i-1]-\frac{\pi}{p+1}\right)- \\ &\quad v_i\left(\theta_{\gamma 1}[i+1]-\theta_{\gamma 1}[i]-\frac{\pi}{p+1}\right)+\bar{\theta}_{\gamma 2}[i] \end{aligned} \tag{17}$$

Formula (17) means adjusting the value of $^{-}\theta_{\gamma 2}[i]$ by weighting the differences between the ith LSP parameter $\theta_{\gamma 1}[i]$ in the LSP parameter sequence, $\theta_{\gamma 1}[1], \theta_{\gamma 1}[2], \ldots, \theta_{\gamma 1}[p]$, and its preceding and following LSP parameter values (i.e., $\theta_{\gamma 1}[i]-\theta_{\gamma 1}[i-1]$ and $\theta_{\gamma 1}[i+1]-\theta_{\gamma 1}[i]$) to obtain $\sim\theta_{\gamma 2}[i]$. That is to say, correlations such as shown in Formulas (9) through (12) above are reflected in the elements in the band portion (non-zero elements) of the matrix K in Formula (13a).

The values $\sim\theta_{\gamma 2}[1], \sim\theta_{\gamma 2}[2], \ldots, \sim\theta_{\gamma 2}[p]$ given by Formula (13a) are approximate values (estimated values) of LSP parameter values $\theta_{\gamma 2}[1], \theta_{\gamma 2}[2], \ldots, \theta_{\gamma 2}[p]$ when the linear prediction coefficient sequence $a[1]\times(\gamma 2), \ldots, a[p]\times(\gamma 2)^p$ is converted to LSP parameters.

Especially when $\gamma 2>\gamma 1$, the matrix K in Formula (14) tends to have positive values in the diagonal components and negative values in elements in the vicinity of them, as indicated by Formulas (16) and (17).

The matrix K is a preset matrix, which is pre-learned using learning data, for example. How to learn the matrix K will be discussed later.

Similar properties also apply to quantized LSP parameters. That is, vectors $\Theta_{\gamma 1}$ and $\Theta_{\gamma 2}$ in the LSP parameter sequence in Formula (13) can be replaced with the vectors $\hat{\Theta}_{\gamma 1}$ and $\hat{\Theta}_{\gamma 2}$ in the quantized LSP parameter sequence, respectively. Specifically, $\hat{\Theta}_{\gamma 1}=(\hat{\theta}_{\gamma 1}[1], \hat{\theta}_{\gamma 1}[2], \ldots, \hat{\theta}_{\gamma 1}[p])^T$ and $\hat{\Theta}_{\gamma 2}=(\hat{\theta}_{\gamma 2}[1], \hat{\theta}_{\gamma 2}[2], \ldots, \hat{\theta}_{\gamma 2}[p])^T$, then the following formula holds:

$$\hat{\Theta}_{\gamma 2} \approx K(\hat{\Theta}_{\gamma 1}-\hat{\Theta}_{\gamma=0})(\gamma_2-\gamma_1)+\hat{\Theta}_{\gamma 1} \tag{13b}$$

Since matrix K is a band matrix, calculation cost required for calculating Formulas (13), (13a), and (13b) is very small.

The LSP linear transformation unit 300 included in the encoding apparatus 3 of the second embodiment generates an approximate quantized LSP parameter sequence $\hat{\theta}[1]_{app}, \hat{\theta}[2]_{app}, \ldots, \hat{\theta}[p]_{app}$ from the adjusted quantized LSP parameter sequence $\hat{\theta}_{\gamma R}[1], \hat{\theta}_{\gamma R}[2], \ldots, \hat{\theta}_{\gamma R}[p]$ based on Formula (13b). Note that the adjustment factor γR used in generation of the adjusted quantized LSP parameter sequence $\hat{\theta}_{\gamma R}[1], \hat{\theta}_{\gamma R}[2], \ldots, \hat{\theta}_{\gamma R}[p]$ is the same as the adjustment factor γR used in the linear prediction coefficient adjusting unit 125.

<Encoding Method>

Figure 12:
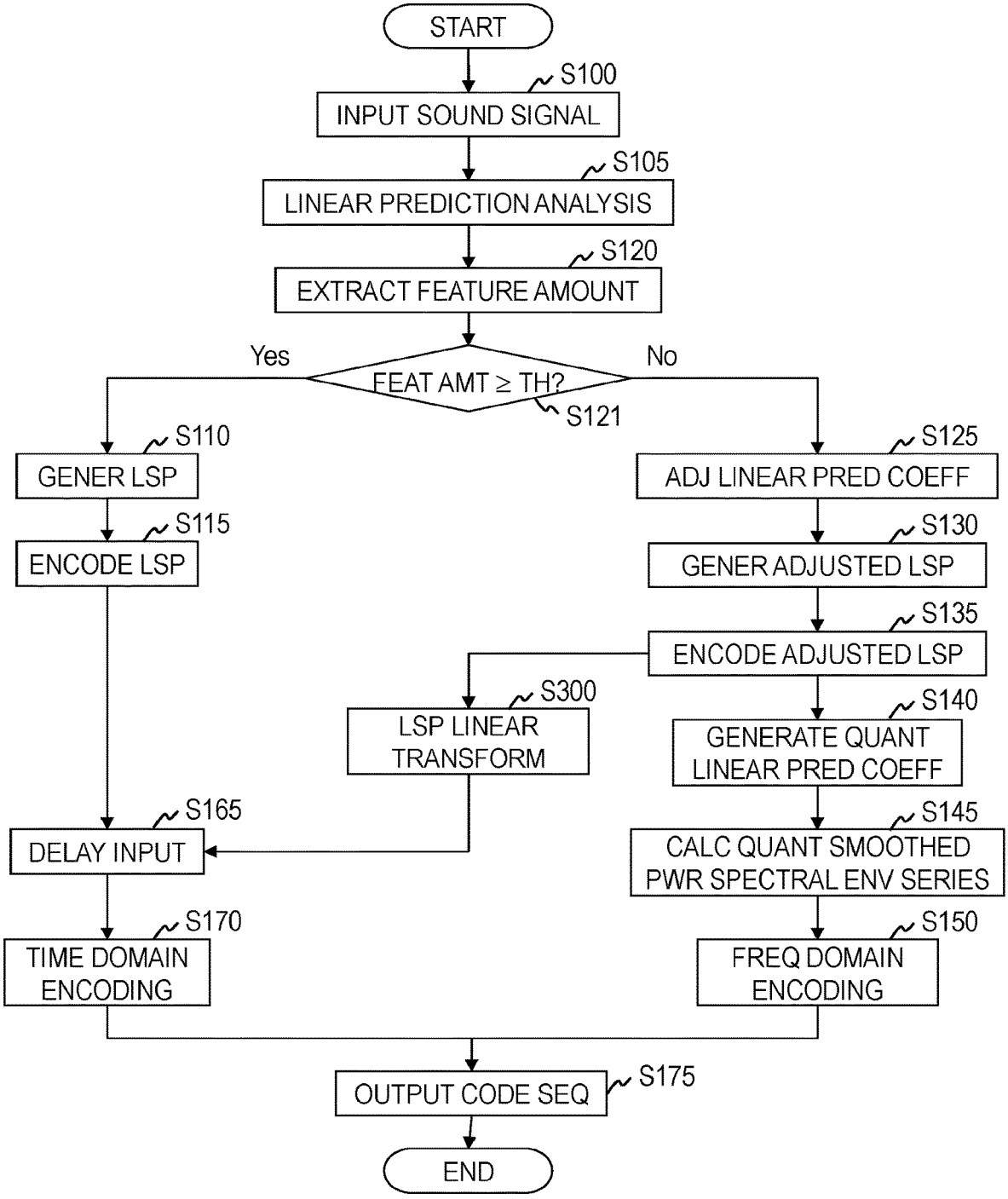
FIG. 12 is a diagram illustrating the process flow of the encoding method in the second embodiment.

Referring to FIG. 12, the encoding method in the second embodiment will be described. The following description mainly focuses on differences from the foregoing embodiment.

Processing performed in the adjusted LSP encoding unit 135 is the same as the first embodiment. However, the adjusted quantized LSP parameter sequence $\hat{\theta}_{\gamma R}[1], \hat{\theta}_{\gamma R}[2], \ldots, \hat{\theta}_{\gamma R}[p]$ output by the adjusted LSP encoding unit 135 is also input to the LSP linear transformation unit 300 in addition to the quantized linear prediction coefficient generating unit 140.

The LSP linear transformation unit 300, given $\hat{\Theta}_{\gamma 1}=(\hat{\theta}_{\gamma 1}[1], \hat{\theta}_{\gamma 1}[2], \ldots, \hat{\theta}_{\gamma 1}[p])^T$, determines and outputs an approximate quantized LSP parameter sequence $\hat{\theta}[1]_{app}, \hat{\theta}[2]_{app}, \ldots, \hat{\theta}[p]_{app}$ according to $$\begin{pmatrix} \hat{\theta}[1]_{app} \\ \vdots \\ \hat{\theta}[p]_{app} \end{pmatrix} = K(\hat{\Theta}_{\gamma 1} - \hat{\Theta}_{\gamma R=0})(\gamma_2 - \gamma_1) + \hat{\Theta}_{\gamma 1}. \tag{18}$$

That is, using Formula (13b), the LSP linear transformation unit 300 determines a series of approximations, $\hat{\theta}[1]_{app}, \hat{\theta}[2]_{app}, \ldots, \hat{\theta}[p]_{app}$, of the quantized LSP parameter sequence. As γ1 and γ2 are constants, matrix K' which is generated by multiplying the individual elements of matrix K by (γ2−γ1) may be used instead of the matrix K of Formula (18), and the approximate quantized LSP parameter sequence $\hat{\theta}[1]_{app}, \hat{\theta}[2]_{app}, \ldots, \hat{\theta}[p]_{app}$ may also be determined by $$\begin{pmatrix} \hat{\theta}[1]_{app} \\ \vdots \\ \hat{\theta}[p]_{app} \end{pmatrix} = K'(\hat{\Theta}_{\gamma 1} - \hat{\Theta}_{\gamma R=0}) + \hat{\Theta}_{\gamma 1}. \tag{18a}$$

The approximate quantized LSP parameter sequence $\hat{\theta}[1]_{app}, \hat{\theta}[2]_{app}, \ldots, \hat{\theta}[p]_{app}$ output by the LSP linear transformation unit 300 is input to the delay input unit 165 as the quantized LSP parameter sequence $\hat{\theta}[1], \hat{\theta}[2], \ldots, \hat{\theta}[p]$. That is to say, in the time domain encoding unit 170, when the feature amount extracted by the feature amount extracting unit 120 for the preceding frame is smaller than the predetermined threshold (i.e., when temporal variation in the input sound signal was small, that is, when encoding in the frequency domain was performed), the approximate quantized LSP parameter sequence $\hat{\theta}[1]_{app}, \hat{\theta}[2]_{app}, \ldots, \hat{\theta}[p]_{app}$ for the preceding frame is used in place of the quantized LSP parameter sequence $\hat{\theta}[1], \hat{\theta}[2], \ldots, \hat{\theta}[p]$ for the preceding frame.

<Decoding Apparatus>

Figure 13:
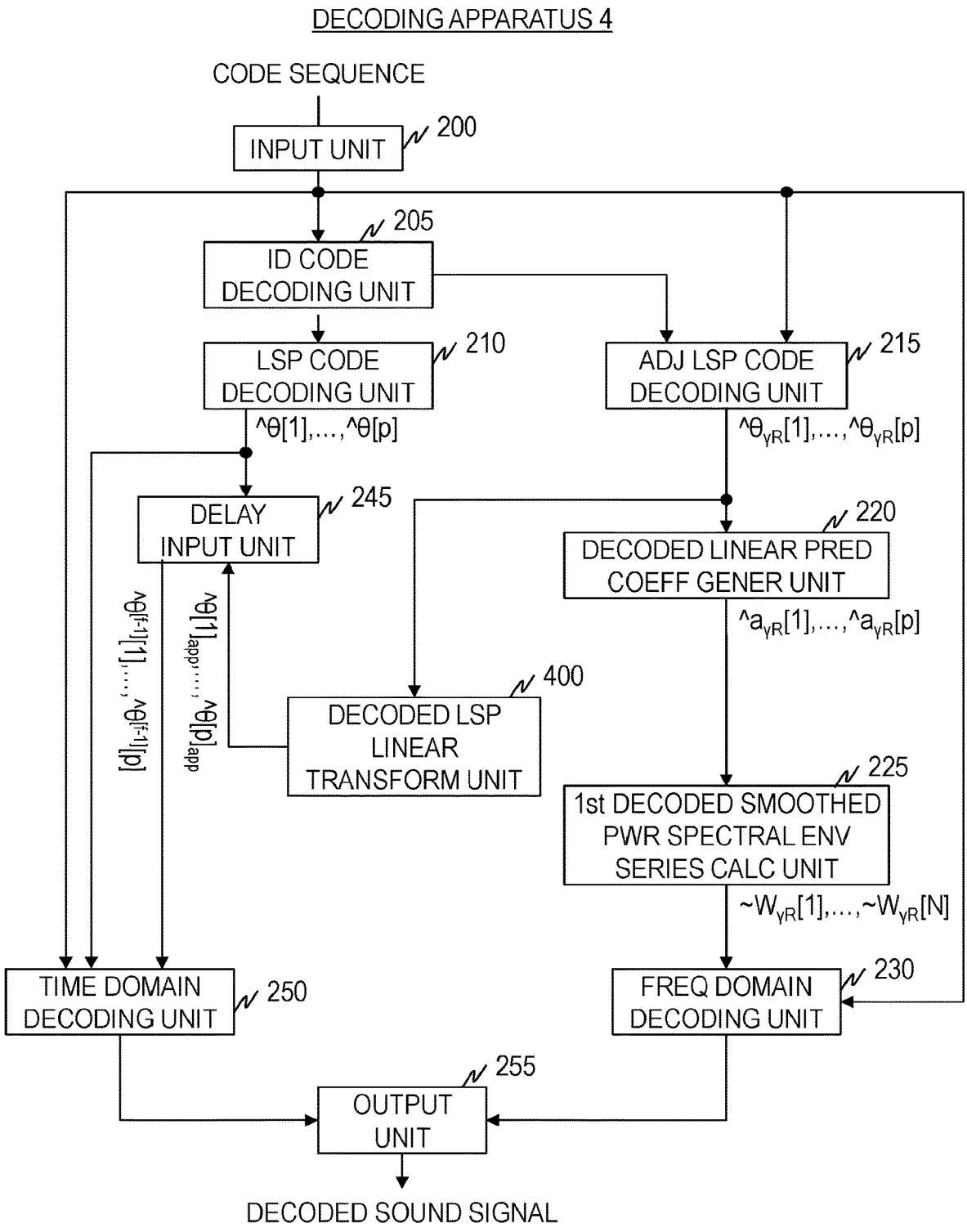
FIG. 13 is a diagram illustrating the functional configuration of the decoding apparatus in the second embodiment.

FIG. 13 shows the functional configuration of the decoding apparatus 4 in the second embodiment.

The decoding apparatus 4 differs from the decoding apparatus 2 in the first embodiment in that it does not include the decoded linear prediction coefficient inverse adjustment unit 235 and the decoded inverse-adjusted LSP generating unit 240 but includes a decoded LSP linear transformation unit 400 instead.

<Decoding Method>

Figure 14:
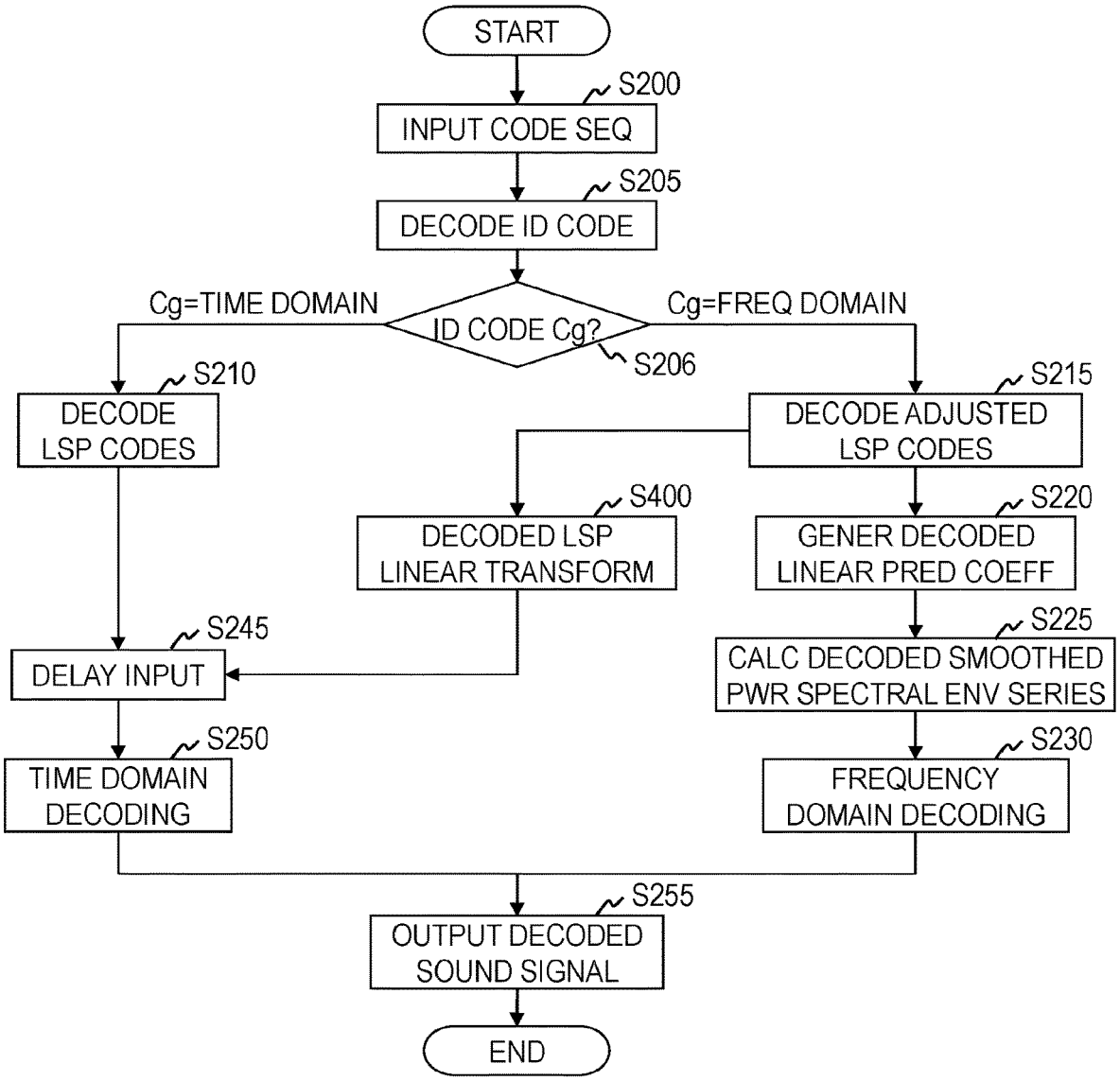
FIG. 14 is a diagram illustrating the process flow of the decoding method in the second embodiment.

Referring to FIG. 14, the decoding method in the second embodiment will be described. The following description mainly focuses on differences from the foregoing embodiment.

Processing in the adjusted LSP code decoding unit 215 is the same as the first embodiment. However, the decoded adjusted LSP parameter sequence $\hat{\theta}_{\gamma R}[1], \hat{\theta}_{\gamma R}[2], \ldots, \hat{\theta}_{\gamma R}[p]$ output by the adjusted LSP code decoding unit 215 is also input to the decoded LSP linear transformation unit 400 in addition to the decoded linear prediction coefficient generating unit 220.

The decoded LSP linear transformation unit 400 determines a decoded approximate LSP parameter sequence $\hat{\theta}[1]_{app}, \hat{\theta}[2]_{app}, \ldots, \hat{\theta}[p]_{app}$ according to Formula (18) with $\hat{\Theta}_{\gamma 1}=(\hat{\theta}_{\gamma R}[1], \hat{\theta}_{\gamma R}[2], \ldots, \hat{\theta}_{\gamma R}[p])^T$, and outputs it. That is, Formula (13b) is used to determine a series of approximations, $\hat{\theta}[1]_{app}, \hat{\theta}[2]_{app}, \ldots, \hat{\theta}[p]_{app}$, of the decoded LSP parameter sequence. As with the LSP linear transformation unit 300, the decoded approximate LSP parameter sequence $\hat{\theta}[1]_{app}, \hat{\theta}[2]_{app}, \ldots, \hat{\theta}[p]_{app}$ may be determined by use of Formula (18a).

The decoded approximate LSP parameter sequence $\hat{\theta}[1]_{app}, \hat{\theta}[2]_{app}, \ldots, \hat{\theta}[p]_{app}$ output by the decoded LSP linear transformation unit 400 is input to the delay input unit 245 as a decoded LSP parameter sequence $\hat{\theta}[1], \hat{\theta}[2], \ldots, \hat{\theta}[p]$. It means that in the time domain decoding unit 250, when the identification code Cg for the preceding frame corresponds to information indicating the frequency domain encoding method, the approximate quantized LSP parameter sequence $\hat{\theta}[1]_{app}, \hat{\theta}[2]_{app}, \ldots, \hat{\theta}[p]_{app}$ for the preceding frame is used in place of the decoded LSP parameter sequence $\hat{}[1], \hat{}[2], \ldots, \hat{\theta}[p]$ for the preceding frame.

<Learning Process for Transformation Matrix K>

The transformation matrix K used in the LSP linear transformation unit 300 and the decoded LSP linear transformation unit 400 is determined in advance through the following process and prestored in storages (not shown) of the encoding apparatus 3 and the decoding apparatus 4.

(Step 1) For prepared sample data for speech sound signals corresponding to M frames, each sample data is subjected to linear prediction analysis to obtain linear prediction coefficients. A linear prediction coefficient sequence produced by linear prediction analysis of the mth (1≤m≤M) sample data is represented as $a^{(m)}[1], a^{(m)}[2], \ldots, a^{(m)}[p]$, and referred to as a linear prediction coefficient sequence $a^{(m)}[1], a^{(m)}[2], \ldots, a^{(m)}[p]$ corresponding to the mth sample data.

(Step 2) For each m, LSP parameters $\theta_{\gamma=1}{}^{(m)}[1], \theta_{\gamma=1}{}^{(m)}[2], \ldots, \theta_{\gamma=1}{}^{(m)}[p]$ are determined from the linear prediction coefficient sequence $a^{(m)}[1], a^{(m)}[2], \ldots, a^{(m)}[p]$. The LSP parameters $\theta_{\gamma=1}{}^{(m)}[1], \theta_{\gamma=1}{}^{(m)}[2], \ldots, \theta_{\gamma=1}{}^{(m)}[p]$ are coded in a similar manner to the LSP encoding unit 115, thereby generating a quantized LSP parameter sequence $\hat{\theta}_{\gamma=1}{}^{(m)}[1], \hat{\theta}_{\gamma=1}{}^{(m)}[2], \ldots, \hat{\theta}_{\gamma=1}{}^{(m)}[p]$. Here, $$\hat{\Theta}^{(m)}{}_{\gamma 1}=(\hat{\theta}_{\gamma=1}{}^{(m)}[1], \ldots, \hat{\theta}_{\gamma=1}{}^{(m)}[p])^T.$$

(Step 3) For each m, setting γL as a predetermined positive constant smaller than 1 (for example, γL=0.92), a adjusted linear prediction coefficient, $$a_{\gamma}{}^{(m)}[i]=a^{(m)}[i]\times(\gamma L)^i$$

is calculated.

(Step 4) For each m, a adjusted LSP parameter sequence $\theta_{\gamma L}{}^{(m)}[1], \ldots, \theta_{\gamma L}{}^{(m)}[p]$ is determined from the adjusted linear prediction coefficient sequence $a_{\gamma L}{}^{(m)}[1], \ldots, a_{\gamma L}{}^{(m)}[p]$. The adjusted LSP parameter sequence $\theta_{\gamma L}{}^{(m)}[1], \ldots,$ $\theta_{\gamma L}^{(m)}[p]$ is coded in a similar manner to the adjusted LSP encoding unit 135, thereby generating a quantized LSP parameter sequence $\hat{\theta}_{\gamma L}^{(m)}[1], \hat{\theta}_{\gamma L}^{(m)}[p]$. Here, $$\hat{\Theta}^{(m)}_{\gamma 2}=(\hat{\theta}_{\gamma L}^{(m)}[1], \ldots, \hat{\theta}_{\gamma L}^{(m)}[p])^T.$$

Through Steps 1 to 4, M pairs of quantized LSP parameter sequences $(\hat{\Theta}^{(m)}_{\gamma 1}, \hat{\Theta}^{(m)}_{\gamma 2})$ are obtained. This set is used as learning data set Q, where $Q=\{(\hat{\Theta}^{(m)}_{\gamma 1}, \hat{\Theta}^{(m)}_{\gamma 2})|m=1, \ldots, M\}$. Note that all of the values of adjustment factor γL used in generation of the learning data set Q are common fixed values.

(Step 5) Each pair of LSP parameter sequences $(\hat{\Theta}^{(m)}_{\gamma 1}, \hat{\Theta}^{(m)}_{\gamma 2})$ contained in the learning data Q is substituted into the model of Formula (13b), where γ1=γL, γ2=1, $\hat{\Theta}_{\gamma 1}=\hat{\Theta}^{(m)}_{\gamma 1}$, and $\hat{\Theta}_{\gamma 2}=\hat{\Theta}^{(m)}_{\gamma 2}$, and the coefficients for matrix K are learned with the square error criterion. That is, a vector in which the components in the band portion of the matrix K are arranged in order from the top is defined as:

$$B=\begin{pmatrix} x_1 \\ y_1 \\ z_2 \\ x_2 \\ y_2 \\ z_3 \\ \vdots \\ x_p \end{pmatrix}$$

and B is obtained by $$B=\frac{1}{(\gamma 2-\gamma 1)}\left(\sum_{m=1}^{M} J_m^T J_m\right)^{-1}\sum_{m=1}^{M} J_m^T(\hat{\Theta}_{\gamma 1}^{(m)}-\hat{\Theta}_{\gamma 2}^{(m)})$$
$$=\frac{1}{(1-\gamma L)}\left(\sum_{m=1}^{M} J_m^T J_m\right)^{-1}\sum_{m=1}^{M} J_m^T(\hat{\Theta}_{\gamma 1}^{(m)}-\hat{\Theta}_{\gamma 2}^{(m)}).$$

Here, $$J_m=\begin{pmatrix} d_1 & d_2 & & & & & & \\ & & d_1 & d_2 & d_3 & & & \\ & & & & \ddots & \ddots & & \\ & & & & & d_{p-2} & d_{p-1} & d_p \\ & & & & & & d_{p-1} & d_p \end{pmatrix},$$

$$d_i=\hat{\theta}_{\gamma 2}^{(m)}[i]-\hat{\theta}_{\gamma L=0}^{(m)}[i]$$
$$=\hat{\theta}_{\gamma 2}^{(m)}[i]-\frac{i\pi}{p+1}$$

Learning of the matrix K is performed with the value of γL fixed. However, the matrix K used in the LSP linear transformation unit 300 does not have to be one that has been learned using the same value as the adjustment factor γR used in the encoding apparatus 3.

By way of example, values obtained by multiplying (γ2−γ1) and the elements in the band portion of the matrix K generated by the above-described method given that p=15 and γL=0.92, namely the values of the elements in the band portion of matrix K', are shown below. That is, the products of the values $x_1, x_2, \ldots, x_{15}, y_1, y_2, \ldots, y_{14}, z_2, z_3, \ldots, z_{15}$ in Formula (14) and γ2−γ1 are $xx_1, xx_2, \ldots, xx_{15}, yy_1, yy_2, \ldots, yy_{14}, zz_2, zz_3, \ldots, zz_{15}$ below:

xx1=1.11499, yy1=−0.54272,
zz2=−0.83414f, xx2=1.59810f, yy2=−0.70966,
zz3=−0.49432, xx3=1.38370, yy3=−0.78076,
zz4=−0.39319, xx4=1.23032, yy4=−0.67921,
zz5=−0.39166, xx5=1.18521, yy5=−0.69088,
zz6=−0.34784, xx6=1.04839, yy6=−0.60619,
zz7=−0.41279, xx7=1.13305, yy7 =−0.63247,
zz8=−0.36450, xx8=0.95694, yy8=−0.53039,
zz9=−0.43984, xx9=1.01910, yy9=−0.51707,
zz10=−0.40120, xx10=0.90395, yy10=−0.44594,
zz11=−0.49262, xx11=1.07345, yy11=−0.51892,
zz12=−0.41695, xx12=0.96596, yy12=−0.49247,
zz13=−0.45002, xx13=1.00336, yy13=−0.48790,
zz14=−0.46854, xx14=0.93258, yy14=−0.41927,
zz15=−0.45020, xx15=0.88783.

When γ2>γ1 as in the above example, in which γ1=γL=0.92 and γ2=1, the diagonal components of matrix K' assume values close to 1 as in the above example, while components neighboring the diagonal component assume negative values.

Conversely, when γ1>γ2, the diagonal components of matrix K' assume negative values as in the example shown below, while components neighboring the diagonal component assume positive values. Values obtained by multiplying (γ2−γ1) and the elements in the band portion of the matrix K with p=15, γ1=1, and γ2=γL=0.92, namely the values of the elements in the band portion of matrix K' can be as below, for example:

xx1=−0.557012055, yy1=0.213853042,
zz2=0.110112745, xx2 =−0.534830085, yy2=0.2440903,
zz3=0.149879603, xx3=−0.522734808, yy3=0.23494022,
zz4=0.144479327, xx4=−0.533013231, yy4=0.259021145,
zz5=0.136523255, xx5=−0.502606738, yy5=0.248139539,
zz6=0.138005088, xx6=−0.478327709, yy6=0.244219107,
zz7=0.133771751, xx7=−0.467186849, yy7=0.243988642,
zz8=0.13667916, xx8=−0.408737408, yy8=0.192803054,
zz9=0.160602461, xx9=−0.427436157, yy9=0.190554547,
zz10=0.147621742, xx10=−0.383087812, yy10=0.165954888,
zz11=0.18358465, xx11=−0.434034351, yy11=0.183004742,
zz12=0.166249458, xx12=−0.409482196, yy12=0.170107295,
zz13=0.162343147, xx13=−0.409804718, yy13=0.165221097,
zz14=0.178158258, xx14−−0.400869431, yy14=0.123020055,
zz15=0.171958144, xx15=−0.447472325.

When γ1>y2, this corresponds to a case where $\hat{\Theta}^{(m)}_{\gamma 1}$ is set as $$\hat{\Theta}^{(m)}_{\gamma 1}=(\hat{\theta}_{\gamma L}^{(m)}[1], \ldots, \hat{\theta}_{\gamma L}^{(m)}[p])^T$$

in Step 2 of <Learning Process for Transformation Matrix K>, $\hat{\Theta}^{(m)}_{\gamma 2}$ is set as $$\hat{\Theta}^{(m)}_{\gamma 2}=(\hat{\theta}_{\gamma=1}^{(m)}[1], \ldots, \hat{\theta}_{\gamma=1}^{(m)}[p])^T$$

in Step 4, and each pair of LSP parameter sequences $(\hat{\Theta}^{(m)}_{\gamma 1}, \hat{\Theta}^{(m)}_{\gamma 2})$ contained in learning data Q is substituted into the model of Formula (13b) with γ1=1, γ2=γL, $\hat{\Theta}_{\gamma 1}=\hat{\Theta}^{(m)}_{\gamma 1}$, and $\hat{\Theta}_{\gamma 2}=\hat{\Theta}^{(m)}_{\gamma 2}$ in Step 5 and the coefficients for matrix K are learned with the square error criterion.

<Effects of the Second Embodiment>

The encoding apparatus 3 according to the second embodiment provides similar effects to the encoding apparatus 1 in the first embodiment because, as with the first embodiment, it has a configuration in which the quantized linear prediction coefficient generating unit 900, the quantized linear prediction coefficient adjusting unit 905, and the approximate smoothed power spectral envelope series calculating unit 910 of the conventional encoding apparatus 9 are replaced with the linear prediction coefficient adjusting unit 125, adjusted LSP generating unit 130, adjusted LSP encoding unit 135, quantized linear prediction coefficient generating unit 140, and the first quantized smoothed power spectral envelope series calculating unit 145. That is, when the encoding distortion is equal to that in a conventional method, the code amount can be reduced compared to the conventional method, whereas when the code amount is the same as in the conventional method, encoding distortion can be reduced compared to the conventional method.

In addition, the calculation cost of the encoding apparatus 3 in the second embodiment is low because K is a band matrix in calculation of Formula (18). By replacing the quantized linear prediction coefficient inverse adjustment unit 155 and the inverse-adjusted LSP generating unit 160 in the first embodiment with the LSP linear transformation unit 300, a series of approximations of the quantized LSP parameter sequence $\hat{\theta}[1], \hat{\theta}[2], \ldots, \hat{\theta}[p]$ can be generated with a smaller amount of calculation than the first embodiment.

Modification of Second Embodiment

The encoding apparatus 3 in the second embodiment decides whether to code in the time domain or in the frequency domain based on the magnitude of temporal variation in the input sound signal for each frame. However, even for a frame in which the temporal variation in the input sound signal was large and frequency domain encoding was selected, it is possible that actually a sound signal reproduced by encoding in the time domain leads to smaller distortion relative to the input sound signal than a signal reproduced by encoding in the frequency domain. Likewise, even for a frame in which the temporal variation in the input sound signal was small and encoding in the time domain was selected, it is possible that actually a sound signal reproduced by encoding in the frequency domain leads to smaller distortion relative to the input sound signal than a sound signal reproduced by encoding in the time domain. That is to say, the encoding apparatus 3 in the second embodiment cannot always select one of the time domain and frequency domain encoding methods that provides smaller distortion relative to the input sound signal. To address this, a encoding apparatus 8 in a modification of the second embodiment performs both time domain and frequency domain encoding on each frame and selects either of them that yields smaller distortion relative to the input sound signal.

<Encoding Apparatus>

Figure 15:
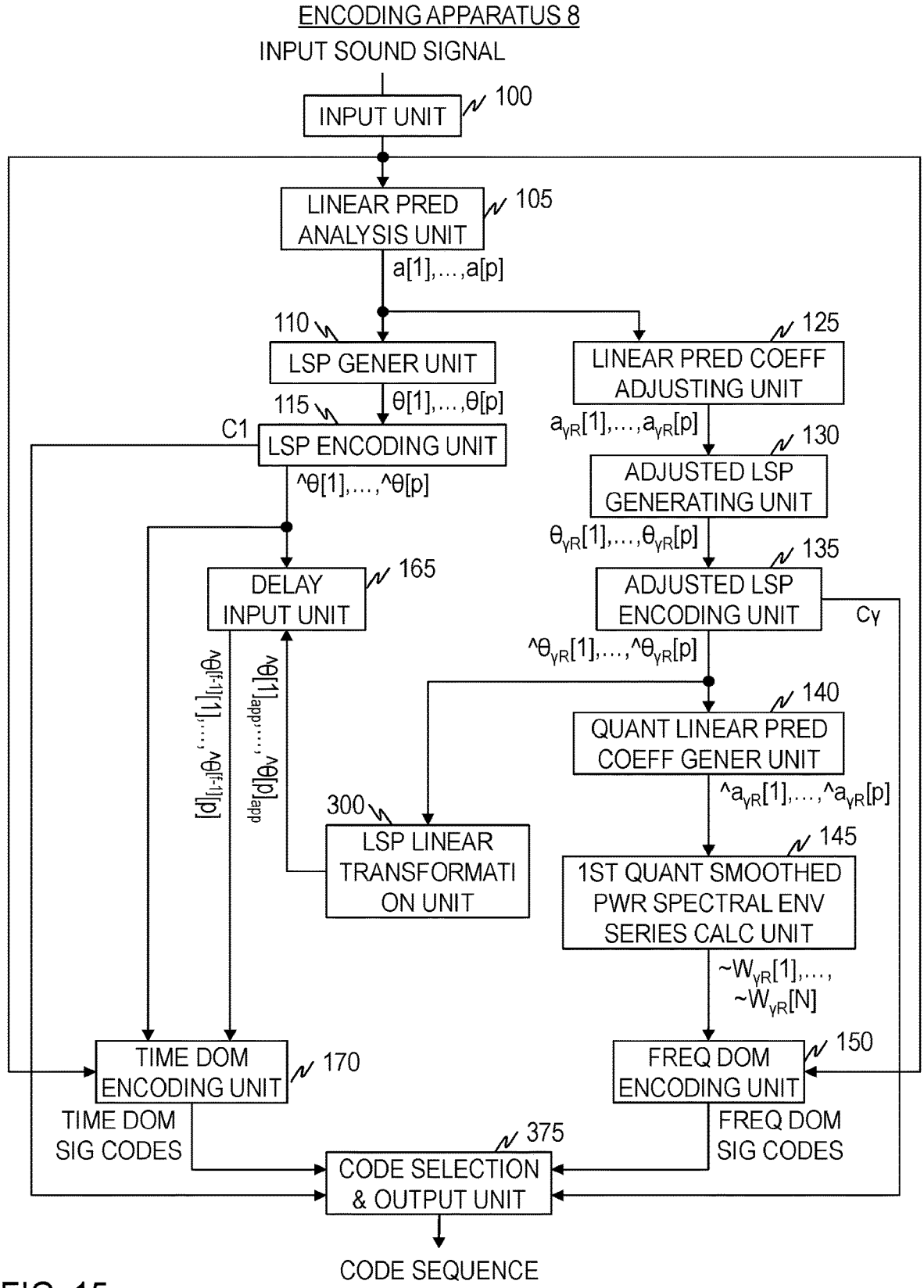
FIG. 15 is a diagram illustrating the functional configuration of a encoding apparatus in a modification of the second embodiment.

FIG. 15 shows the functional configuration of the encoding apparatus 8 in a modification of the second embodiment.

The encoding apparatus 8 differs from the encoding apparatus 3 in the second embodiment in that it does not include the feature amount extracting unit 120 and includes a code selection and output unit 375 in place of the output unit 175.

<Encoding Method>

Figure 16:
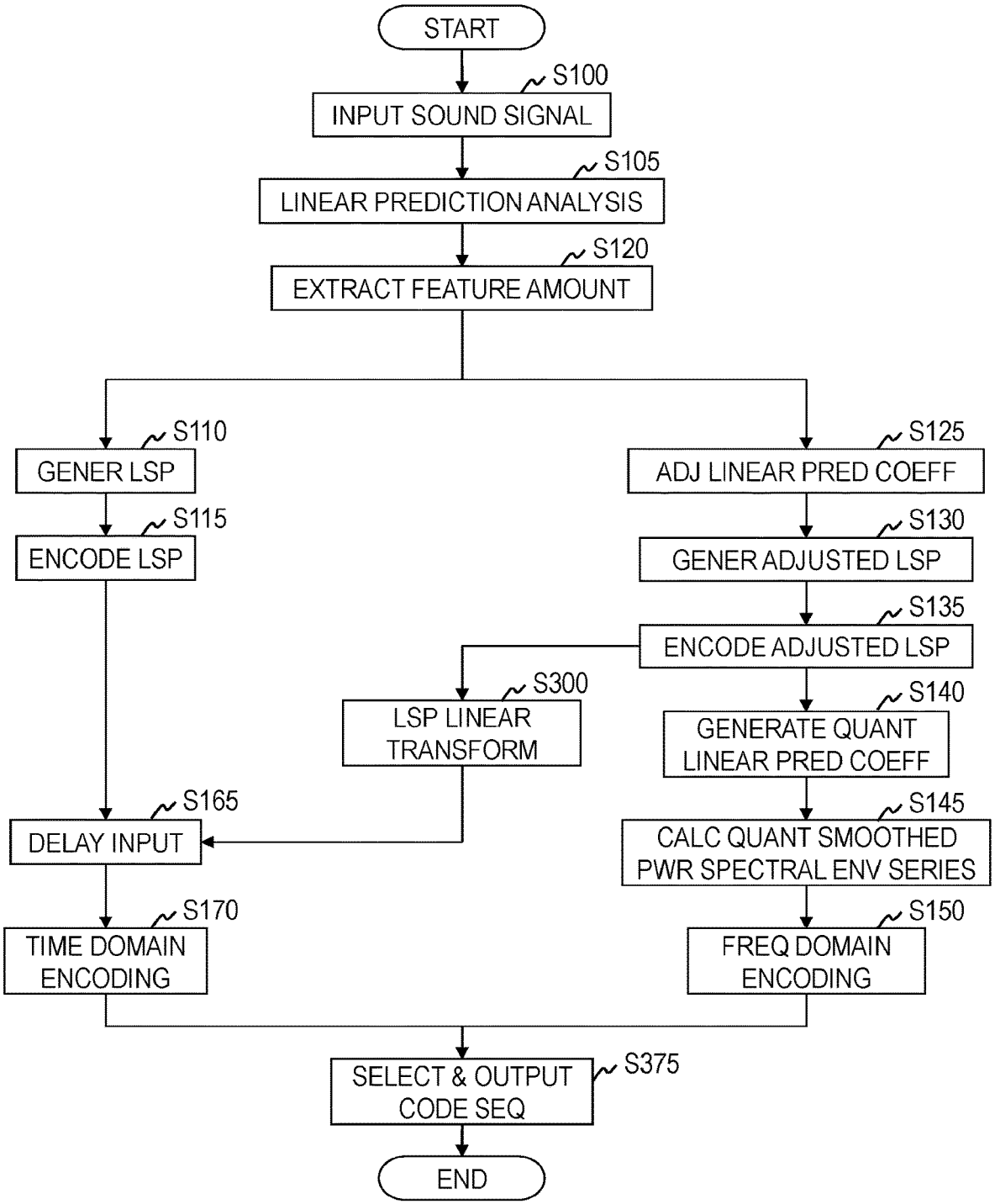
FIG. 16 is a diagram illustrating the process flow of the encoding method in the modification of the second embodiment.

Referring to FIG. 16, the encoding method in the modification of the second embodiment will be described. The following description mainly focuses on differences from the second embodiment.

In the encoding method according to the modification of the second embodiment, the LSP generating unit 110, LSP encoding unit 115, linear prediction coefficient adjusting unit 125, adjusted LSP generating unit 130, adjusted LSP encoding unit 135, quantized linear prediction coefficient generating unit 140, first quantized smoothed power spectral envelope series calculating unit 145, delay input unit 165, and LSP linear transformation unit 300 are also executed in addition to the input unit 100 and the linear prediction analysis unit 105 for all frames regardless of whether the temporal variation in the input sound signal is large or small. The operations of these components are the same as the second embodiment. However, the approximate quantized LSP parameter sequence $\hat{\theta}[1]_{app}, \hat{\theta}[2]_{app}, \ldots, \hat{\theta}[p]_{app}$ generated by the LSP linear transformation unit 300 is input to the delay input unit 165.

The delay input unit 165 holds the quantized LSP parameter sequence $\hat{\theta}[1], \hat{\theta}[2], \ldots, \hat{\theta}[p]$ input from the LSP encoding unit 115 and the approximate quantized LSP parameter sequence $\hat{\theta}[1]_{app}, \hat{\theta}[2]_{app}, \ldots, \hat{\theta}[p]_{app}$ input from the LSP linear transformation unit 300 at least for the duration of one frame. When the frequency domain encoding method was selected by the code selection and output unit 375 for the preceding frame (i.e., when the identification code Cg output by the code selection and output unit 375 for the preceding frame is information indicating the frequency domain encoding method), the delay input unit 165 outputs the approximate quantized LSP parameter sequence $\hat{\theta}[1]_{app}, \hat{\theta}[2]_{app}, \ldots, \hat{\theta}[p]_{app}$ for the preceding frame input from the LSP linear transformation unit 300 to the time domain encoding unit 170 as the quantized LSP parameter sequence $\hat{\theta}[1], \hat{\theta}[2], \ldots, \hat{\theta}[p]$ for the preceding frame. When the time domain encoding method was selected by the code selection and output unit 375 for the preceding frame (i.e., when the identification code Cg output by the code selection and output unit 375 for the preceding frame is information indicating the time domain encoding method), the delay input unit 165 outputs the quantized LSP parameter sequence $\hat{\theta}[1], \hat{\theta}[2], \ldots, \hat{\theta}[p]$ for the preceding frame input from the LSP encoding unit 115 to the time domain encoding unit 170 (step S165).

As with the frequency domain encoding unit 150 in the second embodiment, the frequency domain encoding unit 150 generates and outputs frequency domain signal codes, and also determines and outputs the distortion or an estimated value of the distortion of the sound signal corresponding to the frequency domain signal codes relative to the input sound signal. The distortion or an estimation thereof may be determined either in the time domain or in the frequency domain. This means that the frequency domain encoding unit 150 may determine the distortion or an estimated value of the distortion of a frequency-domain sound signal series corresponding to frequency domain signal codes relative to the frequency-domain sound signal series that is obtained by converting the input sound to signal into the frequency domain.

The time domain encoding unit 170, as with the time domain encoding unit 170 in the second embodiment, generates and outputs time domain signal codes, and also determines the distortion or an estimated value of the distortion of the sound signal corresponding to the time domain signal codes relative to the input sound signal.

Input to the code selection and output unit 375 are the frequency domain signal codes generated by the frequency domain encoding unit 150, the distortion or an estimated value of distortion determined by the frequency domain encoding unit 150, the time domain signal codes generated by the time domain encoding unit 170, and the distortion or an estimated value of distortion determined by the time domain encoding unit 170.

When the distortion or estimated value of distortion input from the frequency domain encoding unit 150 is smaller than the distortion or an estimated value of distortion input from the time domain encoding unit 170, the code selection and output unit 375 outputs the frequency domain signal codes and identification code Cg which is information indicating the frequency domain encoding method. When the distortion or estimated value of distortion input from the frequency domain encoding unit 150 is greater than the distortion or an estimated value of distortion input from the time domain encoding unit 170, the code selection and output unit 375 outputs the time domain signal codes and identification code Cg which is information indicating the time domain encoding method. When the distortion or an estimated value of distortion input from the frequency domain encoding unit 150 is equal to the distortion or an estimated value of distortion input from the time domain encoding unit 170, the code selection and output unit 375 outputs either the time domain signal codes or the frequency domain signal codes according to predetermined rules, as well as identification code Cg which is information indicating the encoding method corresponding to the codes being output. That is to say, of the frequency domain signal codes input from the frequency domain encoding unit 150 and the time domain signal codes input from the time domain encoding unit 170, the code selection and output unit 375 outputs either one that leads to a smaller distortion of the sound signal reproduced from the codes relative to the input sound signal, and also outputs information indicative of the encoding method that yields smaller distortion as identification code Cg (step S375).

The code selection and output unit 375 may also be configured to select either one of the sound signals reproduced from the respective codes that has smaller distortion relative to the input sound signal. In such a configuration, the frequency domain encoding unit 150 and the time domain encoding unit 170 reproduce sound signals from the codes and output them instead of distortion or an estimated value of distortion. The code selection and output unit 375 outputs either the sound signal reproduced by the frequency domain encoding unit 150 or the sound signal reproduced by the time domain encoding unit 170 respectively from frequency domain signal codes and time domain signal codes that has smaller distortion relative to the input sound signal, and also outputs information indicating the encoding method that yields smaller distortion as identification code Cg.

Alternatively, the code selection and output unit 375 may be configured to select either one that has a smaller code amount. In such a configuration, the frequency domain encoding unit 150 outputs frequency domain signal codes as in the second embodiment. The time domain encoding unit 170 outputs time domain signal codes as in the second embodiment. The code selection and output unit 375 outputs either the frequency domain signal codes or the time domain signal codes that have a smaller code amount, and also outputs information indicating the encoding method that yields a smaller code amount as identification code Cg.

<Decoding Apparatus>

A code sequence output by the encoding apparatus 8 in the modification of the second embodiment can be decoded by the decoding apparatus 4 of the second embodiment as with a code sequence output by the encoding apparatus 3 of the second embodiment.

<Effects of Modification of the Second Embodiment>

The encoding apparatus 8 in the modification of the second embodiment provides similar effects to the encoding apparatus 3 of the second embodiment and further has the effect of reducing the code amount to be output compared to the encoding apparatus 3 of the second embodiment.

Third Embodiment

The encoding apparatus 1 of the first embodiment and the encoding apparatus 3 of the second embodiment once convert the adjusted quantized LSP parameter sequence $\hat{\theta}_{\gamma R}[1]$, $\hat{\theta}_{\gamma R}[2]$, . . . . $\hat{\theta}_{\gamma R}[p]$ into linear prediction coefficients and then calculate the quantized smoothed power spectral envelope series $\hat{W}_{\gamma R}[1]$, $\hat{W}_{\gamma R}[2]$, . . . , $\hat{W}_{\gamma R}[N]$. A encoding apparatus 5 in the third embodiment directly calculates the quantized smoothed power spectral envelope series $\hat{W}_{\gamma R}[1]$, $\hat{W}_{\gamma R}[2]$, . . . , $\hat{W}_{\gamma R}[N]$ from the adjusted quantized LSP parameter sequence $\hat{\theta}_{\gamma R}[1]$, $\hat{\theta}_{\gamma R}[2]$, . . . . $\hat{\theta}_{\gamma R}[p]$ without converting the adjusted quantized LSP parameter sequence to linear prediction coefficients. Similarly, a decoding apparatus 6 in the third embodiment directly calculates the decoded smoothed power spectral envelope series $\hat{W}_{\gamma R}[1]$, $\hat{W}_{\gamma R}[2]$, . . . , $\hat{W}_{\gamma R}[N]$ from the decoded adjusted LSP parameter sequence $\hat{\theta}_{\gamma R}[1]$, $\hat{\theta}_{\gamma R}[2]$, . . . . $\hat{\theta}_{\gamma R}[p]$ without converting the decoded adjusted LSP parameter sequence to linear prediction coefficients.

<Encoding Apparatus>

Figure 17:
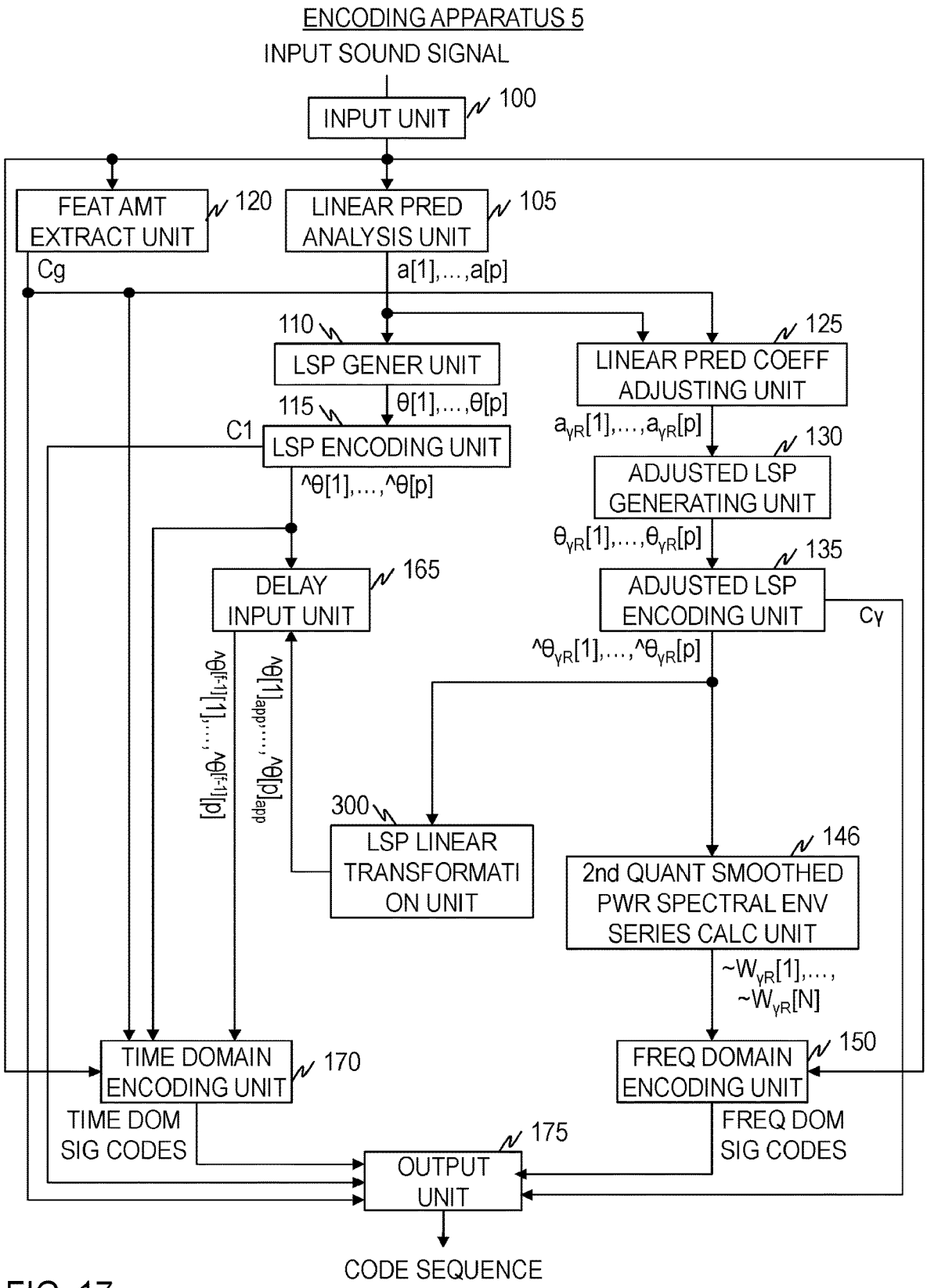
FIG. 17 is a diagram illustrating the functional configuration of the encoding apparatus in a third embodiment.

FIG. 17 shows the functional configuration of the encoding apparatus 5 according to the third embodiment.

The encoding apparatus 5 differs from the encoding apparatus 3 in the second embodiment in that it does not include the quantized linear prediction coefficient generating unit 140 and the first quantized smoothed power spectral envelope series calculating unit 145 but includes a second quantized smoothed power spectral envelope series calculating unit 146 instead.

<Encoding Method>

Figure 18:
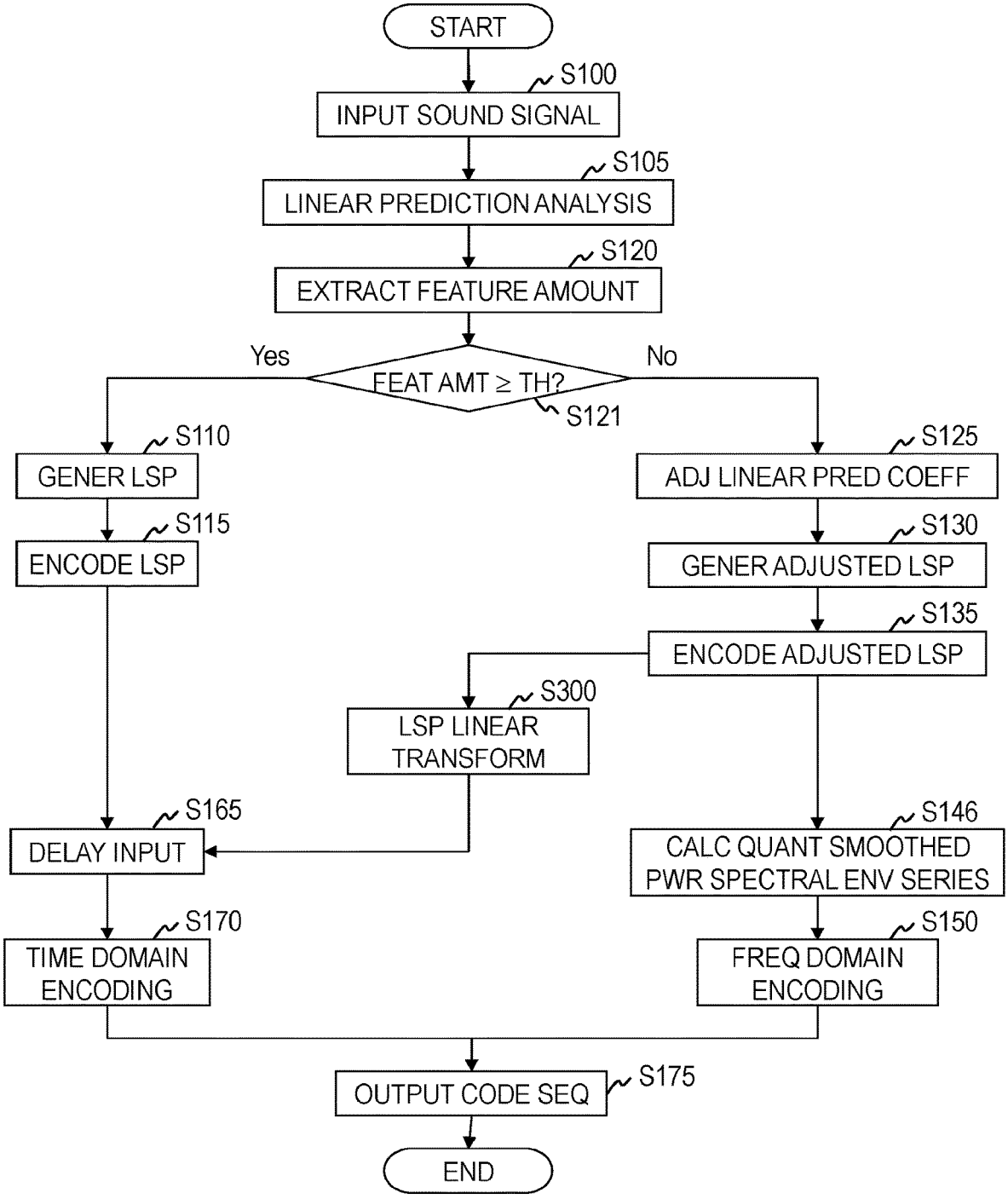
FIG. 18 is a diagram illustrating the process flow of the encoding method in the third embodiment.

Referring to FIG. 18, the encoding method in the third embodiment will be described. The following description mainly focuses on differences from the foregoing embodiments.

At step S146, the second quantized smoothed power spectral envelope series calculating unit 146 uses the adjusted quantized LSP parameters $\hat{\theta}_{\gamma R}[1]$, $\hat{\theta}_{\gamma R}[2]$, . . . . $\hat{\theta}_{\gamma R}[p]$ output by the adjusted LSP encoding unit 135 to determine a quantized smoothed power spectral envelope series $\hat{W}_{\gamma R}[1]$, $\hat{W}_{\gamma R}[2]$, . . . , $\hat{W}_{\gamma R}[N]$ according to Formula (19) and outputs it.

$$\hat{W}_{\gamma R}[k] = \sqrt{\frac{\delta^2}{2\pi}\frac{1}{|A(\exp(j\omega_k))|^2}}, \tag{19}$$

$$|A(\exp(j\omega_k))|^2 = \begin{cases} 2^{p-1}\left[(1-\cos\omega_k)\prod_{n=1}^{p/2}\left(\cos\hat{\theta}_{\gamma R}[2n]-\cos\omega_k\right)^2 + (1+\cos\omega_k)\prod_{n=1}^{p/2}\left(\cos\hat{\theta}_{\gamma R}[2n-1]-\cos\omega_k\right)^2\right] & (p\text{: odd}) \\ 2^{p-1}\left[(1-\cos\omega_k)(1+\cos\omega_k)\prod_{n=1}^{(p-1)/2}\left(\cos\hat{\theta}_{\gamma R}[2n]-\cos\omega_k\right)^2 + \prod_{n=1}^{(p+1)/2}\left(\cos\hat{\theta}_{\gamma R}[2n-1]-\cos\omega_k\right)^2\right] & (p\text{: even}) \end{cases}$$

$$\omega_k = -\frac{2\pi k}{N}$$

<Decoding Apparatus>

Figure 19:
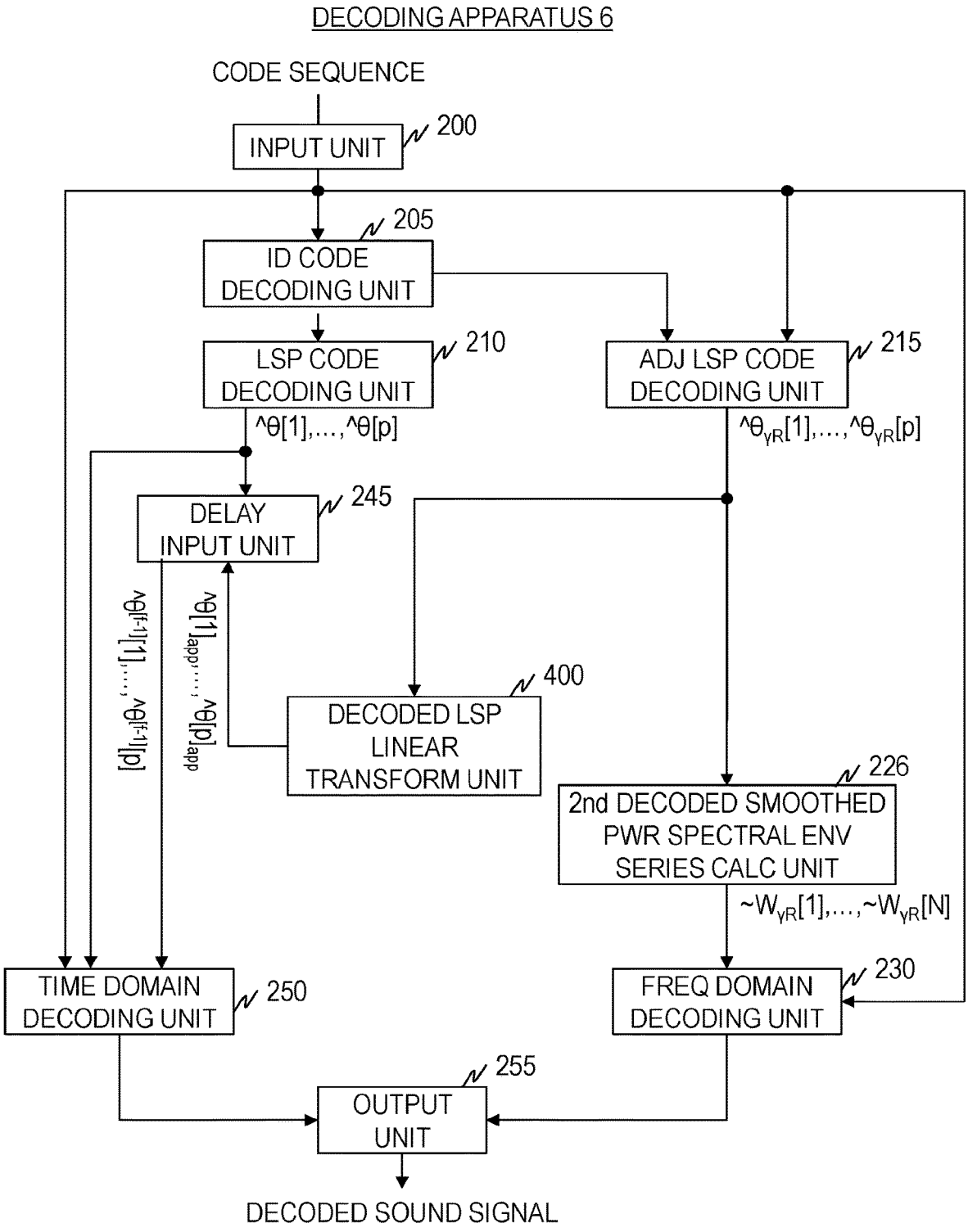
FIG. 19 is a diagram illustrating the functional configuration of the decoding apparatus in the third embodiment.

FIG. 19 shows the functional configuration of the decoding apparatus 6 in the third embodiment.

The decoding apparatus 6 differs from the decoding apparatus 4 in the second embodiment in that it does not include the decoded linear prediction coefficient generating unit 220 and the first decoded smoothed power spectral envelope series calculating unit 225 but includes a second decoded smoothed power spectral envelope series calculating unit 226 instead.

<Decoding Method>

Figure 20:
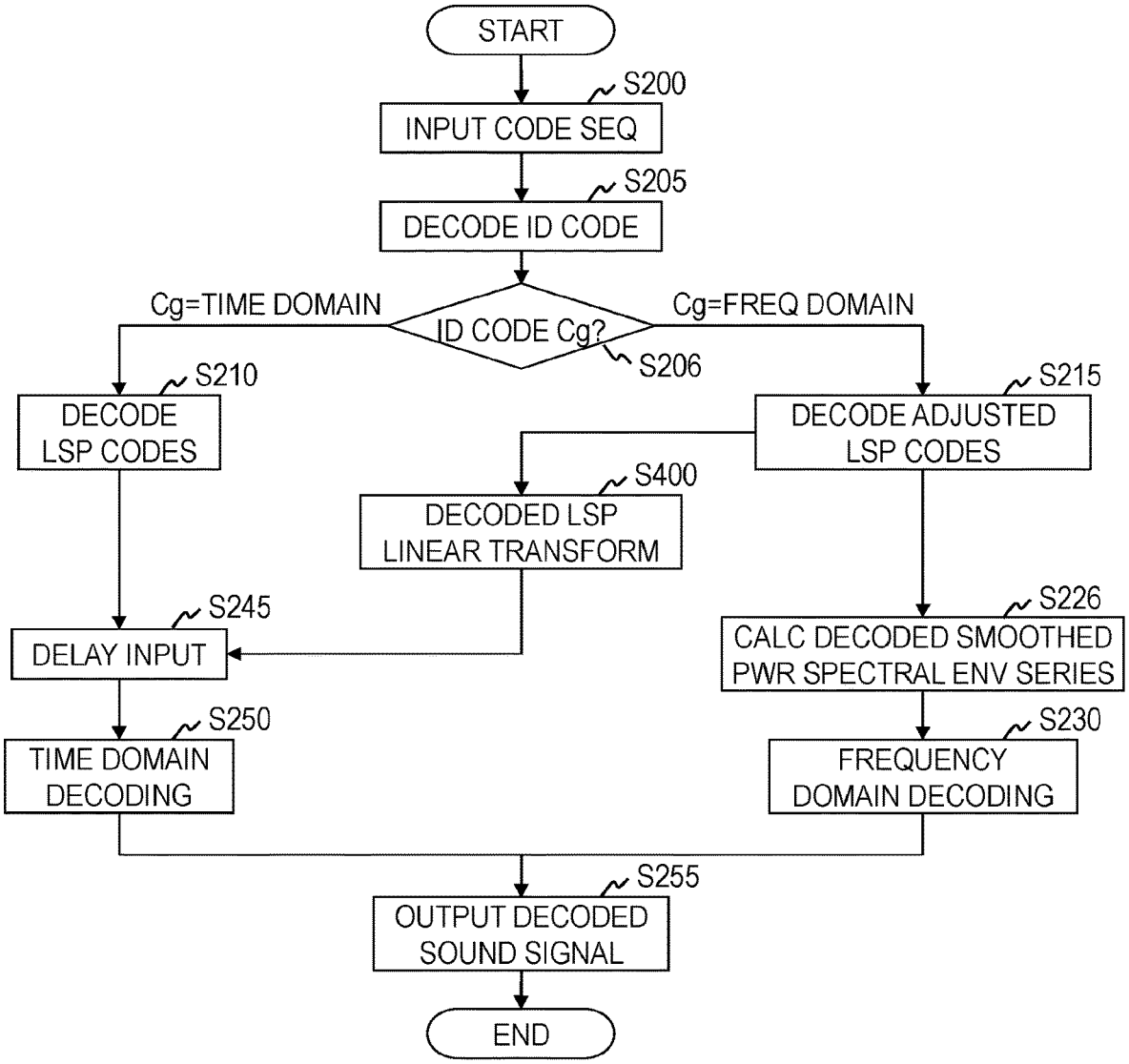
FIG. 20 is a diagram illustrating the process flow of the decoding method in the third embodiment.

Referring to FIG. 20, the decoding method in the third embodiment will be described. The following description mainly focuses on differences from the foregoing embodiments.

At step S226, as with the second quantized smoothed power spectral envelope series calculating unit 146, the second decoded smoothed power spectral envelope series calculating unit 226 uses the decoded adjusted LSP parameter sequence $\hat{\theta}_{\gamma R}[1], \hat{\theta}_{\gamma R}[2], \ldots \hat{\theta}_{\gamma R}[p]$ to determine a decoded smoothed power spectral envelope series $\hat{W}_{\gamma R}[1], \hat{W}_{\gamma R}[2], \ldots, \hat{W}_{\gamma R}[N]$ according to the Formula (19) above and outputs it.

Fourth Embodiment

The quantized LSP parameter sequence $\hat{\theta}[1], \hat{\theta}[2], \ldots, \hat{\theta}[p]$ is a series that satisfies $$0<\hat{\theta}[1]<\ldots<\hat{\theta}[p]<\pi.$$

That is, it is a series in which parameters are arranged in ascending order. Meanwhile, the approximate quantized LSP parameter sequence $\hat{\theta}[1]_{app}, \hat{\theta}[2]_{app}, \ldots, \hat{\theta}[p]_{app}$ generated by the LSP linear transformation unit 300 is produced through approximate transformation, so it could not be in ascending order. To address this, the fourth embodiment adds processing for rearranging the approximate quantized LSP parameter sequence $\hat{\theta}[1]_{app}, \hat{\theta}[2]_{app}, \ldots, \hat{\theta}[p]_{app}$ output by the LSP linear transformation unit 300 into ascending order.

<Encoding Apparatus>

Figure 21:
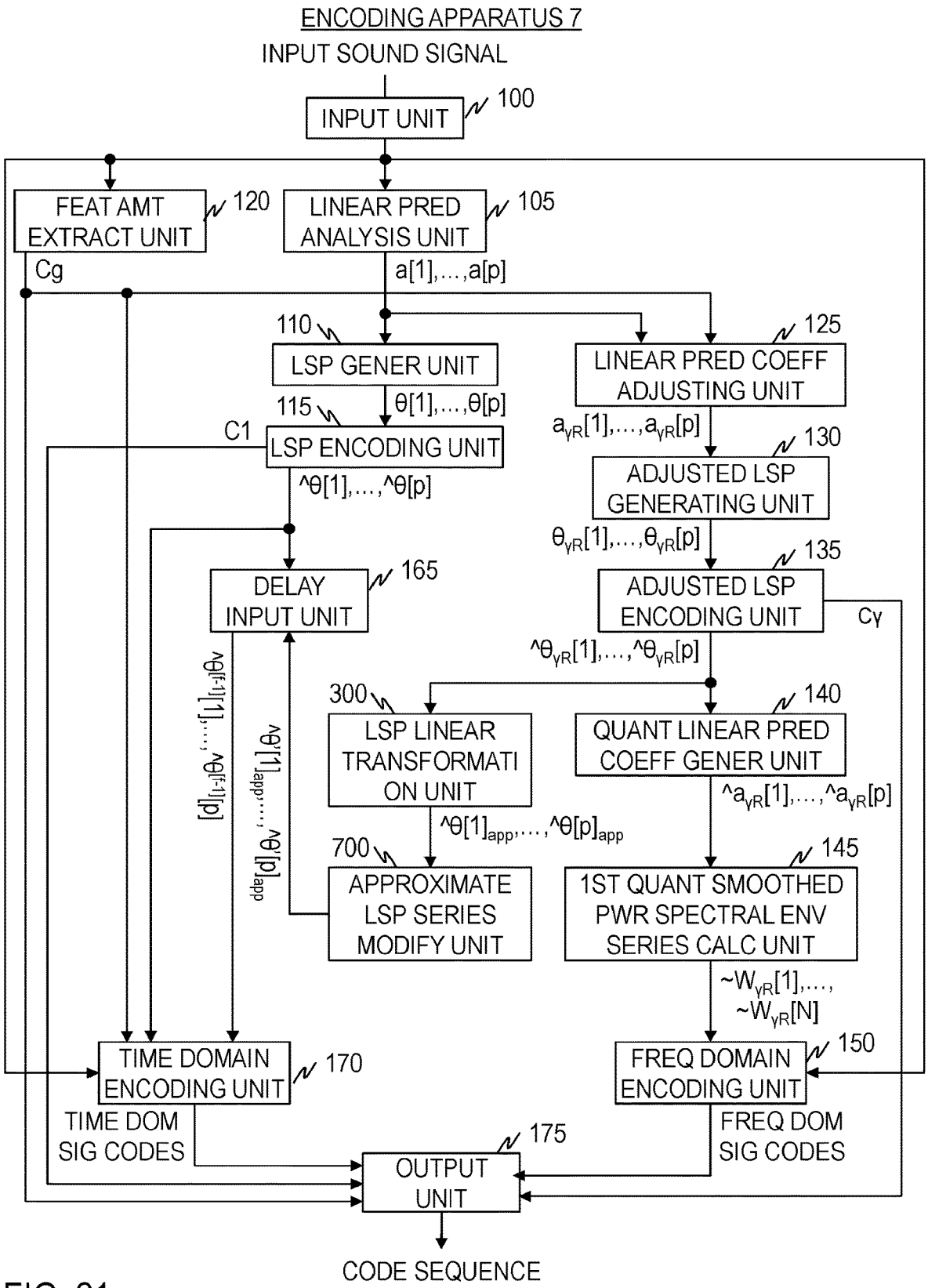
FIG. 21 is a diagram illustrating the functional configuration of the encoding apparatus in a fourth embodiment.

FIG. 21 shows the functional configuration of a encoding apparatus 7 in the fourth embodiment.

The encoding apparatus 7 differs from the encoding apparatus 5 in the second embodiment in that it further includes an approximate LSP series modifying unit 700.

<Encoding Method>

Figure 22:
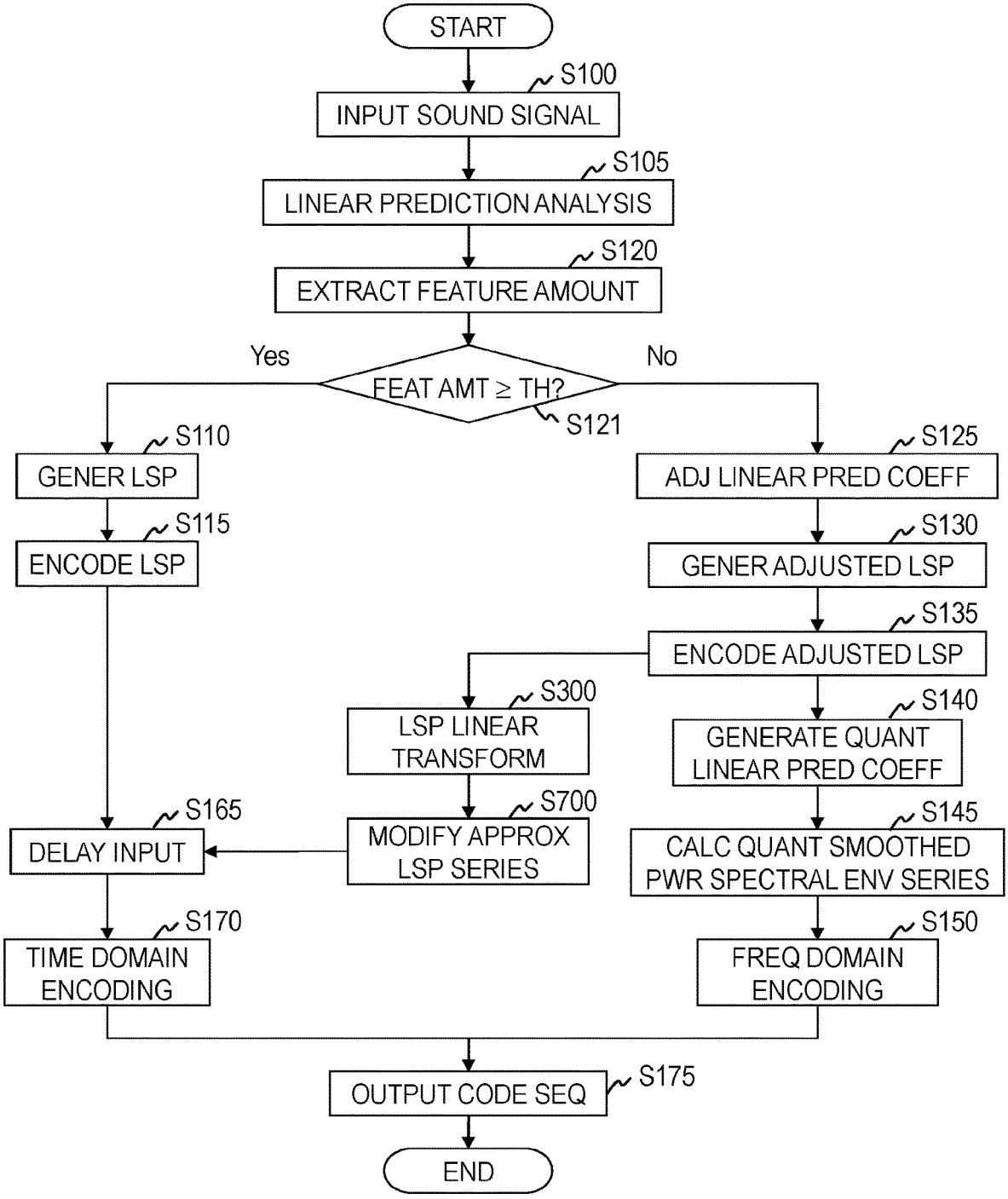
FIG. 22 is a diagram illustrating the process flow of the encoding method in the fourth embodiment.

Referring to FIG. 22, the encoding method in the fourth embodiment will be described. The following description mainly focuses on differences from the foregoing embodiments.

The approximate LSP series modifying unit 700 outputs a series in which the values $\hat{\theta}[i]_{app}$ in the approximate quantized LSP parameter sequence $\hat{\theta}[1]_{app}, \hat{\theta}[2]_{app}, \ldots, \hat{\theta}[p]_{app}$ output by the LSP linear transformation unit 300 have been rearranged in ascending order as a modified approximate quantized LSP parameter sequence $\hat{\theta}'[1]_{app}, \hat{\theta}'[2]_{app}, \ldots, \hat{\theta}'[p]_{app}$. The modified first approximate quantized LSP parameter sequence $\hat{\theta}'[1]_{app}, \hat{\theta}'[2]_{app}, \ldots, \hat{\theta}'[p]_{app}$ output by the approximate LSP series modifying unit 700 is input to the delay input unit 165 as the quantized LSP parameter sequence $\hat{\theta}[1], \hat{}[2], \ldots, \hat{\theta}[p]$.

In addition to merely rearranging the values in the approximate quantized LSP parameter sequence, each value $\hat{\theta}[i]_{app}$ may be adjusted as $\hat{\theta}'[i]_{app}$ such that $|\hat{\theta}[i+1]_{app}-\hat{\theta}[i]_{app}|$ is equal to or greater than a predetermined threshold for each value of i=1, . . . , p−1.

Modification

While the foregoing embodiments were described assuming use of LSP parameters, an ISP parameter sequence may be employed instead of an LSP parameter sequence. An ISP parameter sequence ISP[1], . . . , ISP[p] is equivalent to a series consisting of an LSP parameter sequence of the p−1th order and PARCOR coefficient $k_p$ of the pth order (the highest order). That is to say, $$\mathrm{ISP}[i]=\theta[i] \text{ for } i=1, \ldots, p-1, \text{ and}$$

$$\mathrm{ISP}[p]=k_p.$$

Specific processing will be illustrated for a case where input to the LSP linear transformation unit 300 is an ISP parameter sequence in the second embodiment.

Assume that input to the LSP linear transformation unit 300 is a adjusted quantized ISP parameter sequence $\hat{\mathrm{ISP}}_{\gamma R}[1], \hat{\mathrm{ISP}}_{\gamma R}[2], \ldots, \hat{\mathrm{ISP}}_{\gamma R}[p]$. Here, $$\hat{\mathrm{ISP}}_{\gamma R}[1]=\hat{\theta}_{\gamma R}[i], \text{ and}$$

$$\hat{\mathrm{ISP}}_{\gamma R}[p]=\hat{k}_p.$$

The value $\hat{k}_p$ is the quantized value of $k_p$.

The LSP linear transformation unit 300 determines an approximate quantized ISP parameter sequence $\hat{\mathrm{ISP}}[1]_{app}, \ldots, \hat{\mathrm{ISP}}[p]_{app}$ through the following process and outputs it.

(Step 1) Given $\hat{\Theta}_{\gamma 1}=(\hat{\mathrm{ISP}}_{\gamma R}[1], \ldots, \hat{\mathrm{ISP}}_{\gamma R}[p-1])^T$, p is replaced with p−1, and $\hat{\theta}[1]_{app}, \ldots, \hat{\theta}[p-1]_{app}$ are determined by calculating Formula (18). Here, $$\hat{\mathrm{ISP}}[i]_{app}=\hat{\theta}[i]_{app} \ (i=1, \ldots, p-1).$$

(Step 2) $\hat{\mathrm{ISP}}[p]_{app}$ defined by the formula below is determined.

$$\hat{\mathrm{ISP}}[p]_{app}=\hat{\mathrm{ISP}}_{\gamma R}[p]\cdot(1/\gamma R)^p.$$

Fifth Embodiment

The LSP linear transformation unit 300 included in the encoding apparatuses 3, 5, 7, 8 and the decoded LSP linear transformation unit 400 included in the decoding apparatuses 4, 6 may also be implemented as a separate frequency domain parameter sequence generating apparatus.

The following description illustrates a case where the LSP linear transformation unit 300 included in the encoding apparatuses 3, 5, 7, 8 and the decoded LSP linear transformation unit 400 included in the decoding apparatuses 4, 6 are implemented as a separate frequency domain parameter sequence generating apparatus.

<Frequency Domain Parameter Sequence Generating Apparatus>

Figure 23:
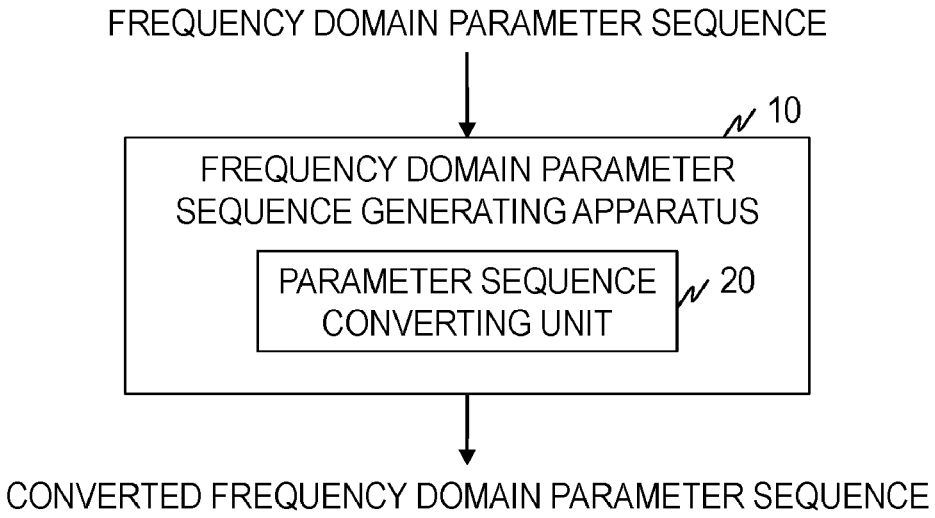
FIG. 23 is a diagram illustrating the functional configuration of a frequency domain parameter sequence generating apparatus in a fifth embodiment.

A frequency domain parameter sequence generating apparatus 10 according to the fifth embodiment includes a parameter sequence converting unit 20 for example, as shown in FIG. 23, and receives frequency domain parameters ω[1], ω[2], . . . , ω[p] as input and outputs converted frequency domain parameters ~ω[1], ~ω[2], . . . , ~ω[p].

The frequency domain parameters ω[1], ω[2], . . . , ω[p] to be input are a frequency domain parameter sequence derived from linear prediction coefficients, a[1], a[2], . . . , a[p], which are obtained by linear prediction analysis of sound signals in a predetermined time segment. The frequency domain parameters ω[1], ω[2], . . . , ω[p] may be an LSP parameter sequence θ[1], θ[2], . . . , θ[p] used in conventional encoding methods, or a quantized LSP parameter sequence $\hat{\theta}[1], \hat{\theta}[2], \ldots, \hat{\theta}[p]$, for example. Alternatively, they may be the adjusted LSP parameter sequence $\theta_{\gamma R}[1], \theta_{\gamma R}[2], \ldots, \hat{\theta}_{\gamma R}[p]$ or the adjusted quantized LSP parameter sequence $\hat{\theta}_{\gamma R}[1], \hat{\theta}_{\gamma R}[2], \ldots, \hat{\theta}_{\gamma R}[p]$ used in the aforementioned embodiments, for example. Further, they may be frequency domain parameters equivalent to LSP parameters, such as the ISP parameter sequence described in the modification above, for example. A frequency domain parameter sequence derived from linear prediction coefficients a[1], a[2], . . . , a[p] are a series in the frequency domain derived from a linear prediction coefficient sequence and represented by the same number of elements as the order of prediction, typified by an LSP parameter sequence, an ISP parameter sequence, an LSF parameter sequence, or an ISF parameter sequence each derived from the linear prediction coefficient sequence a[1], a[2], . . . , a[p], or a frequency domain parameter sequence in which all of the frequency domain parameters ω[1], ω[2], . . . , ω[p−1] are present from 0 to π and, when all of the linear prediction coefficients contained in the linear prediction coefficient sequence are 0, the frequency domain parameters ω[1], ω[2], . . . , ω[p−1] are present from 0 to π at equal intervals.

The parameter sequence converting unit 20, similarly to the LSP linear transformation unit 300 and the decoded LSP linear transformation unit 400, applies approximate linear transformation to the frequency domain parameter sequence ω[1], ω[2], . . . , ω[p−1] making use of the nature of LSP parameters to generate a converted frequency domain parameter sequence ~ω[1], ~ω[2], . . . , ~ω[p]. The parameter sequence converting unit 20 determines the value of the converted frequency domain parameter ~ω[i] according to one of the methods shown below for each i=1, 2, . . . , p, for example.

1. The value of the converted frequency domain parameter ~ω[i] is determined by linear transformation which is based on the relationship of values between ω[i] and one or more frequency domain parameters adjacent to ω[i]. For instance, linear transformation is performed so that the intervals between parameter values becomes more uniform or less uniform in the converted frequency domain parameter sequence ~ω[i] than in the frequency domain parameter sequence ω[i]. Linear transformation that makes the parameter interval more uniform corresponds to processing that flats the waves of the amplitude of the power spectral envelope in the frequency domain (processing for smoothing the power spectral envelope). Linear transformation that makes the parameter interval less uniform corresponds to processing that emphasizes the height difference in the waves of the amplitude of the power spectral envelope in the frequency domain (processing for unsmoothing the power spectral envelope).

2. When ω[i] is closer to ω[i+1] relative to the midpoint between ω[i+1] and ω[i−1], then ~ω[i] is determined so that ~ω[i] will be closer to ~ω[i+1] relative to the midpoint between ~ω[i+1] and ~ω[i−1] and that the value of ~ω[i+1]−~ω[i] will be smaller than ω[i+1]−ω[i]. When ω[i] is closer to ω[i−1] relative to the midpoint between ω[i+1] and ω[i−1], then ~ω[i] is determined so that ~ω[i] will be closer to ~ω[i−1] relative to the midpoint between ~ω[i+1] and ~ω[i−1] and that the value of ~ω[i]−~ω[i−1] will be smaller than ω[i]−ω[i−1]. This corresponds to processing that emphasizes the height difference in the waves of the amplitude of the power spectral envelope in the frequency domain (processing for unsmoothing the power spectral envelope).

3. When ω[i] is closer to ω[i+1] relative to the midpoint between ω[i+1] and ω[i−1], then ~ω[i] is determined so that ~ω[i] will be closer to ~ω[i+1] relative to the midpoint between ~ω[i+1] and ~ω[i−1] and that the value of ~ω[i+1]−~ω[i] will be greater than ω[i+1]−ω[i]. When ω[i] is closer to ω[i−1] relative to the midpoint between ω[i+1] and ω[i−1], then ~ω[i] is determined so that ~ω[i] will be closer to ~ω[i−1] relative to the midpoint between ~ω[i+1] and ~ω[i−1] and that the value of ~ω[i]−~ω[i−1] will be greater than ω[i]−ω[i−1]. This corresponds to processing that flats the waves of the amplitude of the power spectral envelope in the frequency domain (processing for smoothing the power spectral envelope).

For example, the parameter sequence converting unit 20 determines the converted frequency domain parameters ~ω[1], ~ω[2], . . . , ~ω[p] according to Formula (20) below and outputs it.

$$\begin{pmatrix} \tilde{\omega}[1] \\ \tilde{\omega}[2] \\ \vdots \\ \tilde{\omega}[p] \end{pmatrix} = K \begin{pmatrix} \omega[1] - \dfrac{\pi}{p+1} \\ \omega[2] - \dfrac{2\pi}{p+1} \\ \vdots \\ \omega[p] - \dfrac{p\pi}{p+1} \end{pmatrix} (\gamma 2 - \gamma 1) + \begin{pmatrix} \omega[1] \\ \omega[2] \\ \vdots \\ \omega[p] \end{pmatrix} \tag{20}$$

Here, γ1 and γ2 are positive coefficients equal to or smaller than 1. Formula (20) can be derived by setting $\Theta_{\gamma 1}=(\omega[1], \omega[2], \ldots, \omega[p])^T$ and $\Theta_{\gamma 2}=(\sim\omega[1], \sim\omega[2], \ldots, \sim\omega[p])^T$ in Formula (13), which models LSP parameters, and defining $$\Theta_{\gamma=0} = \left(\frac{\pi}{p+1}, \frac{2\pi}{p+1}, \ldots, \frac{p\pi}{p+1}\right).$$

In this case, frequency domain parameters ω[1], ω[2], . . . , ω[p] are a frequency-domain parameter sequence or the quantized values thereof equivalent to $$a[1]\times(\gamma 1),\ a[2]\times(\gamma 1)^2, \ldots, a[p]\times(\gamma 1)^p,$$

which is a coefficient sequence that has been adjusted by multiplying each coefficient a[i] of the linear prediction coefficients a[1], a[2], . . . , a[p] by the ith power of the factor γ1. The converted frequency domain parameters ~ω[1], ~ω[2], . . . , ~ω[p] are a series that approximates a frequency-domain parameter sequence equivalent to $$a[1]\times(\gamma 2),\ a[2]\times(\gamma 2)^2, \ldots, a[p]\times(\gamma 2)^p,$$

which is a coefficient sequence that has been adjusted by multiplying each coefficient a[i] of the linear prediction coefficients a[1], a[2], . . . , a[p] by the ith power of factor γ2.

<Effects of the Fifth Embodiment>

As with the encoding apparatuses 3, 5, 7, 8 or the decoding apparatuses 4, 6, the frequency domain parameter sequence generating apparatus in the fifth embodiment is able to determine converted frequency domain parameters from frequency domain parameters with a smaller amount of calculation than when converted frequency domain parameters are determined from frequency domain parameters by way of linear prediction coefficients as in the encoding apparatus 1 and the decoding apparatus 2.

The present invention is not limited to the above-described embodiments and it goes without saying that modifications may be made as necessary without departing from the scope of the invention. The various kinds of processing illustrated in the embodiments above could also be performed in parallel or separately in accordance with the processing capability of the device executing them or certain necessity in addition to being carried out chronologically in the orders described herein.

[Program and Recording Media]

When the various processing functions of the apparatuses described in the embodiments are implemented by a computer, the processing details of the functions supposed to be provided in the apparatuses are described by a program. The program is then executed by the computer so as to implement various processing functions of the individual apparatuses on the computer.

A program describing the processing details can be recorded in a computer-readable recording medium. The computer-readable recording medium may be any kind of media, such as a magnetic recording device, optical disk, magneto-optical recording medium, and semiconductor memory, for example.

Such a program may be distributed by selling, granting, or lending a portable recording medium, such as a DVD or CD-ROM for example, having the program recorded thereon. Alternatively, the program may be stored in a storage device at a server computer and transferred to other computers from the server computer over a network so as to distribute the program When a computer is to execute such a program, the computer first stores the program recorded on a portable recording medium or the program transferred from the server computer once in its own storage device, for example. Then, when it carries out processing, the computer reads the program stored in its recording medium and performs processing in accordance with the program that has been read. As an alternative form of execution of the program, the computer may directly read the program from a portable recording medium and perform processing in accordance with the program, or the computer may perform processing sequentially in accordance with a program it has received every time a program is transferred from the server computer to the computer. The above-described processing may also be implemented as a so-called application service provider (ASP) service, which implements processing functions only through requests for execution and acquisition of results without transfer of programs from a server computer to a computer. Programs in the embodiments described herein are intended to contain information that is used in processing by an electronic computer and subordinate to programs (such as data that is not a direct instruction on a computer but has properties governing the processing of the computer).

Additionally, while the apparatuses of the present invention have been described as being implemented through execution of predetermined programs on computer in such embodiments, at least part of these processing details may also be implemented by hardware.

What is claimed is:

1. A decoding method, implemented by a decoding apparatus having processing circuitry, comprising:

where p is an integer equal to or greater than 1, decoding, by the processing circuitry, input adjusted LSP codes to obtain a decoded adjusted LSP parameter sequence $\hat{\theta}_\gamma[1], \hat{\theta}_\gamma[2], \ldots, \hat{\theta}_\gamma[p]$;

with a frequency domain parameter sequence $\omega[1], \omega[2], \ldots, \omega[p]$ being the decoded adjusted LSP parameter sequence $\hat{\theta}_\gamma[1], \hat{\theta}_\gamma[2], \ldots, \hat{\theta}_\gamma[p]$, executing, by the processing circuitry, a parameter sequence conversion step of determining a converted frequency domain parameter sequence $\sim\omega[1], \sim\omega[2], \ldots, \sim\omega[p]$ using the frequency domain parameter sequence $\omega[1], \omega[2], \ldots, \omega[p]$ as input to thereby generate the converted frequency domain parameter sequence $\sim\omega[1], \sim\omega[2], \ldots, \sim\omega[p]$ as a decoded approximate LSP parameter sequence $\hat{\theta}_{app}[1], \hat{\theta}_{app}[2], \ldots, \hat{\theta}_{app}[p]$;

generating, by the processing circuitry, a decoded adjusted linear prediction coefficient sequence $\hat{a}_\gamma[1], \hat{a}_\gamma[2], \ldots, \hat{a}_\gamma[p]$ by converting the decoded adjusted LSP parameter sequence $\hat{\theta}_\gamma[1], \hat{\theta}_\gamma[2], \ldots, \hat{\theta}_\gamma[p]$ into linear prediction coefficients;

calculating, by the processing circuitry, a decoded smoothed power spectral envelope series $\hat{W}_{65}[1], \hat{W}_\gamma[2], \ldots, \hat{W}_\gamma[N]$ which is a series in frequency domain corresponding to the decoded adjusted linear prediction coefficient sequence $\hat{a}_\gamma[1], \hat{a}_\gamma[2], \ldots, \hat{a}_\gamma[p]$;

generating, by the processing circuitry, decoded sound signals using a frequency domain signal sequence resulting from decoding of input frequency domain signal codes and the decoded smoothed power spectral envelope series $\hat{W}_\gamma[1], \hat{W}_\gamma[2], \ldots, \hat{W}_\gamma[N]$;

decoding, by the processing circuitry, input LSP codes to obtain a decoded LSP parameter sequence $\hat{\theta}[1], \hat{\theta}[2], \ldots, \hat{\theta}[p]$; and decoding, by the processing circuitry, input time domain signal codes, and generating decoded sound signals by synthesizing the time domain signal codes using either the decoded LSP parameter sequence for a preceding time segment or the decoded approximate LSP parameter sequence for the preceding time segment, and the decoded LSP parameter sequence for the predetermined time segment, wherein the processing circuitry determines a value of each converted frequency domain parameter $\sim\omega[i]$ ($i=1, 2, \ldots, p$) in the converted frequency domain parameter sequence $\sim\omega[1], \sim\omega[2], \ldots, \sim\omega[p]$ through linear transformation which is based on a relationship of values between $\omega[i]$ and one or more frequency domain parameters adjacent to $\omega[i]$.

2. A decoding method, implemented by a decoding apparatus having processing circuitry, comprising:

where p is an integer equal to or greater than 1, decoding, by the processing circuitry, input adjusted LSP codes to obtain a decoded adjusted LSP parameter sequence $\hat{\theta}_\gamma[1], \hat{\theta}_\gamma[2], \ldots, \hat{\theta}_\gamma[p]$;

with a frequency domain parameter sequence $\omega[1], \omega[2], \ldots, \omega[p]$ being the decoded adjusted LSP parameter sequence $\hat{\theta}_\gamma[1], \hat{\theta}_\gamma[2], \ldots, \hat{\theta}_\gamma[p]$, executing, by the processing circuitry, a parameter sequence conversion step of determining a converted frequency domain parameter sequence $\sim\omega[1], \sim\omega[2], \ldots, \sim\omega[p]$ using the frequency domain parameter sequence $\omega[1], \omega[2], \ldots, \omega[p]$ as input to thereby generate the converted frequency domain parameter sequence $\sim\omega[1], \sim\omega[2], \ldots, \sim\omega[p]$ as a decoded approximate LSP parameter sequence $\hat{\theta}_{app}[1], \hat{\theta}_{app}[2], \ldots, \hat{\theta}_{app}[p]$;

calculating, by the processing circuitry, a decoded smoothed power spectral envelope series $\hat{W}_\gamma[1], \hat{W}_\gamma[2], \ldots, \hat{W}_\gamma[N]$ based on the decoded adjusted LSP parameter sequence $\hat{\theta}_\gamma[1], \hat{\theta}_\gamma[2], \ldots, \hat{\theta}_\gamma[p]$;

generating, by the processing circuitry, decoded sound signals using a frequency domain signal sequence resulting from decoding of input frequency domain signal codes and the decoded smoothed power spectral envelope series $\hat{W}_\gamma[1], \hat{W}_\gamma[2], \ldots, \hat{W}_\gamma[N]$;

decoding, by the processing circuitry, input LSP codes to obtain a decoded LSP parameter sequence $\hat{\theta}[1], \hat{\theta}[2], \ldots, \hat{\theta}[p]$; and decoding, by the processing circuitry, input time domain signal codes, and generating decoded sound signals by synthesizing the time domain signal codes using either the decoded LSP parameter sequence for a preceding time segment or the decoded approximate LSP parameter sequence for the preceding time segment, and the decoded LSP parameter sequence for the predetermined time segment, wherein the processing circuitry determines a value of each converted frequency domain parameter $\sim\omega[i]$ (i=1, 2, . . . , p) in the converted frequency domain parameter sequence $\sim\omega[1], \sim\omega[2], \ldots, \sim\omega[p]$ through linear transformation which is based on a relationship of values between $\omega[i]$ and one or more frequency domain parameters adjacent to $\omega[i]$.

3. A decoding apparatus comprising:

where p is an integer equal to or greater than 1, an adjusted LSP code decoding unit that decodes input adjusted LSP codes to obtain a decoded adjusted LSP parameter sequence $\hat{\theta}_\gamma[1], \hat{\theta}_\gamma[2], \ldots, \hat{\theta}_\gamma[p]$;

a decoded LSP linear transformation unit that, with a frequency domain parameter sequence $\omega[1], \omega[2], \ldots, \omega[p]$ being the decoded adjusted LSP parameter sequence $\hat{\theta}_\gamma[1], \hat{\theta}_\gamma[2], \ldots, \hat{\theta}_\gamma[p]$, executes a parameter sequence converting unit of determining a converted frequency domain parameter sequence $\sim\omega[1], \sim\omega[2], \ldots, \sim\omega[p]$ using the frequency domain parameter sequence $\omega[1], \omega[2], \ldots, \omega[p]$ as input to thereby generate the converted frequency domain parameter sequence $\sim\omega[1], \sim\omega[2], \ldots, \sim\omega[p]$ as a decoded approximate LSP parameter sequence $\hat{\theta}_{app}[1], \hat{\theta}_{app}[2], \ldots, \hat{\theta}_{app}[p]$;

a decoded linear prediction coefficient sequence generating unit that generates a decoded adjusted linear prediction coefficient sequence $\hat{a}_\gamma[1], \hat{a}_\gamma[2], \ldots, \hat{a}_\gamma[p]$ by converting the decoded adjusted LSP parameter sequence $\hat{\theta}_\gamma[1], \hat{\theta}_\gamma[2], \ldots, \hat{\theta}_\gamma[p]$ into linear prediction coefficients;

a decoded smoothed power spectral envelope series calculating unit that calculates a decoded smoothed power spectral envelope series $\hat{W}_\gamma[1], \hat{W}_\gamma[2], \ldots, \hat{W}_\gamma[N]$ which is a series in frequency domain corresponding to the decoded adjusted linear prediction coefficient sequence $\hat{a}_{65}[1], \hat{a}_\gamma[2], \ldots, \hat{a}_\gamma[p]$;

a frequency domain decoding unit that generates decoded sound signals using a frequency domain signal sequence resulting from decoding of input frequency domain signal codes and the decoded smoothed power spectral envelope series $\hat{W}_\gamma[1], \hat{W}_\gamma[2], \ldots, \hat{W}_\gamma[N]$;

an LSP code decoding unit that decodes input LSP codes to obtain a decoded LSP parameter sequence $\hat{\theta}[1], \hat{\theta}[2], \ldots, \hat{\theta}[p]$; and a time domain decoding unit that decodes input time domain signal codes, and generates decoded sound signals by synthesizing the time domain signal codes using either the decoded LSP parameter sequence obtained by the LSP code decoding unit for a preceding time segment or the decoded approximate LSP parameter sequence obtained in the decoded LSP linear transformation unit for the preceding time segment, and the decoded LSP parameter sequence for the predetermined time segment, wherein the parameter sequence conversion unit determines a value of each converted frequency domain parameter $\sim\omega[i]$ (i=1, 2, . . . , p) in the converted frequency domain parameter sequence $\sim\omega[1], \sim\omega[2], \ldots, \sim\omega[p]$ through linear transformation which is based on a relationship of values between $\omega[i]$ and one or more frequency domain parameters adjacent to $\omega[i]$.

4. A decoding apparatus comprising:

where p is an integer equal to or greater than 1, an adjusted LSP code decoding unit that decodes input adjusted LSP codes to obtain a decoded adjusted LSP parameter sequence $\hat{\theta}_\gamma[1], \hat{\theta}_\gamma[2], \ldots, \hat{\theta}_\gamma[p]$;

a decoded LSP linear transformation unit that, with a frequency domain parameter sequence $\omega[1], \omega[2], \ldots, \omega[p]$ being the decoded adjusted LSP parameter sequence $\hat{\theta}_\gamma[1], \hat{\theta}_\gamma[2], \ldots, \hat{}_\gamma[p]$, executes a parameter sequence converting unit of determining a converted frequency domain parameter sequence $\sim\omega[1], \sim\omega[2], \ldots, \sim\omega[p]$ using the frequency domain parameter sequence $\omega[1], \omega[2], \ldots, \omega[p]$ as input to thereby generate the converted frequency domain parameter sequence $\sim\omega[1], \sim\omega[2], \ldots, \sim\omega[p]$ as a decoded approximate LSP parameter sequence $\hat{\theta}_{app}[1], \hat{\theta}_{app}[2], \ldots, \hat{\theta}_{app}[p]$;

a decoded smoothed power spectral envelope series calculating unit that calculates a decoded smoothed power spectral envelope series $\hat{W}_\gamma[1], \hat{W}_\gamma[2], \ldots, \hat{W}_\gamma[N]$ based on the decoded adjusted LSP parameter sequence $\hat{\theta}_\gamma[1], \hat{\theta}_\gamma[2], \ldots, \hat{\theta}_\gamma[p]$;

a frequency domain decoding unit that generates decoded sound signals using a frequency domain signal sequence resulting from decoding of input frequency domain signal codes and the decoded smoothed power spectral envelope series $\hat{W}_\gamma[1], \hat{W}_\gamma[2], \ldots, \hat{W}_\gamma[N]$;

an LSP code decoding unit that decodes input LSP codes to obtain a decoded LSP parameter sequence $\hat{\theta}[1], \hat{\theta}[2], \ldots, \hat{\theta}[p]$; and an time domain decoding unit that decodes input time domain signal codes, and generates decoded sound signals by synthesizing the time domain signal codes using either the decoded LSP parameter sequence obtained in the LSP code decoding unit for a preceding time segment or the decoded approximate LSP parameter sequence obtained in the decoded LSP linear transformation unit for the preceding time segment, and the decoded LSP parameter sequence for the predetermined time segment, wherein the parameter sequence conversion unit determines a value of each converted frequency domain parameter $\sim\omega[i]$ (i=1, 2, . . . , p) in the converted frequency domain parameter sequence $\sim\omega[1], \sim\omega[2], \ldots, \sim\omega[p]$ through linear transformation which is based on a relationship of values between $\omega[i]$ and one or more frequency domain parameters adjacent to $\omega[i]$.

5. A non-transitory computer-readable recording medium having a program recorded thereon for causing a computer to carry out the steps of the decoding method according to claim 1 or 2.

* * * * *